US007311378B2

(12) United States Patent
Fujimori et al.

(10) Patent No.: US 7,311,378 B2
(45) Date of Patent: Dec. 25, 2007

(54) WIPING APPARATUS AND IMAGING APPARATUS PROVIDED THEREWITH, METHOD OF MANUFACTURING ELECTRO-OPTICAL DEVICE, ELECTRO-OPTICAL DEVICE, AND ELECTRONIC APPARATUS

(75) Inventors: Kazuyoshi Fujimori, Suwa (JP); Koichiro Komatsu, Suwa (JP); Toru Shirasaki, Suwa (JP)

(73) Assignee: Seiko Epson Corporation (JP)

( * ) Notice: Subject to any disclaimer, the term of this patent is extended or adjusted under 35 U.S.C. 154(b) by 329 days.

(21) Appl. No.: 11/062,209

(22) Filed: Feb. 21, 2005

(65) Prior Publication Data

US 2005/0162461 A1 Jul. 28, 2005

(30) Foreign Application Priority Data

Jan. 22, 2004 (JP) ..... 2004-014723
Oct. 13, 2004 (JP) ..... 2004-299435

(51) Int. Cl.
*B41J 2/165* (2006.01)
*B41J 29/13* (2006.01)

(52) U.S. Cl. ..... 347/33; 347/28; 347/32; 347/108

(58) Field of Classification Search ..... 347/22–36, 347/108
See application file for complete search history.

(56) References Cited

U.S. PATENT DOCUMENTS 5,905,514 A * 5/1999 Rhoads et al. ..... 347/33
6,692,100 B2 * 2/2004 Steinfield et al. ..... 347/22
7,073,886 B2 * 7/2006 Nakamura ..... 347/33

FOREIGN PATENT DOCUMENTS

JP 10-146984 6/1998
JP 2003-127405 5/2003
JP 2003-270426 9/2003
JP 2003-288030 10/2003
JP 2004-000841 1/2004

OTHER PUBLICATIONS

Communication from Japanese Patent Office re: related application.
Communication from Korean Patent Office re: related application.

* cited by examiner

*Primary Examiner*—Shih-Wen Hsieh
(74) *Attorney, Agent, or Firm*—Harness, Dickey & Pierce, P.L.C.

(57) ABSTRACT

A wiping apparatus has a cover box which covers at least a feeding reel, a take-up reel, a wiping member and a spray head, as well as a sheet-feeding passage for the wiping sheet. The passage extends from the feeding reel to the take-up reel. The cover box has formed therein a member opening through which the wiping member protrudes.

6 Claims, 35 Drawing Sheets

WIPING APPARATUS AND IMAGING APPARATUS PROVIDED THEREWITH, METHOD OF MANUFACTURING ELECTRO-OPTICAL DEVICE, ELECTRO-OPTICAL DEVICE, AND ELECTRONIC APPARATUS

RELATED APPLICATIONS

This application claims priority to Japanese Patent Application No. 2004-299435 filed Oct. 13, 2004 which is hereby incorporated by reference herein in its entirety. Applicant also incorporates by reference Japanese Patent Application No. 2004-014723 filed Jan. 22, 2004 in its entirety.

BACKGROUND OF THE INVENTION

1. Field of the Invention

This invention relates to a wiping apparatus for wiping a nozzle surface of a function (or functional) liquid droplet ejection (or discharge) head which ejects function liquid droplets, the wiping being performed by a wiping sheet which has been spread or coated with a cleaning liquid; an imaging apparatus which is provided with the wiping apparatus; a method of manufacturing an electro-optical device; an electro-optical device; and an electronic apparatus.

2. Description of the Related Art

The wiping apparatus is made up of: a feeding reel for feeding a wiping sheet; a take-up reel for taking up the fed reel; a wiping roller around which is wound the fed-out wiping sheet; and a take-up motor for driving the take-up roller. While the take-up motor is driven and the wiping sheet is fed, the wiping sheet is urged or pushed by the wiping roller against the nozzle surface of the function liquid droplet ejection head. The wiping sheet is thus brought into sliding contact with the nozzle surface, whereby the wiping operation is performed.

In the sheet feeding passage (or sheet feeding path) of the wiping sheet, there is disposed a cleaning liquid supply head in close proximity to the wiping roller. The wiping sheet is sprayed with a cleaning liquid right before wiping the nozzle surface. The wiping of the nozzle surface of the function liquid droplet ejection head is performed with a wiping sheet which is impregnated with the cleaning liquid.

While the cleaning liquid improves the efficiency of wiping of the nozzle surface, there is the following problem. Namely, if the wiping sheet is sprayed with an excessive amount of cleaning liquid, the cleaning liquid will find its way into the ejection nozzles which are open in the nozzle surface. As a result, the function liquid droplet ejection head cannot be maintained in an appropriate state any longer. As a solution, there is considered the following. Namely, the cleaning liquid supply head is constituted by a spray nozzle which is capable of spraying minute cleaning liquid particles, and the wiping sheet is supplied with a uniform and adequate amount of cleaning liquid. However, if the cleaning liquid is supplied to the wiping sheet with the spray nozzle, the cleaning liquid becomes partly atomized. As a consequence, the atomized particles are away from the wiping sheet and are kept in suspension or scattered. Depending on the cleaning liquids, they get adhered to the peripheral parts of the apparatus, or the like, to thereby cause corrosion thereof.

SUMMARY OF THE INVENTION

Accordingly, it is an object of this invention to provide a wiping apparatus in which the sprayed cleaning liquid can be effectively prevented from getting splashed or suspended outside the apparatus. This invention also provides an imaging apparatus provided with the wiping apparatus, a method of manufacturing an electro-optical device, an electro-optical device, and an electronic apparatus.

According to one aspect of this invention, there is provided a wiping apparatus for wiping a nozzle surface of a function liquid droplet ejection head by a wiping sheet coated with a cleaning liquid capable of dissolving a function liquid. The apparatus comprises: a feeding reel for feeding the wiping sheet; a spray head for spraying and coating the wiping sheet fed from the feeding reel with the cleaning liquid; a wiping member for causing the wiping sheet coated with the cleaning liquid to be urged against the nozzle surface of the function liquid droplet ejection head, thereby performing a wiping operation; a take-up reel for taking up the wiping sheet passing through the wiping member; a cover box covering at least the feeding reel, the take-up reel, the wiping member and the spray head, as well as a sheet-feeding passage for the wiping sheet, the passage extending from the feeding reel to the take-up reel through the wiping member; and an apparatus frame supporting the above-described constituting elements of the apparatus, wherein the cover box has formed therein a member opening through which the wiping member protrudes.

According to this arrangement, since the spray head for spraying the cleaning liquid, the wiping sheet to which the cleaning liquid is sprayed, and thereabout are covered by the cover box, the cleaning liquid can be effectively prevented from being suspended or splashed outside the cover box. In addition, since the cover box is provided with a member opening through which the wiping member can be protruded or projected. Therefore, the wiping work can be performed without removing the cover box.

Preferably, the apparatus further comprises an air-tight member for sealing a clearance between the member opening and the wiping member, the air-tight member being disposed along an edge of the member opening.

According to this arrangement, the air-tight member can prevent the sprayed cleaning liquid from getting splashed outside through the clearance between the member opening and the wiping member.

Preferably, the apparatus further comprises: a protruding/withdrawal mechanism for supporting the wiping member and also for causing the wiping member to be protruded or withdrawn from the member opening; an open/close lid for opening or closing the member opening; and a cover interlocking mechanism for closing the open/close lid in a manner interlocked with an withdrawing movement of the wiping member by the protruding/withdrawal mechanism.

According to this arrangement, there is provided an open/close lid to open or close the member opening in a manner interlocked with the protruding/withdrawal operation of the wiping member. Therefore, the member opening is left open only at the time of wiping operation, and thus the amount of cleaning liquid to be splashed outside through the member opening can be reduced. It is preferable to spray the cleaning liquid while the member opening is kept closed.

Preferably, the wiping member is disposed on an upper end, the spray head is disposed on an upper portion, and the feeding reel and the take-up reel are disposed on a lower portion of the apparatus, respectively, and the cover box comprises an upper covering part for covering the upper portion, and a lower covering part for covering the lower portion, respectively, of the apparatus. The upper covering part and the lower covering part are respectively detachably mounted on the apparatus frame.

According to this arrangement, the cover box is constituted by a plurality of parts and they are independently attached in a detachable manner. Therefore, at the time of maintenance, only the required portion may be removed for performing the maintenance work. For example, in performing maintenance of the spray head and therearound, only the upper cover part may be partly removed.

Preferably, the apparatus further comprises a carrier arm for supporting the spray head, and a head scanning mechanism for causing the spray head to perform spray-scanning in a widthwise direction of the wiping sheet. The upper covering part has formed therein a slit opening to which the carrier arm faces.

According to this arrangement, the slit opening allows the carrier arm to move. As a result, the spray head can be subjected to spray-scanning in the widthwise direction in the widthwise direction of the wiping sheet inside the cover box. Therefore, there is no need of preparing the spray head to suit the width of the wiping sheet.

Preferably, the cover box has a pair of side plates which lie parallel with each other, and at least one of the pair of side plates serves a dual purpose of the apparatus frame.

According to this arrangement, since at least one of the side plates of the cover box serves the dual purpose of the apparatus frame, the number of parts can be reduced.

Preferably, the cover box has connected thereto an exhaust passage communicated with an exhaust equipment.

According to this arrangement, that air inside the cover box which is mixed with the cleaning liquid can be discharged through the exhaust passage. Therefore, even in case the air-tightness of the cover box is insufficient, the cleaning liquid can be prevented from leaking outside.

Preferably, the apparatus further comprises a moistening apparatus disposed inside the cover box.

According to this arrangement, the moisture inside the cover box can be controlled by the moistening apparatus. Therefore, the evaporation of the cleaning liquid can be kept under control during the time in which the wiping sheet spread with the volatile cleaning liquid reaches the function liquid droplet ejection head.

Preferably, the apparatus further comprises a liquid receiving pan disposed at a bottom of the cover box to receive the cleaning liquid.

According to this arrangement, the liquid receiving pan provided at the bottom of the cover box can receive the cleaning liquid that has been sprayed away from the wiping sheet or the cleaning liquid dripping from the wiping sheet.

According to another aspect of this invention, there is provided an imaging apparatus comprising the above-described wiping apparatus and the function liquid droplet ejection head. While relatively moving the function liquid droplet ejection head with respect to a workpiece, the function liquid droplet ejection head is driven to thereby perform imaging on the workpiece with the function liquid droplet.

According to this arrangement, the imaging apparatus is provided with the wiping apparatus which is capable of preventing the cleaning liquid from being suspended and splashed. Therefore, without damaging the apparatus and pieces of equipment outside the cover box, an adequate amount of cleaning liquid can be supplied to the wiping sheet. As a result, the nozzle surface of the function liquid droplet ejection head can be wiped off by the wiping sheet that has been supplied with the cleaning liquid. In this manner, the function liquid droplet ejection head can be properly maintained.

According to still another aspect of this invention, there is provided a method of manufacturing an electro-optical device by using the above-described imaging apparatus. The method comprises forming a film-forming portion on the workpiece by the function liquid droplet. There is also provided an electro-optical device comprising a film-forming portion formed on the workpiece by using the above-described imaging apparatus.

According to the above arrangement, the electro-optical device is manufactured by using the imaging apparatus which is capable of adequately maintaining the function liquid droplet ejection head and which is capable of preventing the cleaning liquid from being splashed. Therefore, an efficient manufacturing becomes possible. As the electro-optical device, there can be listed a liquid crystal display device, an organic electroluminescence (EL) device, an electron emission device, a plasma display panel (PDP) device, an electrophoretic display device, or the like. The electron emission device is a concept inclusive of a so-called field emission display (FED) device and a surface conduction electron-emitter display (SED) device. Further, as the electro-optical device, there can be listed a device inclusive of metallic wiring formation, lens formation, resist formation, light diffusion member formation, or the like.

According to another aspect of this invention, there is provided an electronic apparatus manufactured by the above-described method of manufacturing an electro-optical device, or having mounted thereon the above-described electro-optical device.

As the electronic apparatus, there can be listed a cellular phone, a personal computer and other electric appliances.

As described above, since the wiping apparatus according to this invention can prevent the cleaning liquid from getting suspended or splashed, the cleaning liquid does not adhere to the apparatus outside the cover box. Therefore, the damages to the apparatus due to the adhesion of the function liquid can be prevented.

In addition, the imaging apparatus according to this invention can prevent the corrosion, or the like, due to the cleaning liquid splashed from the wiping apparatus and, also the function liquid droplet ejection head can be adequately maintained. Therefore, the maintenance efficiency is high and the imaging accuracy is also high. Further, since the method of manufacturing an electro-optical device and an apparatus therefor according to this invention uses the above-described imaging apparatus, the device can be efficiently manufactured.

BRIEF DESCRIPTION OF THE DRAWINGS

The above and other objects and the attendant features of this invention will become readily apparent by reference to the following detailed description when considered in conjunction with the accompanying drawings wherein:

FIGS. 5A and 5B are explanatory views of a pressure regulating valve in which FIG. 5A is an perspective external view thereof and FIG. 5B is a vertical sectional view thereof;

FIGS. 17A and 17B are side views of an open/close mechanism, in which FIG. 17A shows a state in which an open/close lid is closed, and FIG. 17B shows a state in which the open/close lid is left open;

DETAILED DESCRIPTION OF THE PREFERRED EMBODIMENTS

Description will now be made below about an imaging (or drawing) apparatus to which this invention is applied, with reference to the accompanying drawings. The imaging apparatus is intended to be assembled into a line for manufacturing so-called flat displays and is used for forming emitting elements, or the like, which constitute pixels of a color filter for a liquid crystal device, an organic electroluminescence (EL) device, or the like.

Figure 1:
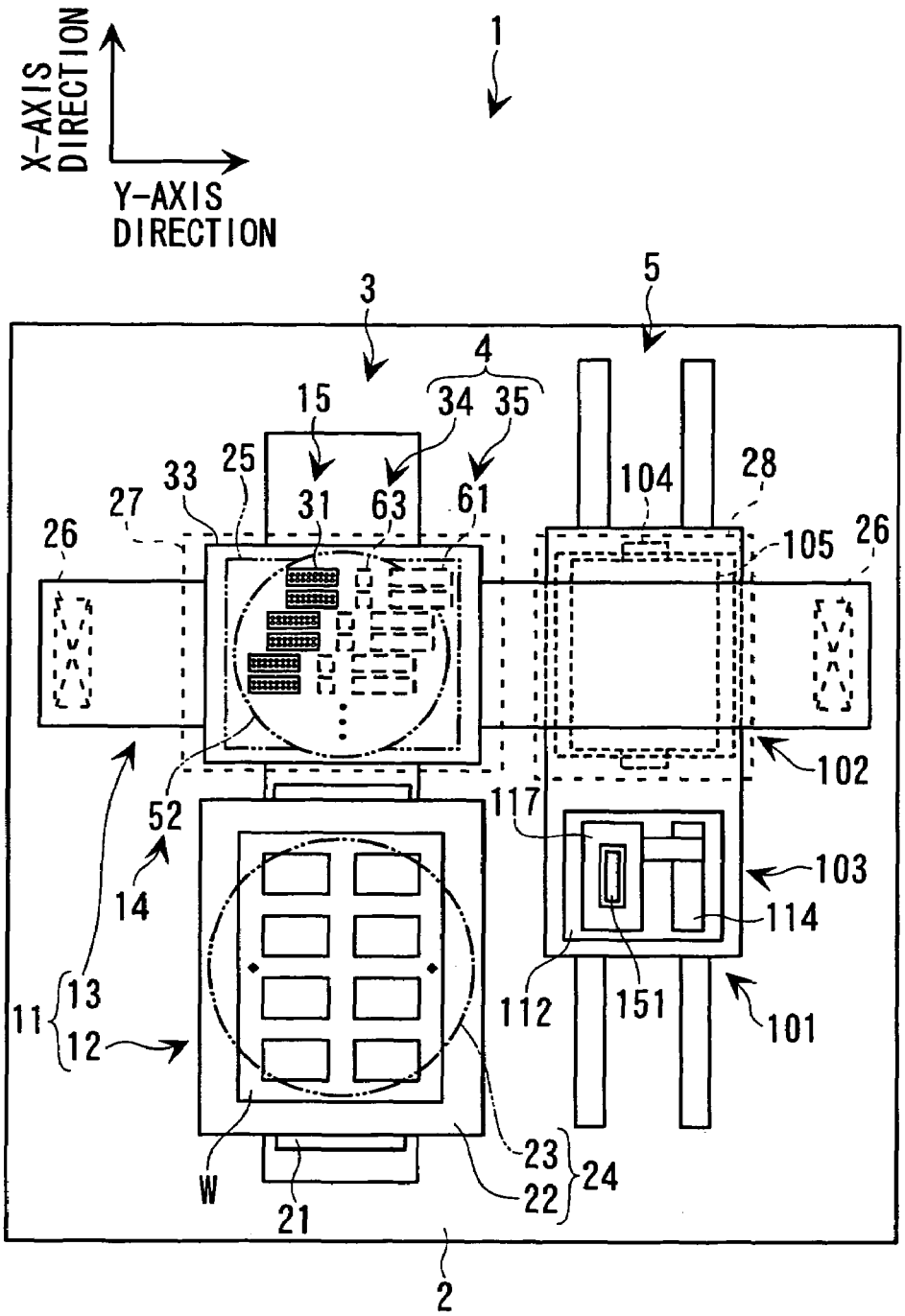
FIG. 1 is a schematic plan view of the imaging apparatus according to an embodiment of this invention.
Figure 2:
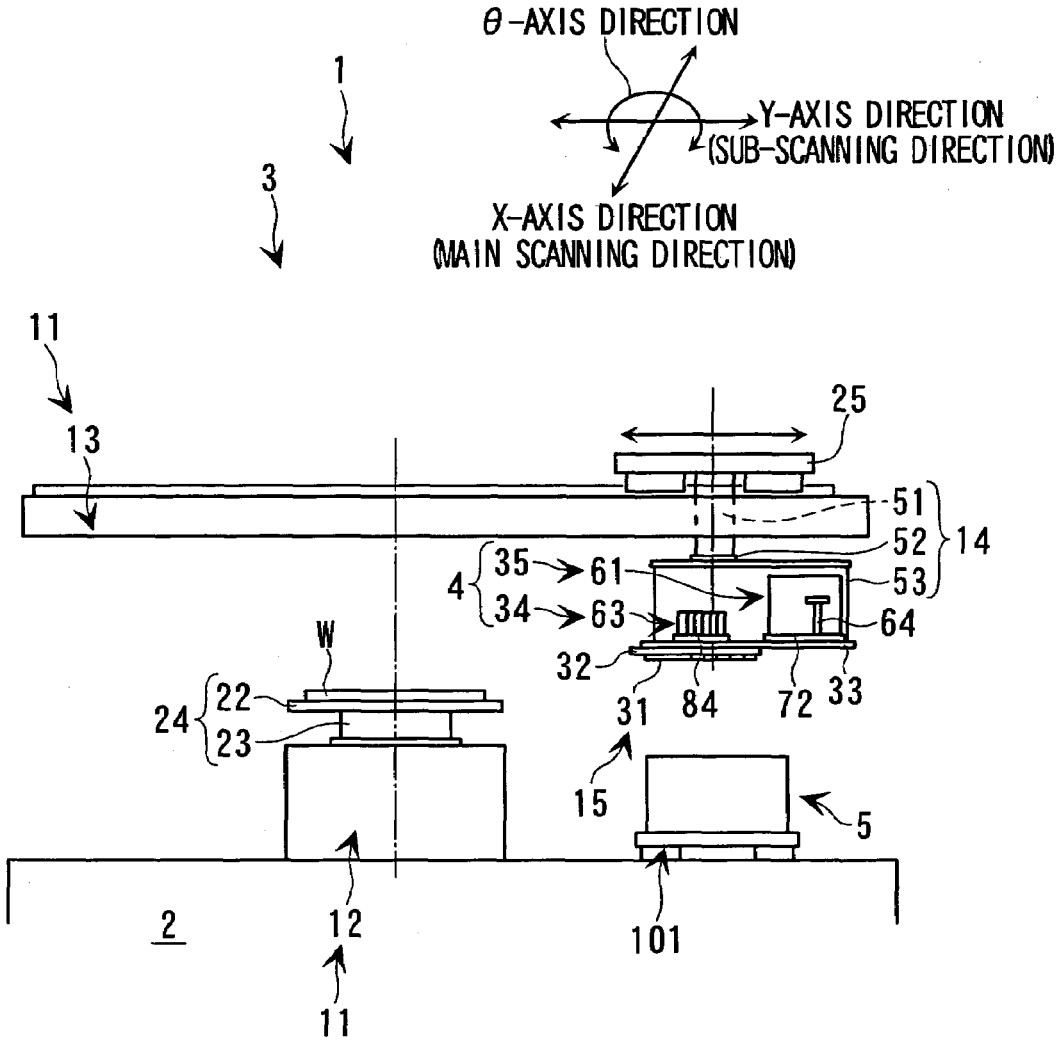
FIG. 2 is a schematic front view of the imaging apparatus according to the embodiment of this invention.

As shown in FIGS. 1 and 2, the imaging apparatus 1 is made up of: an apparatus base 2; a liquid droplet ejection apparatus 3 which has function liquid droplet ejection heads 31 and is mounted on an entire area of the apparatus base 2; a function liquid supply apparatus 4 which is connected to the liquid droplet ejection apparatus 3; and a head maintenance apparatus 5 which is mounted on the apparatus base 2 in a manner to lie adjacent to the liquid droplet ejection apparatus 3. The imaging apparatus 1 is further provided with a control apparatus 6 (not illustrated; see FIG. 12). The imaging apparatus 1 is thus so arranged that, while the liquid droplet ejection apparatus 3 keeps on receiving the supply of the function liquid from the function liquid supply apparatus 4, the liquid droplet ejection apparatus 3 performs imaging motion onto a workpiece W based on the control by the control apparatus 6. The head maintenance apparatus 5 performs maintenance work on the function liquid droplet ejection head 31 as required.

As shown therein, the liquid droplet ejection head 3 is made up of: an X/Y moving mechanism 11 which is constituted by an X-axis table 12 for performing main scanning (movement in the X-axis direction) of the workpiece W and a Y-axis table 13 which crosses the X-axis table 12 at right angles; a main carriage 14 which is mounted on the Y-axis table 13 in a freely movable manner; and a head unit 15 which is vertically provided in the main carriage 14 and has mounted thereon the function liquid droplet ejection head 31.

The X-axis table 12 is made up of: an X-axis slider 21 which is driven by an X-axis motor (not illustrated) which constitutes a driving system in the X-axis direction; and a setting table 24 which is constituted by a suction table 22 and Θ-table 23, or the like, and is mounted on the slider 21 in a freely movable manner. Similarly, the Y-axis table 13 is made up of: a Y-axis slider 25 which is driven by a Y-axis motor (not illustrated) which constitutes a driving system in the Y-axis direction; and the above-described main carriage 14 which is mounted on the Y-axis slider 25 in a manner movable in the Y-axis direction. The X-axis table 12 is disposed parallel to the X-axis and is directly supported on the apparatus base 2. On the other hand, the Y-axis table 13 is supported by right and left supporting columns 26 which are vertically disposed on the apparatus base 2, and is extended in the Y-axis direction so as to bridge over the X-axis table 12 and the head maintenance apparatus 5 (see FIG. 1).

In the imaging apparatus 1 of this embodiment, the area in which the X-axis table 12 and the Y-axis table 13 cross each other is defined as an imaging area 27 for performing the imaging on the workpiece W, and the area in which the Y-axis table 13 and the head maintenance apparatus 5 cross each other is defined as a maintenance area in which the processing for recovering the function is performed on the function liquid droplet ejection head 31. It follows that the head unit 15 is brought to face the imaging area 27 in performing the imaging work and is brought to the maintenance area 28 in performing the function recovery processing.

The head unit 15 is made up of: a plurality of (twelve) function liquid droplet ejection heads 31; and a head plate 32 for mounting thereon the function liquid droplet ejection heads 31 through a head supporting member (not illustrated). The head plate 32 is detachably supported by the supporting frame 33, and the head unit 15 is mounted on the main carriage 14 through the supporting frame 33 in an aligned state. On the supporting frame 33 are supported a valve unit 34 and a tank unit 35 for the function liquid supply apparatus 4 (details to be described hereinafter) in line with the head unit 15 (see FIGS. 2 and 3). In the following description, elements or members which are present in a plurality of numbers may sometimes be referred to as a single element or member. If that is the case, it is only for the purpose of simplifying the description by referring to a representative one out of many, and shall be construed accordingly.

Figure 4:
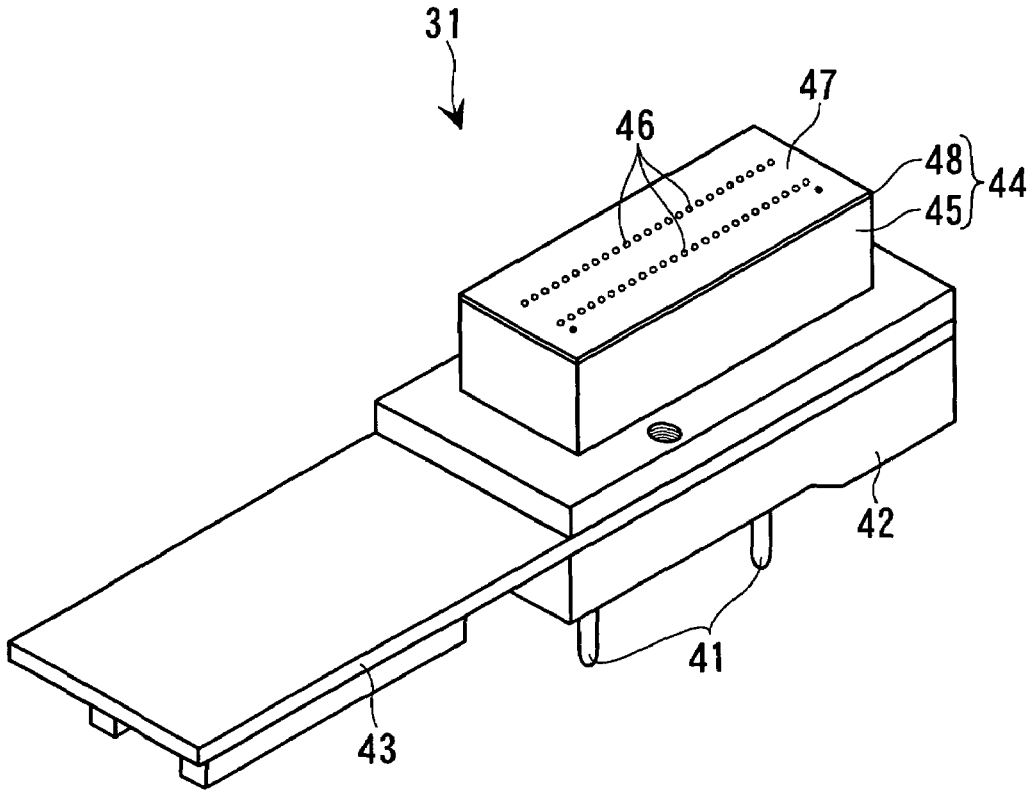
FIG. 4 is a perspective external view showing the function liquid droplet ejection head.

As shown in FIG. 4, the function liquid droplet ejection head 31 is of a so-called twin type and is made up of: a function liquid introduction part 42 which has twin connecting needles 41; a twin head substrate 43 which is connected to the function liquid introduction part 42; and a head main body 44 which is connected to the bottom side of the function liquid introduction part 42 and has formed therein in-head flow passages which are filled with the function liquid. The connection needles 41 are connected to the function liquid supply apparatus 4 to supply the in-head flow passages of the function liquid droplet ejection head 31 with the function liquid. The head main body 44 is made up of: a cavity 45 (piezoelectric element); and a nozzle plate 48 having a nozzle surface 47 in which ejection nozzles 46 are opened. The nozzle surface 47 has formed therein two rows of nozzle arrays each having a large number of (180) ejection nozzles 46. Although not illustrated, the nozzle surface 47 has formed therein shallow grooves so as to enclose the nozzle arrays. The nozzles are opened into these shallow grooves. When the function liquid droplet ejection head 31 is driven for ejection, the function liquid is ejected from the ejection nozzles 46 through the pumping function of the cavity 45.

The head plate 32 is made of a thick rectangular plate such as stainless steel, or the like, having a corrosion resistance to the function liquid. The head plate 32 has formed therein twelve mounting openings (not illustrated) through which the twelve function liquid droplet ejection heads 31 are positioned (or aligned) through the head holding member from the rear side. The twelve mounting openings are divided into six sets, each having two. The mounting openings for the respective sets are formed in a manner deviated in a direction of crossing at right angles with the nozzle array of the function liquid droplet ejection heads 31 (i.e., in the longitudinal direction of the head plate 32). Namely, the twelve function liquid droplet ejection heads 31 are divided into six sets of two each and are disposed in a stepped manner so as to constitute an imaging line (partly overlapped) of each set of the function liquid droplet ejection heads 31 in a direction crossing the nozzle array at right angles (see FIG. 3).

The two nozzle arrays formed in each of the function liquid droplet ejection heads 31 are constituted by a large number of (180) ejection nozzles 46 which are disposed at a pitch of 4 dots. Both nozzle arrays are disposed while deviating by two dots in the array direction. Namely, each of the function liquid droplet ejection heads 31 has formed imaging lines of two-dot pitch by the two rows of the nozzle arrays. On the other hand, the adjacent two function liquid droplet ejection heads 31 belonging to one set are disposed such that the respective imaging lines (of two-dot pitch) are displaced in the array direction by one dot. An imaging line of one dot-pitch is thus formed by one set of the function liquid droplet ejection heads 31. In other words, the two function liquid droplet ejection heads 31 of one set are disposed such that each nozzle array of ¼ resolution mutually deviates in position and, in combination with the remaining ten function liquid droplet ejection heads of the remaining five sets, constitute high-resolution nozzle arrays of one imaging line.

The main carriage 14 is made up of: a suspending member 51 of "I" shape in external appearance which is fixed to the Y-axis table 13 from the lower side thereof; a Θ-rotation mechanism 52 which performs positional rectification of the head unit 15 in the Θ direction; and a carriage main body 53 which is attached in a suspending manner to the lower side of the Θ-rotation mechanism 52. The carriage main body 53 is arranged to support the head unit 15 through the supporting frame 33 (see FIG. 2). Although not illustrated, the carriage main body 53 has formed therein a rectangular opening for loosely fitting therethrough the supporting frame 33, and is provided with a positioning mechanism for positioning the supporting frame 33. It is thus so arranged that the head unit 15 can be fixed in a positioned (or aligned) state.

Figure 3:
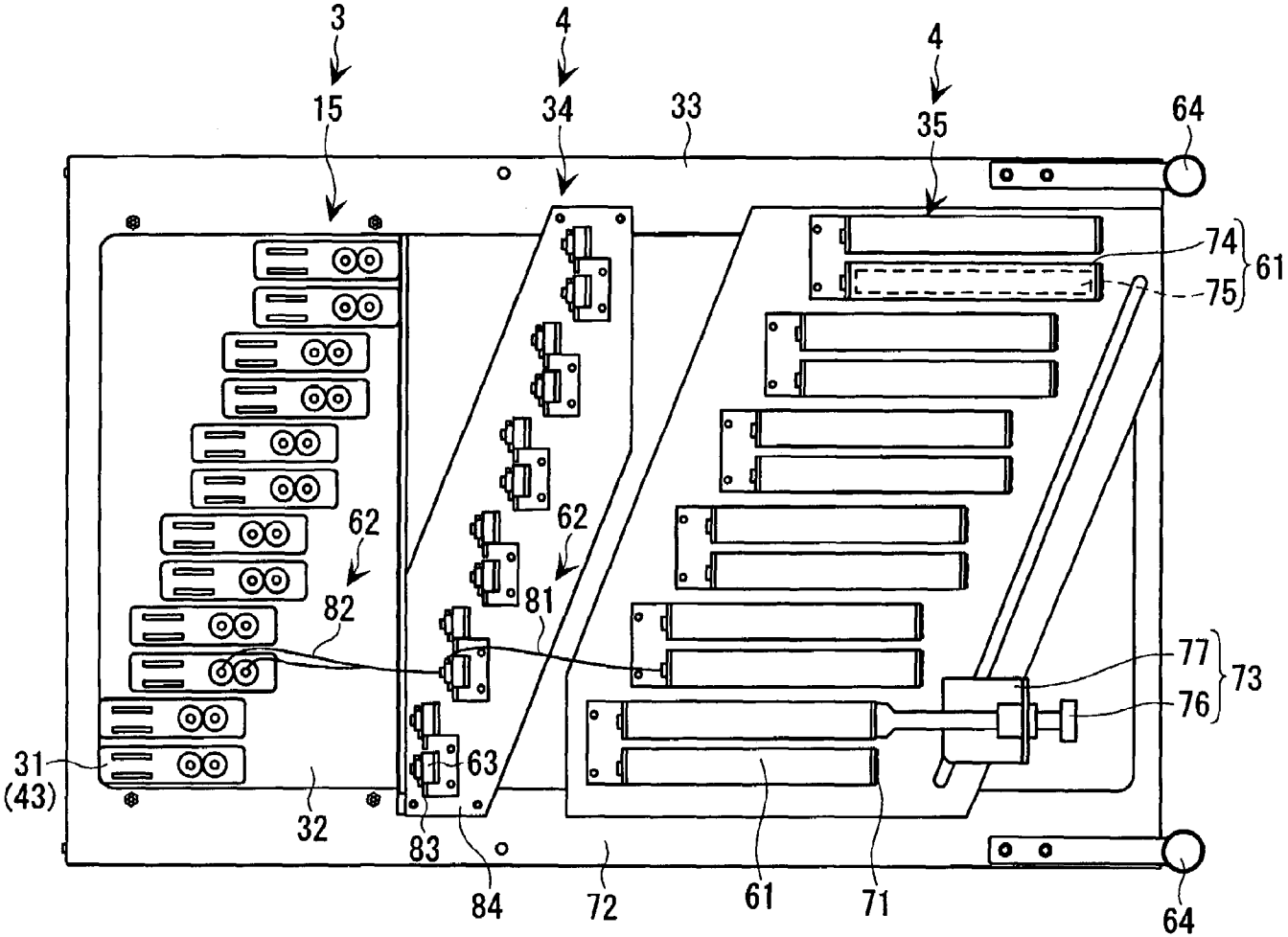
FIG. 3 is a schematic plan view of the supporting frame.

As shown in FIGS. 1 through 3, the function liquid supply apparatus 4 is mounted on the supporting frame 33 together with the head unit 15 and is made up of: the tank unit 35 which has a plurality of (twelve) function liquid tanks 61 for storing therein the function liquid; function liquid supply tubes 62 which connect the respective function liquid supply tanks 61 and the respective function liquid droplet ejection heads 31 together; and valve units 34 which are made up of a plurality of (twelve) pressure adjustment valves 63 interposed in the plurality of function liquid supply tubes 62.

As shown in FIG. 3, the supporting frame 33 is formed into a substantially rectangular frame, and has mounted thereon as seen in the longitudinal direction thereof, the head unit 15, the valve unit 4 and the tank unit 35 in the order as mentioned. Though not illustrated, the supporting frame 33 is provided with a head positioning mechanism for positioning the head unit 15 (head plate 32) which is to be attached from the lower side. The head positioning mechanism has three positioning pins (not illustrated) which project downward from the supporting frame 33, and is capable of mounting the head unit through positioning at a high accuracy by bringing these three positioning pins into abutment with the end surface of the head plate 32. As shown in FIGS. 2 and 3, the supporting frame 33 has mounted on the longer-side part thereof a pair of handles 64. With these pair of handles 64 serving as handling parts, the supporting frame 33 can be detachably inserted into, or withdrawn from, the main carriage 14.

As shown in FIG. 3, the tank unit 35 is made up of: twelve function liquid tanks 61; a tank plate 72 which has twelve setting parts 76 for positioning them and supports the twelve function liquid tanks 61; and setting jigs 73 which set each of the function liquid tanks 61 to the respective setting parts 76. The function liquid tank 61 is of a cartridge type in which a function liquid pack 75 containing therein the vacuum-packed function liquid is housed in a resin cartridge case 74. The function liquid stored in the function liquid pack 75 is deaerated (or degassed) in advance so that the dissolved gas amount is substantially zero.

The tank plate 72 is formed into a substantially parallelogram of a thick plate such as stainless steel, or the like. The tank plate 72 is provided with twelve setting parts 71 which are disposed in the same positional relationship with that of the twelve function liquid droplet ejection heads 31 mounted on the head plate 32. In each of the setting parts 71, each of the function liquid tanks 61 is detachably set in position in the longitudinal direction so that the twelve function liquid tanks 61 can be disposed to follow the arrangement of the function liquid droplet ejection heads 31 (see FIG. 3). The tank setting jig 73 is set in position by pushing the rear surface of the function liquid tank 61 forward (toward the valve unit), thereby sliding the function liquid tank 61 forward into the setting part 71. It has a pushing lever 76 for pushing the function liquid tank 61 and a supporting member 77 which supports the pushing lever 76.

The function liquid supply tube 62 is made up of: a tank-side tube 81 which connects each of the function liquid tanks 61 and each of the pressure adjusting valves 63; and a head-side tube 82 which connects each of the pressure adjusting valves 63 and each of the function liquid droplet ejection heads 31. Though not illustrated, the function liquid supply apparatus 4 of this embodiment is provided with a connection fitting for connecting the function liquid supply tube 62 so that the connection can be secured through the connection fitting.

The valve unit 34 is made up of: twelve pressure adjusting valves 63; twelve valve supporting members 83 which support the twelve pressure adjusting valves 63; and a valve plate 84 which supports the twelve pressure adjusting valves 63 through the valve supporting members (see FIG. 3).

Figure 5A:
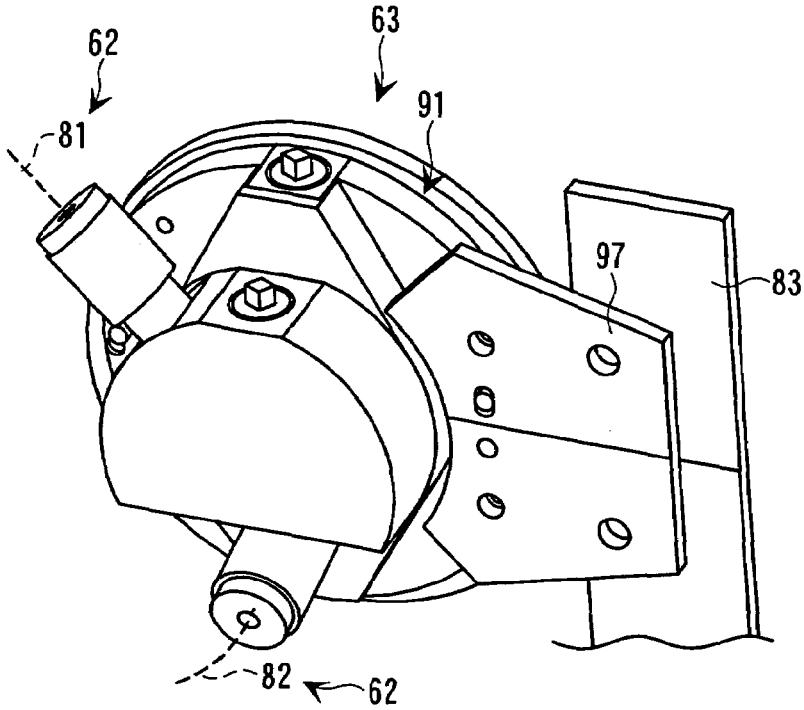
Figure 5B:
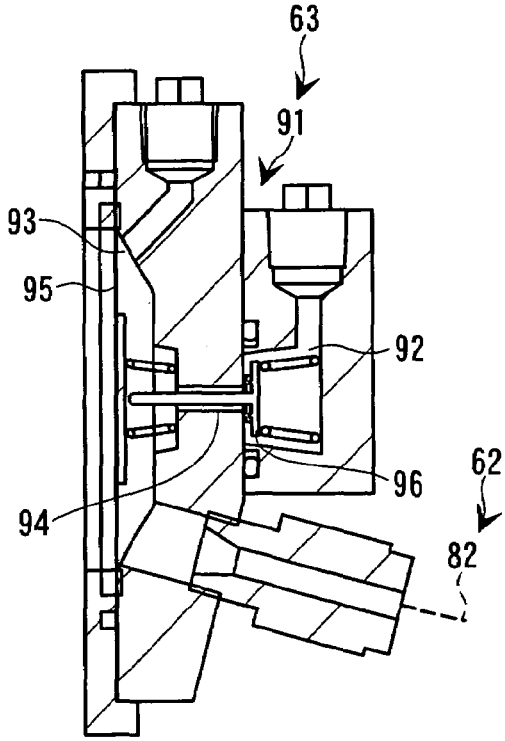

As shown in FIG. 5, the pressure adjustment valve 63 is made up, by forming inside a valve housing 91, of: a primary chamber 92 which is communicated with the function liquid tank 61; a secondary chamber 93 which is communicated with the function liquid droplet ejection head 31; and a communicating flow passage 94 which communicates the primary chamber 92 and the secondary chamber 93 together. On one surface of the secondary chamber 93, there is provided a diaphragm 95 so as to face the outside. The communicating flow passage 94 is provided with a valve body 96 which opens and closes by the diaphragm 95. The function liquid introduced from the function liquid tank 61 into the primary chamber 92 is supplied to the function liquid droplet ejection head 31 through the secondary chamber 93. At that time, the pressure adjustment in the secondary chamber 93 is performed by causing the valve body 96 interposed in the communicating flow passage 94 to be operated by the diaphragm 95 with the atmospheric pressure serving as the adjusting reference pressure. The function liquid pressure in the secondary chamber 93 is thus kept to a slightly negative pressure. Reference numeral 97 in FIG. 5A denotes a mounting plate which mounts the pressure adjustment valve 63 to a frame, or the like (the valve supporting member 83 in this embodiment), in a vertically disposed state in which the diaphragm 95 lies vertically.

By interposing this kind of pressure adjustment valve 63 between the function liquid tank 61 and the function liquid droplet ejection head 31, the function liquid droplet ejection head 31 can be supplied with the function liquid stably without being influenced by the water head of the function liquid tank 61. In other words, the supply pressure of the function liquid is determined by the difference in height between the position of the function liquid droplet ejection head 31 and the position of the pressure adjustment valve 63 (center of the diaphragm 95). By making this difference in height to be a predetermined value (95 mm in this embodiment), the supply pressure of the function liquid can be kept to a given pressure. At the time of closing the valve body 96, the primary chamber 92 and the secondary chamber 93 are isolated from each other, and the pressure adjustment valve 63 has thus a damper function of absorbing pulsations, or the like, which occur on the side of the function liquid tank (primary side).

The valve plate 84 is formed of a thick plate such as stainless steel, or the like. The valve plate 84 is provided with vertically disposed twelve valve supporting members 83 to follow the layout of the function liquid droplet ejection heads 31 so as to support the twelve pressure adjustment valves 63 in a state of being deviated in position in the direction of the short side of the supporting frame 33 (see FIG. 3).

As shown in FIG. 1, the head maintenance apparatus 5 is made up of: a movable table 101 which is placed on the apparatus frame 2 and extends in the X axis direction; a suction unit 102 which is placed on the movable table 101; and a wiping apparatus 103 which is disposed on the movable table 101 along with the suction unit 102. The movable table 101 is arranged to be movable in the X-axis direction and, at the time of maintenance of the function liquid droplet ejection heads 31, the suction unit 102 and the wiping apparatus 103 are adequately moved to the maintenance area 28. Aside from each of the above-described units, preferably, the following units are mounted on the head maintenance apparatus 5, i.e., an ejection inspection unit which inspects the flight conditions of the function liquid droplets ejected from the function liquid droplet ejection heads 31, weight inspection unit which measure the weight of the function liquid droplets ejected from the function liquid droplet ejection heads 31, or the like.

As shown in FIG. 1, the suction unit 102 is made up of: a cap stand 104; twelve caps 105 which correspond to the layout of the function liquid droplet ejection heads 31 and are supported by the cap stand 104 so as to be brought into close contact with the nozzle surfaces 47 of the function liquid droplet ejection heads 31; single suction pump 106 (not illustrated) which is capable of sucking the twelve function liquid droplet ejection heads 31 through the respective caps 105; and suction tubes (not illustrated) which connect each of the caps 105 and the suction pump 106. Although not illustrated, the cap stand 104 has assembled therein a cap elevating mechanism 108 which moves up and down each of the caps 105 by motor drive (see FIG. 12). It is thus so arranged that the corresponding cap 105 can be moved toward and away from each of the function liquid droplet ejection heads 31 of the head unit 15 which is brought to face the maintenance area 28.

In case the function liquid droplet ejection head 31 is subjected to suction, the cap elevating mechanism 108 is driven to bring the cap 105 into close contact with the nozzle surface 47 of the function liquid droplet ejection head 31, and the suction pump 106 is driven. As a result, the suction force can be applied to the function liquid droplet ejection head 31 through the cap 105 so that the function liquid can be forcibly discharged out of the function liquid droplet ejection head 31. The suction of the function liquid is performed not only for the purpose of eliminating/preventing the function liquid droplet ejection head 31 from getting clogged but also for the purpose of filling the function liquid flow passages from the function liquid tank 61 to the function liquid droplet ejection head 31 with the function liquid in case the imaging apparatus 1 is newly installed or in case the head of the function liquid droplet ejection head 31 is replaced.

The cap 105 has a function of a flushing box to receive the function liquid to be ejected from the function liquid droplet ejection head 31 in the form of waste ejection (preliminary ejection not for its original purpose). The cap 105 therefore receives the function liquid for the scheduled (regular) flushing work which is to be performed at the time of temporarily stopping the imaging on the workpiece W such as at the time of replacing the workpiece W. In this waste ejection (flushing operation), the cap elevating mechanism 108 is moved to a position in which the upper surface of the cap 105 is slightly away from the nozzle surface 47 of the function liquid droplet ejection head 31.

The suction unit 102 is used also for keeping or storing the function liquid droplet ejection head 31 at the time in which the imaging apparatus 1 is not operated. In this case, the head unit 15 is brought to a position to face the maintenance area 28, and the cap 105 is brought into close contact with the nozzle surface 47 of the function liquid droplet ejection head 31. As a result, the nozzle surface 47 is sealed and the function liquid droplet ejection head 31 (ejection nozzles 46) is prevented from getting dried, whereby the clogging of the ejection nozzles 46 can be prevented.

The wiping apparatus 103 is to wipe off that nozzle surface 47 of each of the function liquid droplet ejection heads 31 which may have been stained by clogging or sticking of the function liquid as a result of suction (cleaning work), or the like, of the function liquid droplet ejection head 31. The wiping is performed by feeding a rolled wiping sheet 111.

As shown in FIGS. 6 through 9, the wiping apparatus 103 is made up of: an apparatus base 112 which is made by a substantially rectangular thick metallic plate; an apparatus frame 113 like a table which is vertically provided on the apparatus base 112 to support the main constituting members of the apparatus; and a unit stand 114 which is vertically provided on the right-and-left positional relationship (as seen in the Y-axis direction) with the apparatus frame 113 and supports a cleaning liquid spraying unit 118 (to be described later). The apparatus frame 113 supports on the inner side thereof a sheet supply unit 115 for supplying the wiping sheet 111, and on top thereof there is supported a wiping unit 116 which wipes the nozzle surface 47 of the function liquid droplet ejection head 31 through the wiping sheet 111. These units 115, 116 which are the main constituting apparatus are covered by a cover box 117 which is in the shape of a box (details are described hereinafter). The unit stand 114 supports the cleaning liquid spraying unit 118 which has a spray head 202 for the cleaning liquid and sprays and coat the wiping sheet 111 before wiping of the nozzle surface 47 with the cleaning liquid. Further, although not illustrated, the wiping apparatus 103 is also provided with an air supply equipment 119 (see FIG. 12) which supplies the wiping unit 116 and the cleaning liquid spraying unit 118 with compressed air.

Figure 7:
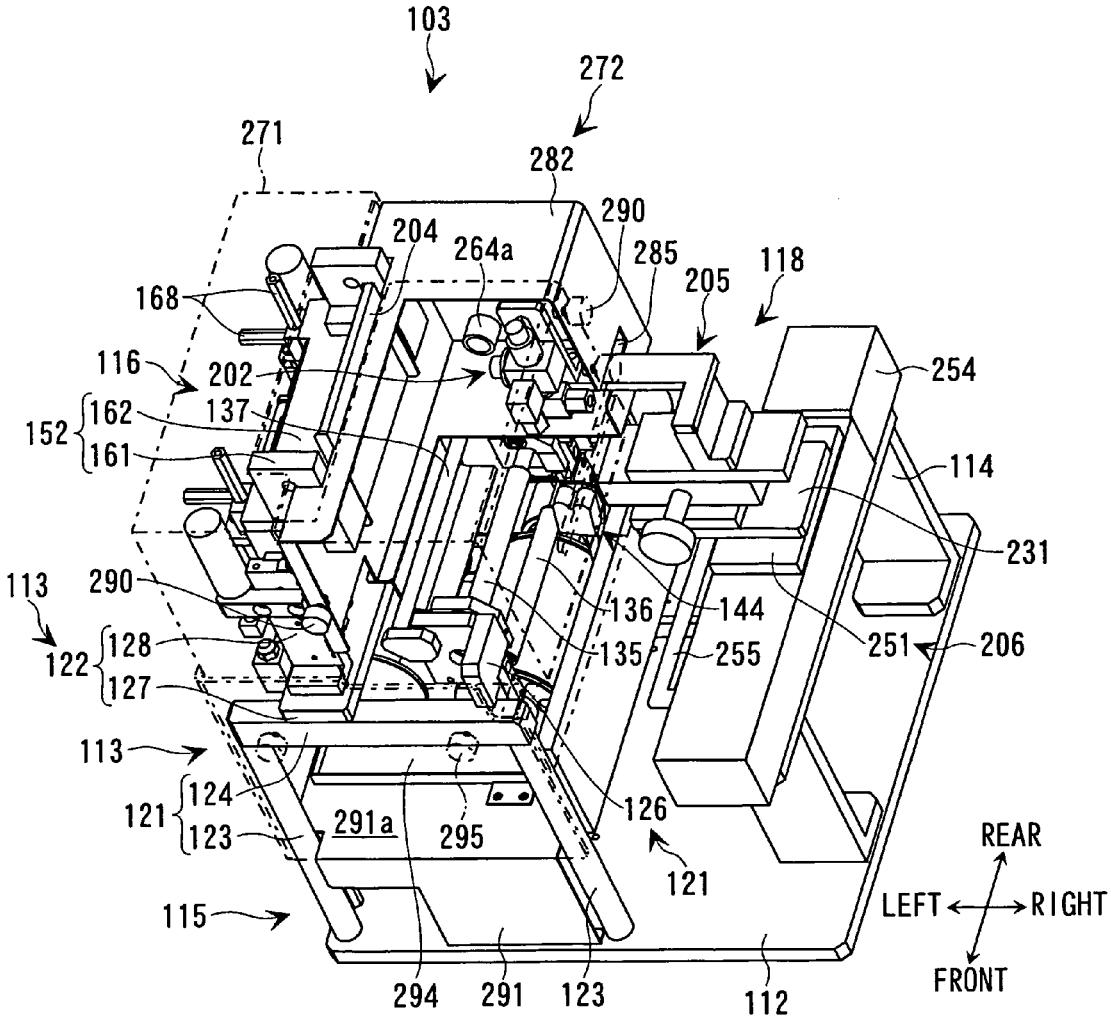
FIG. 7 is an external perspective view of the wiping unit in a state in which part of a cover box is removed.
Figure 8:
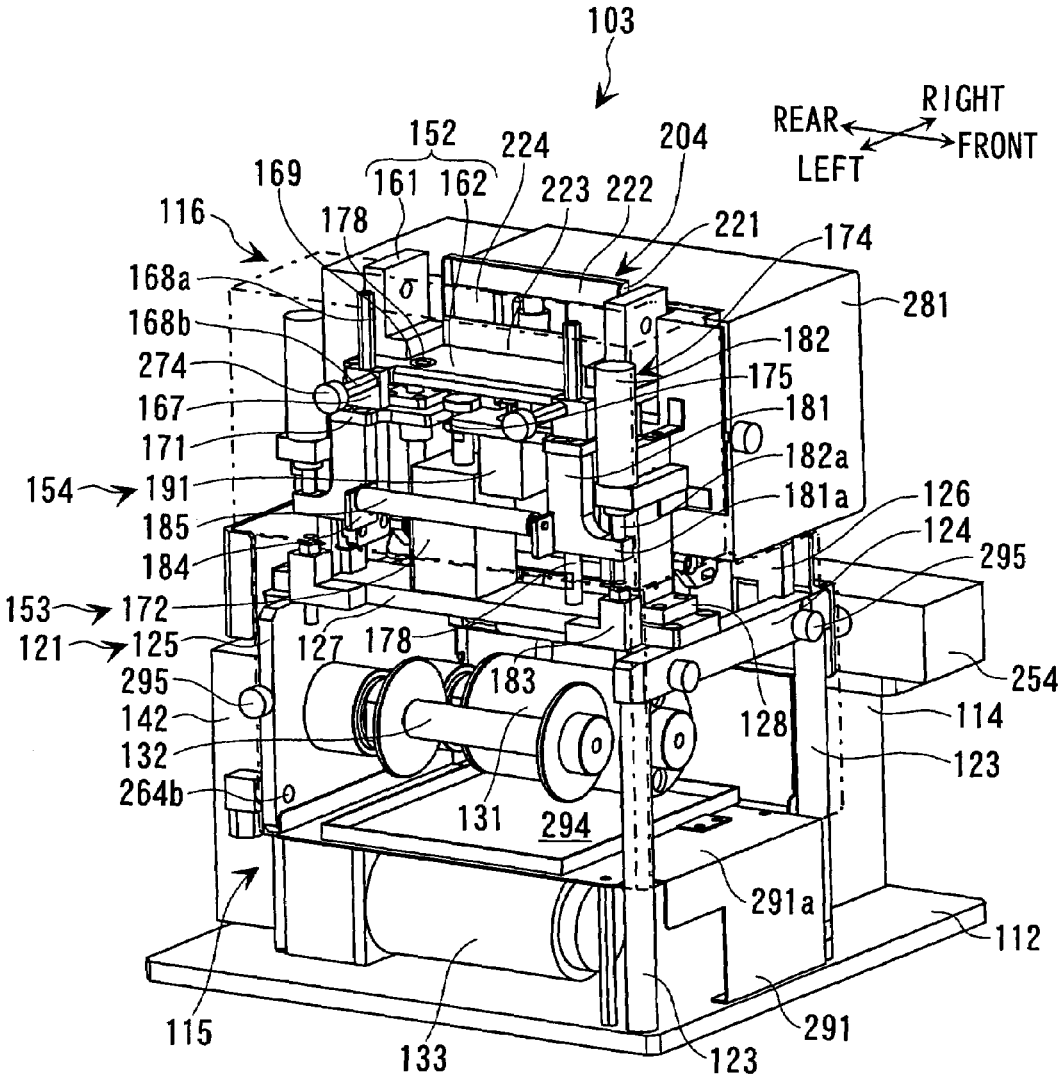
FIG. 8 is an external perspective view of the wiping unit as seen from the left side in a state in which part of a cover box is removed.

As shown in FIGS. 7 and 8, the apparatus frame 113 is made up of: a lower wiping frame 121 which is directly fixed to the apparatus base 112 and supports the sheet supply unit 115; and an upper wiping frame 122 which is mounted on the lower wiping frame 121 and supports the wiping unit 116. The lower wiping frame 121 is made up of: a pair of left and right supporting frames 123 which are formed into a column shape and are vertically provided on the apparatus base 112; a connection supporting frame 124 which is extended to bridge over the upper edges of the right and left pair of supporting frames 123; a rear supporting frame 125 (side plate) which lies opposite to the right and left pair of supporting frames 123 with the sheet supply unit 115 in between; and a pair of front and rear piece frames 126 supported between an inside surface of the connection supporting frame 124 and a right upper end of the rear supporting frame 125, respectively. Although the details are given hereinafter, the rear supporting frame 125 serves the dual purpose of a part (side plate) of the cover box 117. The upper wiping frame 122 is made up of: a horizontal supporting frame 127 which extends to bridge over the upper ends of the connection supporting frames 124 and the rear supporting frame 125; and a pair of front and rear L-shaped frames 128 which are vertically provided on the horizontal supporting frame 127. In the description, the X-axis direction is defined as the front and rear direction, and the Y-axis direction is defined as the right and left direction.

Figure 9:
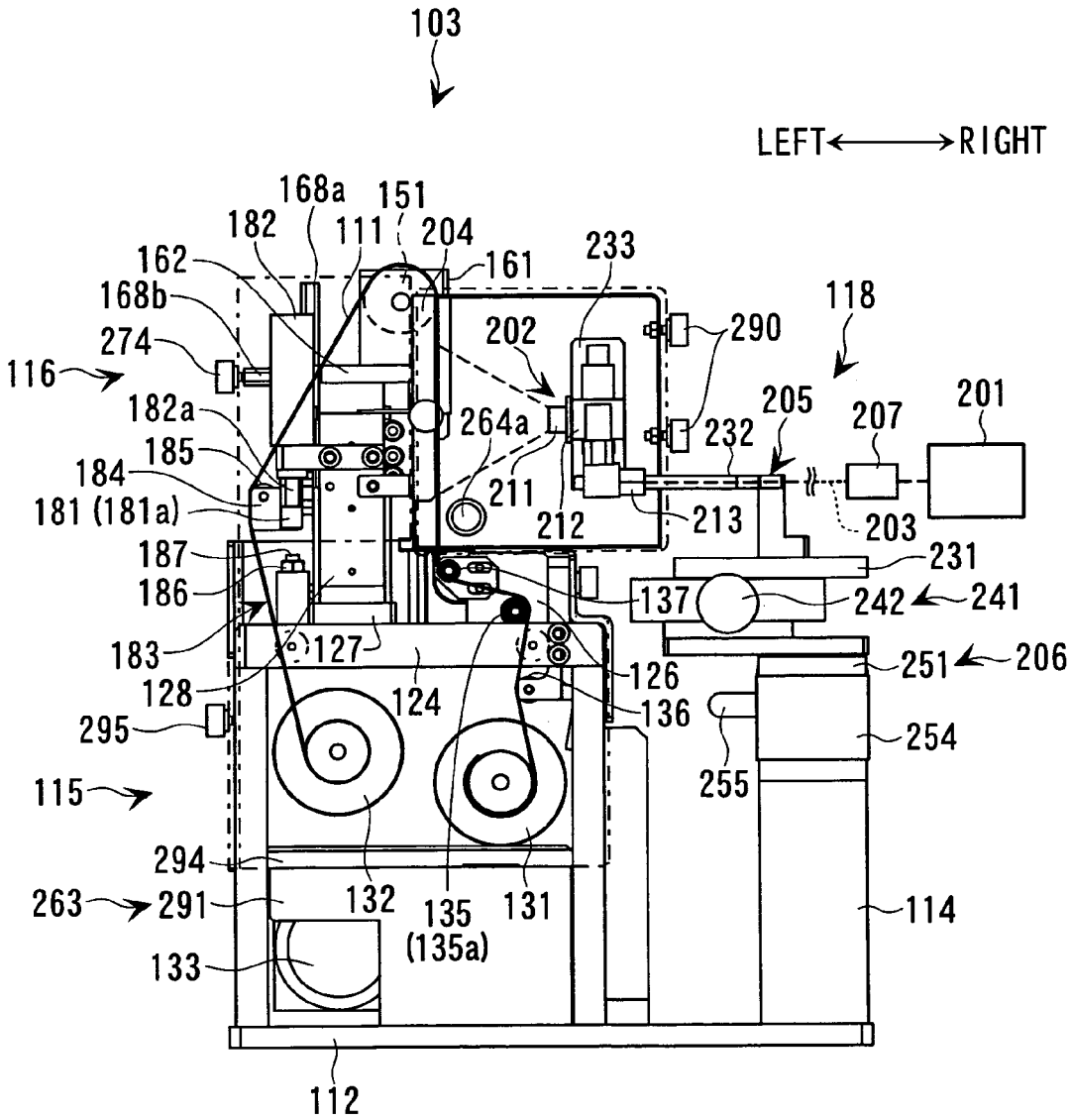
FIG. 9 is a front view of the wiping unit.

As shown in FIGS. 8 and 9, the sheet supply unit 115 is made up of: a feeding reel 131, on the right side of the figure, which is loaded with a roll-shaped wiping sheet 111 and feeds it; a take-up reel 132, on the left side of the figure, which takes up the fed-out wiping sheet 111; a take-up motor 133 which rotates the take-up reel 132; a power transmission mechanism (not illustrated) which transmits the power of the take-up motor 133 to the take-up reel 132; a seed detecting roller 135 which detects the take up (feeding) speed of the wiping sheet 111; a first intermediate roller 136 which feeds the wiping sheet 111 from the feeding reel 131 to the speed detecting roller 135; and a second intermediate roller 137 which feeds the wiping sheet 111 from the speed detecting roller 135 to the wiping unit 116. Though the details are given hereinafter, there is provided a part (bottom cover 291; to be described later) of a lower cover 263, which constitutes the cover box 117, so as to horizontally partition the space between the feeding reel 131/take-up reel 132 and the take-up motor 133. On an upper surface of the bottom cover 291, there is disposed a pan 294 for the cleaning liquid.

As shown in FIG. 8, the feeding reel 131 and the take-up reel 132 are rotatably supported on the rear supporting frame 125 in a cantilevered manner. The feeding reel 131 and the take-up reel 132 are arranged so as to be detachable in the axial direction. At the time of replacing the wiping sheet 111, both reels 131 and 132 are taken out of position. On an outside of the rear supporting frame 125, there is provided a torque limiter (not illustrated) at an axial end of the feeding reel 131 in a manner to act against the take-up motor 133. It is thus so arranged that a predetermined tension is given to the fed-out wiping sheet 111. The take-up motor 133 is made of a geared motor and is fixed to the lower part of the rear supporting frame 125. The power transmission mechanism is built in a belt box 142 which is fixed to the outside of the rear supporting frame 125 and is made up of: a driving pulley (not illustrated) which is fixed to an output end of the take-up motor 133; a driven pulley (not illustrated) which is fixed to the axial end of the take-up reel 132; and a timing belt (not illustrated) which extends between both the pulleys. When the take-up motor 133 is driven, the timing belt travels through its own reduction gear train, and the power is transmitted to the take-up reel 132.

The speed detecting roller 135 is made up of: a roller main body **135*a* which is supported on both ends thereof by a pair of the above-described piece frames 126 so as to be freely rotatable; and a speed detector (not illustrated) 143 (encoder, see FIG. 12) which is provided at an axial end of the roller main body 135***a*. The feeding speed of the wiping sheet 111 is detected by the speed detector 143 and, based on the result of this detection, the driving of the take-up motor 133 is controlled. As shown in FIGS. 7 and 9, the first intermediate roller 136 and the second intermediate roller 137 are also free-rotation roller and are rotatably supported on both sides thereof at the upper and lower parts of the pair of piece frames 126. The first intermediate roller 136 is disposed substantially right under the speed detecting roller 135 so that the feeding path of the wiping sheet 111 becomes substantially at right angles at the position of the speed detecting roller 135. The second intermediate roller 137 is disposed at a slantingly above the speed detecting roller 135 so that the feeding path of the wiping sheet 111 toward the wiping unit 116 lies in the vertical direction. In other words, the feeding path of the wiping sheet 111 is varied so that the first intermediate roller 136 restricts the slippage of the wiping sheet 111 relative to the speed detecting roller 135 (i.e., the rolling contact area becomes large), and so that the second intermediate roller 137 causes the wiping sheet 111 to lie vertically opposite to the spray head 202. Between the first intermediate roller 136 and the speed detecting roller 135, there is provided a sheet detection sensor 144 which detects the presence or absence of the wiping sheet 111 to be fed or sent therebetween (see FIG. 7).

As shown in FIG. 8, the wiping unit 116 is made up of: a wiping roller 151 (wiping member, see FIG. 9) which is constituted by a free-rotating roller and causes the wiping sheet 111 to be brought into abutment with the nozzle surface 47 of the function liquid droplet ejection head 31; a roller supporting frame 152 which supports the wiping roller 151; a roller lifting mechanism 153 (protruding\withdrawal mechanism) which causes the wiping roller 151 to be moved up and down (protruded or withdrawn); and a buffer mechanism 154 which is interposed between the roller supporting frame 152 and the roller lifting mechanism 153 and maintains the wiping pressure (urging or pressing force) of the wiping roller 151 constant. The wiping roller 151 in this case preferably has an axial length corresponding to the width of the wiping sheet 111 and is made of rubber having flexibility and elasticity in order to prevent the nozzle surface 47 of the function liquid droplet ejection head 31 from getting damaged. In the figures, reference numeral 204 denotes a sheet receiving member (to be described later) of the cleaning liquid spraying unit 118.

Figure 10:
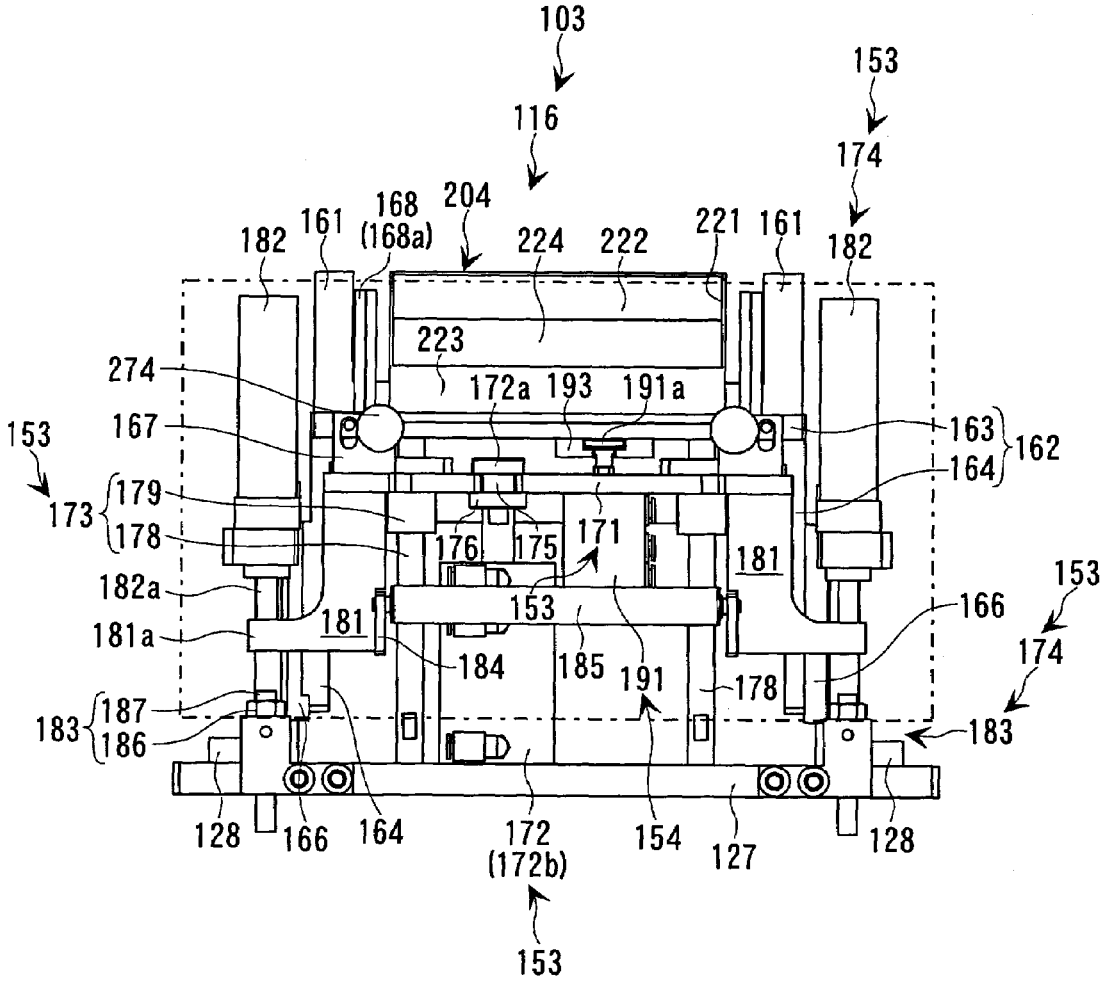
FIG. 10 is a left side view around the wiping unit.

As shown in FIGS. 8 through 10, the roller supporting frame 152 is made up of: a pair of front and rear bearing stands 161 which support the wiping roller 151 at both ends so as to be freely rotatable; and a U-shaped portal frame 162 which supports the pair of front and rear bearing stands 161. The bearing stands 161 support the wiping roller 151 such that the upper edge of the wiping roller 151 slightly protrudes through (or projects beyond) the upper edge surfaces of the bearing stands 161. Attention is thus paid so that the bearing stands 161 do not damage the nozzle surface 47 of the function liquid droplet ejection head 31 at the time of wiping operation.

As shown in FIG. 10, the portal frame 162 is made up of: a horizontal frame 163 of substantially rectangular thick plate which is partly notched in the long-side part in order to stand clear of the sheet feeding passage of the wiping sheet 111; and a pair of vertical frames 164 which extend downward from both ends of the horizontal frame 163. The pair of the bearing stands 161 are screwed to the portal frame 162 so that the longitudinal direction (front and rear direction) of the portal frame 162 coincides with the axial line of the wiping roller 151. It is thus so arranged that the wiping sheet 111 through the wiping roller 151 lies opposite to the notched part (see FIG. 8). On the other hand, each of the vertical frames 164 is engaged with the lifting guide 166 provided on the inside of the above-described rear supporting frame 125, so as to be movable up and down. Namely, the wiping roller 151 is arranged to be vertically movable through the roller supporting frame 152 guided by the pair of lifting guides 166.

As shown in FIGS. 8 through 10, on the left end of the portal frame 162, there are provided a front and rear pair of fixing support blocks 167 which, in turn, are provided with two sets (four in all) of spacer rods 168 for mounting the above-described cover box 117 (left upper cover 271; to be described hereinafter). Further, the portal frame 162 has formed therein a pair of front and rear loose through holes 169 for loosely inserting therethrough a pair of guide shafts 178 (to be described hereinafter).

As shown in FIG. 10, the roller lifting mechanism 153 is disposed between the above-described pair of vertical frames 164 and is made up of: a roller lifting plate 171 which supports the roller supporting frame 152 through the buffer mechanism 154; a roller lifting cylinder 172 (double-acting cylinder) which supports the roller lifting plate 171 and lifts it (i.e., moves it up and down); roller lifting guides 173 which guide the lifting (i.e., moving up and down) of the roller lifting plate 171; and a lift-position restricting mechanism 174 which restricts the upper and lower end positions of the roller lifting mechanism 171. Like the above-described horizontal frame 163, the roller lifting plate 171 has also formed therein a notched part corresponding to the sheet feeding passage. Though described hereinafter, the roller lifting plate 171 has formed therein a U-shaped notch 175 into which is fit, from the front side, a joint piece 176 of the roller lifting cylinder 172.

The roller lifting cylinder 172 is fixed to the horizontal supporting frame 127 in an upward posture. The front end part of the piston rod 172*a* is fixed to the roller lifting plate 171 through the joint piece 176. To a cylinder main body 172*b* of the roller lifting cylinder 172, there is connected the air supply equipment 119 through air tubes (not illustrated). The roller lifting guide 173 is made up of: a pair of guide shafts 178 which are vertically provided on the horizontal supporting frame 127 in a manner to place the roller cylinder 172 therebetween; and a pair of linear bushes 179 with flanges so as to get slidably engaged with the respective guide shafts 178. According to this arrangement, when the roller lifting cylinder 172 is driven, the roller lifting plate 171 is moved up and down while keeping the horizontal posture. The upper ends of the guide shafts 178 are loosely inserted into loose holes 169 in the horizontal frame 163 (see FIG. 8).

The lift-position restricting mechanism 174 is made up of: a pair of restricting plates 181 which are L-shaped in cross section and restrict the position of the roller lifting plate 171; a pair of upper-end restricting members 182 which restrict the upper end position of the roller lifting plate 171 through the pair of restricting plates 181; and a pair of lower-end restricting members 183 which restrict the lower end position through the pair of restricting plates 181 by coming into abutment, from the lower side, with the roller lifting plate 171.

The restricting plates 181 are vertically provided on both ends of the roller lifting plate 171. On the lower part thereof, there are formed restricting parts 181*a* which extend horizontally outward. Between the pair of the restricting plates 181, there is disposed a third intermediate roller 185 in a manner to be rotatable through a pair of bearing brackets 184. This third intermediate roller 185 is so arranged that the sheet feeding passage goes away from the left side of the horizontal supporting frame 127. The wiping sheet 111 from the wiping roller 151 is thus fed toward the take-up reel 132 (see FIGS. 9 and 10).

The upper-end restricting member 182 is constituted by a micrometer head which is fixed to the L-shaped frame 128 so as to lie opposite to (or face) the restriction member 181*a* of the restricting plate 181. When the spindle 182*a* comes into abutment with the upper end surface of the restricting member 181*a*, the lifting end position of the roller lifting plate 171 is restricted. When each of the lower-end restricting members 183 comes into abutment with the lower end of the restricting member 181*a*, the lower-end position of the roller lifting plate 171 is also restricted. The upper-end restricting member 182 is each made up of: an adjusting screw 186 which is supported by the horizontal supporting frame 127 and lies opposite to the upper-end restricting member 182; and an abutment member 187 which is provided by screwing into the upper end of the adjusting screw and comes into abutment with the restricting member 181*a*. The upper-end position of the wiping roller 151 is set in advance based on the position of the nozzle surface 47 of the function liquid droplet ejection head 31 (at a position slightly higher than the nozzle surface), and is adjusted by the micrometer head such that the upper end of the wiping roller 151 attains a predetermined height.

When the roller lifting cylinder 172 is driven to thereby move forward the piston rod 172*a*, the roller lifting plate 171 is moved up guided by the roller lifting guides 173. As a result, the wiping roller 151 moves up toward the nozzle surface 47 of the function liquid droplet ejection head 31 through the buffer mechanism 154 and the roller supporting frame 152. When the roller lifting plate 171 has reached the upper-end position, the movement of the roller lifting plate 171 is restricted by the upper-end restricting member 182, whereby the upward movement of the wiping roller 151 stops. Similarly, when the piston rod 172*a* is moved backward, the roller lifting plate 171 keeps on moving down guided by the roller lifting guide 173 until it is restricted by the lower-end restricting member 183, whereby the wiping roller 151 moves down.

As shown in FIG. 10, the buffer mechanism 154 is an air suspension which is made up of a suspension cylinder 191 and a piston rod 191*a*, and is connected to the above-described air supply equipment. The suspension cylinder 191 is fixed to the bottom of the roller lifting plate 171. The piston rod 191*a* protrudes through (or projects beyond) the opening which is formed in the roller lifting plate 171 and is fixed at its front end to the bottom of the horizontal frame 163. Minute shocks to be applied to the wiping roller 151 in the wiping operation of the function liquid droplet ejection head 31 are transmitted to the buffer mechanism 154 through the roller supporting frame 152 and are absorbed by this buffer mechanism 154. Therefore, the wiping sheet 111 to be urged or pressed against the nozzle surface 47 of the function liquid droplet ejection head 31 is urged against the nozzle surface 47 uniformly and gently. As a result, the wiping of the nozzle surface 47 can be performed even with an adequate urging force without breaking the meniscus.

By providing this kind of buffer mechanism 154, the urging force toward the nozzle surface 47 can be kept to a certain pressure. It is thus not necessary to strictly align or adjust the upper-end position of the wiping roller 151, thereby improving the workability in assembling the wiping apparatus 103. In addition, since the buffer mechanism 154 can compensate for assembling errors and mechanical tolerances of the wiping roller 151, adequate wiping operation can be performed.

Figure 11:
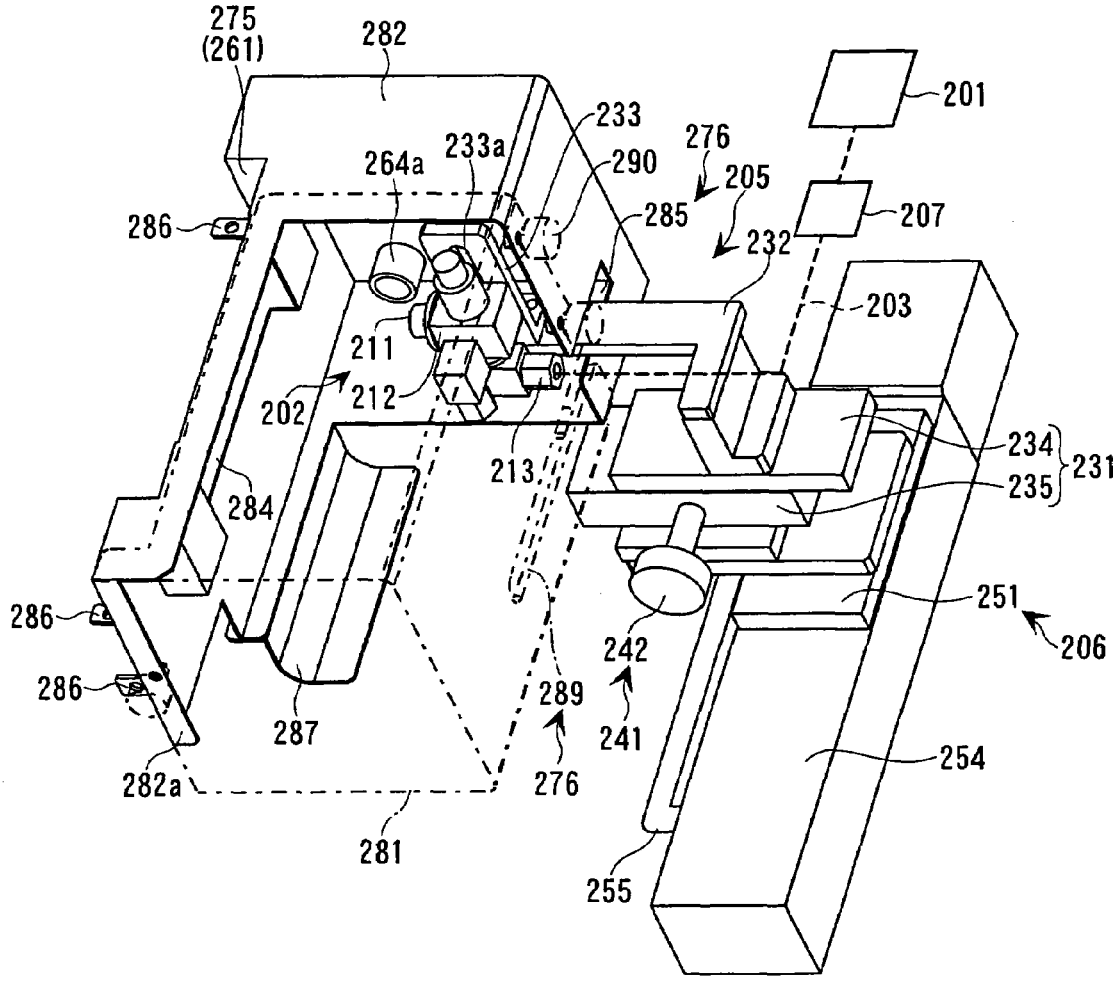
FIG. 11 is an external perspective view around a right upper cover and cleaning liquid spraying unit.

As shown in FIGS. 7, 9 and 11, the cleaning liquid spraying unit 118 is made up of: a cleaning liquid tank 201 which supplies the cleaning liquid; the single spray head 202 which supplies the wiping sheet 111 with the cleaning liquid from the cleaning liquid tank 201; a cleaning liquid supply tube 203 (cleaning liquid passage) which connects the spray head 202 and the cleaning liquid tank 201 together; a sheet receiving member 204 which guides the feeding of the wiping sheet 111 in the vertical direction and keeps the distance between the spray head 202 and the wiping sheet 111 to a certain value; a head carriage 205 (carrier arm) which supports the spray head 202; and a head moving mechanism 206 (head scanning mechanism) which horizontally moves the spray head 202 in the width direction of the wiping sheet 111 through the head carriage 205. The head moving mechanism 206 is mounted on the unit stand 114.

As shown in FIG. 9, the wiping sheet 111 is fed from the feeding reel 131 to the second intermediate roller 137 through the first intermediate roller 136 and the speed detecting roller 135. The wiping sheet 111 is fed from the second intermediate roller 137 upward in the vertical direction and, after passing round the wiping roller 151, is taken up by the take-up reel 132 through the third intermediate roller 185. On the other hand, in the cleaning liquid spraying unit 118, the spray head 202 is caused to face the wiping sheet 111 which is fed vertically from the second intermediate roller 137, thereby spraying the wiping sheet 111 with the cleaning liquid.

The cleaning liquid tank 201 is constituted by a hermetically sealed tank (pressurized tank). The cleaning liquid tank 201 is so arranged that the pressurized or compressed air of a certain pressure is introduced from the air supply equipment 119 so as to discharge under pressure the cleaning liquid in the tank. The cleaning liquid is a liquid which dissolves the function liquid, such as a solvent for the function liquid, and can efficiently remove the stains of the function liquid. The cleaning liquid supply tube 203 which is connected to the cleaning liquid tank 201 has interposed therein a flow adjusting valve 207 so that the amount of cleaning liquid to be supplied to the spray head 202 can be controlled.

As shown in FIGS. 9 and 11, the spray head 202 is made up of: a spray nozzle 211 which is built in on the front end side; a nozzle holder 212 which supports the spray nozzle 211; and a coupling 213 which is provided on the rear-end side. The cleaning liquid supply tube 203 is connected to this coupling 213. In this arrangement, by sending under pressure the cleaning liquid to the spray head 202, the wiping sheet 111 is sprayed and coated with minute cleaning liquid droplets. The mode of spraying to be applied to the spray head 202 may be arbitrarily set on a case-by-case basis. In order to efficiently spray the wiping sheet 111 which is fed upward with the cleaning liquid, this embodiment employs a spray nozzle which sprays the cleaning liquid in an oblong (elliptic) shape.

The sheet receiving member 204 is positioned right above the second intermediate roller 137 and is screwed to the portal frame 162 in a vertical posture and is made up of: a pair of front and rear guide parts 221; an upper plate 222 which bridges over the right upper part of the pair of guide parts 221; and a lower plate 223 which bridges over the left lower part of the pair of guide parts 221. The upper plate 222 and the lower plate 223 are provided at a distance from each other in the vertical direction, and a slit 224 is formed. The wiping sheet 111 to be fed upward from the second intermediate roller 137 is guided by the pair of guide parts 221 and the lower plate 223 and, after being sprayed with the cleaning liquid here, is fed to the wiping roller 151. The upper-end position of the sheet receiving member 204 is substantially the same height as the upper-end position of the bearing stand 161 and is, thus, slightly lower than the upper-end position of the wiping roller 151.

The head carriage 205 is made up of: a base part 231 which is fixed to a slider 251 (to be described hereinafter) of the head moving mechanism 206; an arm part 232 which extends in the L-shape from the base part 231 toward the wiping unit 116 in the Y-axis direction; and a head supporting part 233 which is fixed to the front end of the arm part 232 (on the side of the wiping unit 116) to horizontally support the arm part 232 at a position in which the spray head 202 faces the wiping sheet 111. The head supporting part 233 has formed therein a slot 233*a* to fix the nozzle holder 212 so as to be adjustable in height. The head supporting part 233 supports the spray head 202 horizontally, and the spray head 202 sprays the wiping sheet 111 to be fed vertically with the cleaning liquid in the horizontal direction (see FIG. 9).

Preferably, a nozzle angle adjusting mechanism (not illustrated) which adjusts the spray angle of the spray nozzle 211 is interposed between the head supporting part 233 and the nozzle holder 212 so as to make the spray angle of the spray nozzle 211 adjustable.

The base part 231 is made up of: an upper base part 234 which supports the arm part 232; and a lower base part 235 which supports the upper base part 234. Between the upper base part 234 and the lower base part 235, there is interposed a separating distance adjusting mechanism 241 which adjusts the separating distance between the front and rear position in the Y-axis direction of the upper base part 234 and the lower base part 235, i.e., the separating distance of the spray head 202 away from the wiping sheet 111. The separating distance adjusting mechanism 241 is made up of: a rack and pinion (not illustrated) which moves the spray nozzle 241 back and forth; and a separating distance adjustment screw 242 which is fixed to the pinion. When the separating distance adjusting screw 242 is rotated, the pinion makes a relative movement on the rack and the spray head 202 moves back and forth (spray head 202 moves toward and away from the wiping sheet 111).

As described above, the head carriage 205 is supported such that the height of the spray head 202 and the separating distance are adjustable. Therefore, the position of the spray head 202 relative to the wiping sheet 111 can be adjusted so that the cleaning liquid can be adequately sprayed from the spray head 202 toward the wiping sheet 111.

As shown in FIGS. 7 and 11, the head moving mechanism 206 is made up of: a slider 251 to which the base part 231 of the head carriage 205 is fixed and supports the head carriage 205 so as to be slidable in the X-axis direction (i.e., in the widthwise direction of the wiping sheet 111); a ball screw (not illustrated) which extends in the X-axis direction so as to move the slider 251; a slide guide (not illustrated) which extends in parallel with the ball screw so as to guide the movement of the slider 251; and a moving motor 253 (see FIG. 12) which rotates the ball screw in one direction and in the opposite direction. When the moving motor 253 is driven, the ball screw rotates in one direction or in the opposite direction, and the head carriage 205 (spray head 202) moves in the X-axis direction through the slider 251. The rear side in the figure is the home position of the spray head 202. Reference numeral 254 denotes a casing of the head moving mechanism 206 and reference numeral 255 denotes an exhaust pipe which discharges the dust to be generated inside the casing 254.

As described hereinabove, according to the cleaning liquid spraying unit 118 of this embodiment, the wiping sheet 111 is sprayed with the cleaning liquid while the spray head 202 is moving (scanning) in the widthwise direction of the wiping sheet 111. Therefore, a certain region (wiping region) of the wiping sheet 111 can be uniformly coated with the cleaning liquid. Preferably, the spraying of the cleaning liquid is performed in a state in which the feeding of the wiping sheet 111 is stopped. After spraying, the wiping region of the wiping sheet 111 is fed to the position of the wiping roller 151, and the nozzle surface of the function liquid droplet ejection head 31 is wiped off. Instead of the motor-driven head moving mechanism 206, an air-driven rodless cylinder, or the like, may be employed.

Although the head moving mechanism 206 of this embodiment is motor-driven, an air cylinder (double-acting cylinder) may also be employed instead of the motor. In such a case, although not illustrated, a slide guide is provided in parallel with the air cylinder and the piston rod of the air cylinder is fixed to the slider.

Figure 6:
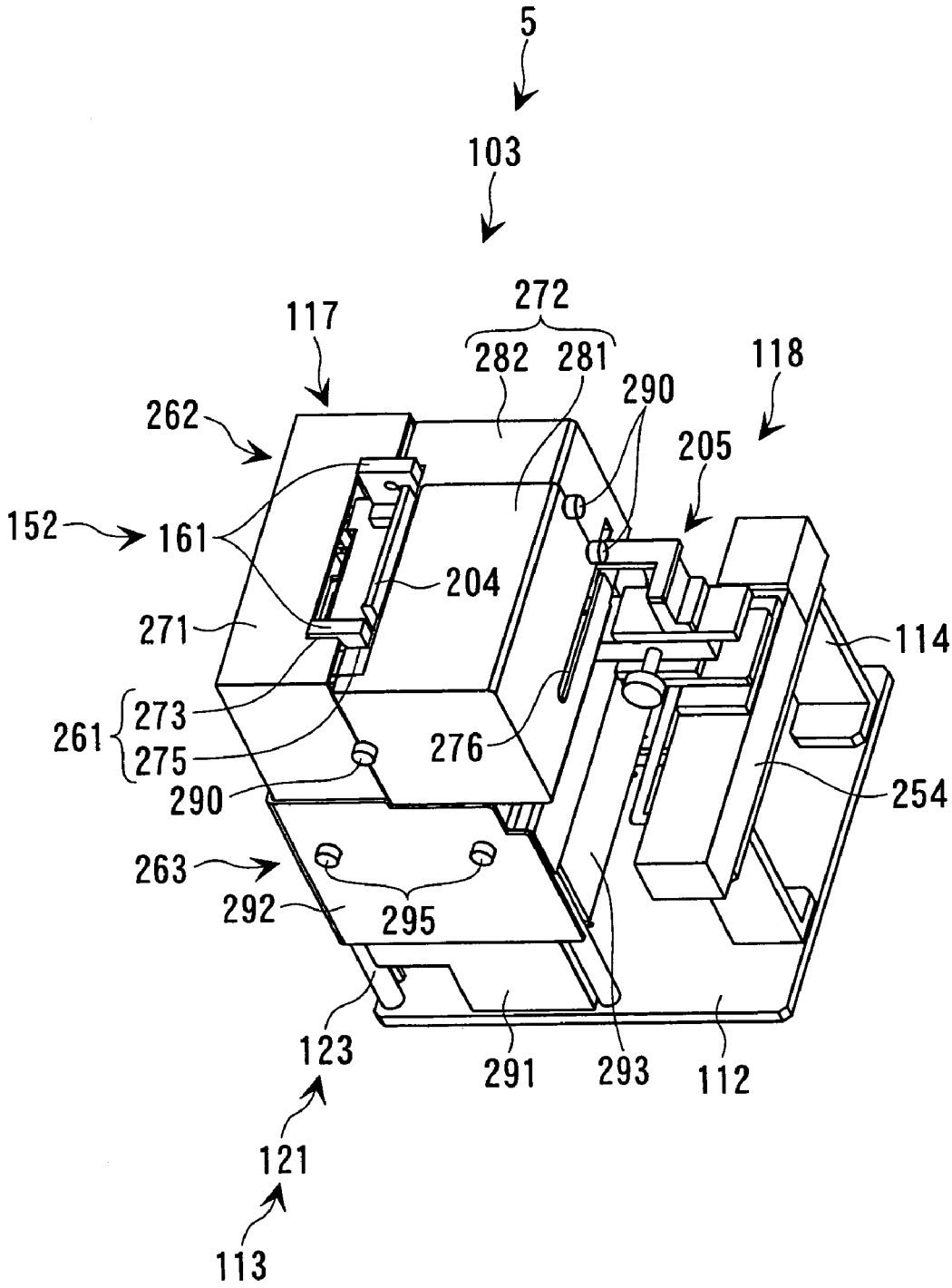
FIG. 6 is an external perspective view of a wiping unit.

A description will now be made about the cover box 117. The cover box 117 is to prevent the cleaning liquid sprayed by the spray head 202 from scattering. As shown in FIG. 6, the cover box 117 covers the main part of the wiping unit 116, and is made up of: an upper cover 262 which has formed therein a roller opening 261 (also referred to as a "member opening") for causing to face outward the wiping roller 151 supported by the bearing stand 161; and a lower cover 263 (lower cover part) which covers the main part of the sheet supply unit 115. The upper cover 262 and the lower cover 263 are respectively provided with exhaust ports 264*a*, 264*b* to which are connected exhaust passages (not illustrated) communicated with the exhaust processing equipment (not illustrated), thereby discharging the inside air mixed with the cleaning liquid. The exhaust pipe 255 is also connected to the exhaust passages.

As shown in FIG. 6 and others, the upper cover 262 is divided into two so that the roller opening 261 is separated apart, and is made up of: a left upper cover 271 which covers the left side of the central axis of the wiping roller 151; and a right upper cover 272 which covers the right side of the central axis of the wiping roller 151. The main part of the wiping unit 116 is housed in the left upper cover 271. On an upper surface of the wiping unit 116, there is formed a rectangular notch in the right central part thereof to thereby form a left opening part 273 of the roller opening 261. The left upper cover 271 is supported by the two sets (four in all) of spacer rods 168 such that the upper surface thereof becomes slightly lower than the upper edge of the pair of bearing stands 161. One set out of the two sets of spacer rods 168*a* are fixed to the upper surface of the pair of fixing support block 167 and extend upward, and the other spacer rods 168*b* are fixed to the left side surface of the fixing support block 167 and extend upward. As shown in FIGS. 8 and 9, the left upper cover 271 is detachably screwed by urea-resin screws 274 to the one set of spacer rods 168*b* in a state in which the upper surface is in abutment with the front end of the one set of spacer rod 168*a*, and in which the left side surface is in abutment with the front end of the one set of spacer rods 168*b*. In other words, the left upper cover 271 is detached upward.

As shown in FIGS. 6 through 9, the right upper cover 272 contains therein the wiping sheet 111 before wiping which is fed from the sheet supply unit 115, the spray head 202 of the cleaning spraying unit 118, the head supporting part 233 and a portion of the arm part 232. As shown therein, on the upper left side of the right upper cover 272, there is formed a right opening part 275 which constitutes the roller opening 261 in combination with the left opening 273 of the left upper cover 271. Also as described above, the spray head 202 is so constructed as to perform scanning in the widthwise direction of the wiping sheet 111 through the head carriage 205. Therefore, in order to allow for the movement of the arm part 232, the right side surface of the right upper cover 272 has formed therein a slit opening 276 to cope with the moving range of the arm part 232 (see FIGS. 6 and 11).

Preferably, the roller opening 261 and the slit opening 276 are provided with an air-tight member which seals the clearance to the wiping roller 151 and the clearance to the arm part 232, respectively. As the air-tight member, a brush-type of material (mohair) is employed.

The right upper cover 272 is made up of: a right upper front cover 281 which widely covers the right upper side of the front side; and a right upper rear cover 282 which covers the rear part thereof. As shown in FIG. 11, the right upper rear cover 282 is formed into a box shape whose front part is open. The left side surface extends to this side (i.e., to the side of the viewer of the figure) and has formed therein a bent part 282*a* which is bent such that the front end lies opposite to the rear surface part. In the left side surface of the right upper rear cover 282, there is formed the above-described right opening 275 and is formed a rear opening groove 284 so as to move the wiping sheet 111 round the wiping roller 151 through the sheet receiving member 204. The right upper rear cover 282 is screwed to the upper wiping frame 122 through a plurality of (five) cover fixing pieces 286. The bottom surface of the right upper rear cover 282 is provided with a tongue-shaped cleaning liquid receiver 287 which lies opposite, from the lower side, to the second intermediate roller 137. The cleaning liquid receiver 287 is formed into a substantially L-shape in cross section so as to receive the cleaning liquid sprayed off from the wiping sheet 111.

The right upper front cover 281 widely covers the front part of the right upper cover 272 so as to face the feeding passage of the wiping sheet 111. On the right side part of the right upper front cover 281, there is formed a front opening groove 289. The right upper front cover 281 is detachably fixed to the right upper rear cover 282. In concrete, the right upper front cover 281 is screwed by urea-resin screws 290 at a total of three points, i.e., one point of the bent part 282*a* of the right upper rear cover 282 and at two points to vertically sandwich the rear opening groove 285 of the right upper rear cover 282. When the right upper front cover 281 is fixed to the right upper rear cover 282, the slit opening 276 (see FIG. 11) is formed by the front opening groove 289 and the rear opening groove 284 in the right upper rear cover 282. Therefore, the right upper front cover 281 is detached in the back and forth direction.

As shown in FIGS. 6 through 9, the lower cover 263 is made up of: a bottom cover 291 which contains therein both the reels 131, 132 of the sheet supply unit 115 and other rollers and constitutes the bottom part thereof; a left side cover 292 which constitutes the front part and the left side part; a right side cover 293 which constitutes mainly the right side part; and the rear supporting frame 125 of the lower wiping frame 121 constituting the rear part. As illustrated, one end is fixed to the rear supporting frame 125 and the other end is fixed to the apparatus base 112. The horizontal part 291*a* of the bottom cover 291 serves to partition the upper reel-containing (or housing) space which contains therein both the reels 131, 132 of the sheet supply unit 115, and the lower motor-containing space which contains therein the take-up motor 133. Further, on the horizontal surface part 291*a*, there is widely disposed a cleaning liquid pan 294 so as to face right below both the reels 131, 132. The cleaning liquid that has failed to hit the wiping sheet 111 or the cleaning liquid to drip from the wiping sheet 111 is thus received thereby. As a result, the spread cleaning liquid is prevented from getting adhered to the take-up reel 133.

The left side cover 292 is also formed by a plate bent into an L-shape. As shown in FIG. 6 and others, the left side cover 292 is screwed at one point of the left end of the right upper rear cover 282 and at right and left two points of the connecting frame 124. The right side cover 293 covers the right side part of the lower cover 263 and a portion of the upper rear part above the rear supporting frame 125, and is screwed to the two front and rear points of the right end of the connecting support frame 124. The left side cover 292 and the right side cover 293 are detachably screwed by urea-resin screws 295. When the wiping sheet 111 is replaced, the left side cover 292 is removed.

As described above, the cover box 117 is constituted by plural pieces and they are mostly detachably fixed with urea-resin screws. Therefore, at the time of mounting and detaching the wiping sheet 111, only the required parts can be easily removed. The ease of operation in maintenance work is thus secured.

A description will now be made about a series of wiping operations. First, the movable table 101 is driven to cause the wiping apparatus 103 to face the maintenance area 28. Then, the cleaning liquid supply from the cleaning liquid tank 201 is started, thereby spraying the cleaning liquid from the spray head 202. At the same time, the head moving mechanism 206 is driven to cause the spray head 202 in the home position to move back and forth depending on the width of the wiping sheet 111 (spray scanning). According to these operations, the cleaning liquid required for one time of wiping operation is supplied to the wiping region of the wiping sheet 111. As soon as the back-and-forth movement of the spray head 202 is finished, the spraying of the cleaning liquid from the spray head 202 is stopped. The movement of the wiping apparatus 103 by the moving table 101 and the spray scanning of the cleaning liquid to the wiping sheet may be performed in an overlapping manner.

Then, pressurized air is supplied to the roller lifting cylinder 172 and the suspension cylinder 191. According to these operations, the roller lifting plate 171 and the roller supporting frame 152 are moved up, whereby the wiping roller 151 is moved up to a predetermined height. Then, the take-up motor 133 is driven to thereby feed the wiping sheet 111 supplied with (or impregnated with) the cleaning liquid to the wiping roller 151. In a manner synchronized with the driving of the take-up motor 133, the X/Y driving mechanism 11 (Y-axis table 13) is driven. In other words, while the wiping sheet 111 is being fed, the head unit 15 is moved in a manner synchronized therewith. The head unit 15 is thus moved to face the maintenance area 28 in a state in which the nozzle surface 47 of the function liquid droplet ejection head 31 is in abutment with the wiping sheet 111 which has been impregnated with the cleaning liquid. In other words, since the nozzle surface of the function liquid droplet ejection head 31 comes into sliding contact with the wiping sheet 111, the nozzle surface 47 of the function liquid droplet ejection head 31 is wiped off with the wiping sheet 111. The feeding speed of the wiping sheet 111 and the moving speed of the head unit 15 is arranged to be arbitrarily set depending on the kind of the function liquid or the kind of the cleaning liquid.

When the wiping operation has been finished, the movement of the X/Y moving mechanism 11 and the take-up motor 133 is stopped. The movement of the head unit 15 is stopped in a state in which the head unit 15 completely faces the maintenance area 28, and the feeding of the wiping sheet 111 is stopped. Then, compressed air is supplied to the return side of the roller cylinder 175 and the suspension cylinder 191 to lower the wiping roller 151, thereby finishing the wiping operation.

The control apparatus 6 is constituted by a personal computer, or the like. Although not illustrated, the apparatus main body has connected thereto: an input apparatus such as a keyboard, mouse, or the like; various drives such as FD drive, CD-ROM drive, or the like; peripheral devices such as a monitor display, or the like.

Figure 12:
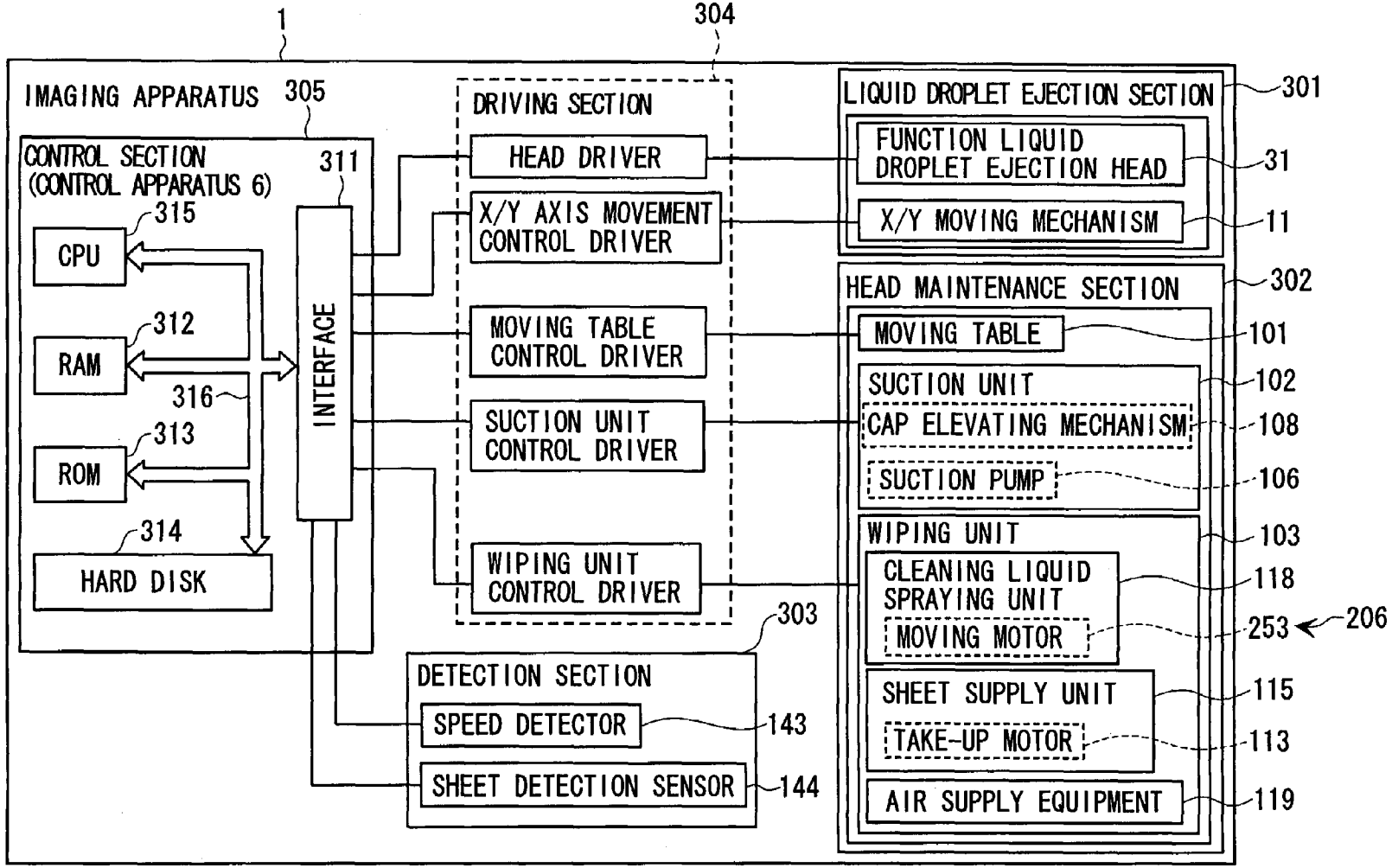
FIG. 12 is a block diagram explaining the main control system of the imaging apparatus.

With reference to FIG. 12, a description will now be made about the main control system of the imaging apparatus 1. The imaging apparatus 1 is made up of: a liquid droplet ejection section 301 having the liquid droplet ejection apparatus 3; a head maintenance section 302 having the head maintenance apparatus 5; a detection section 303 having various sensors for the liquid droplet ejection apparatus 3 and the head maintenance apparatus 5 for performing various detections; a driving section 304 for driving each unit; and control section 305 (control apparatus 6) which is connected to each section to perform an overall control of the imaging apparatus 1.

The control section 305 is provided with: an interface 311 which connects the liquid droplet ejection apparatus 3 and the head maintenance apparatus 5; a RAM 312 which has a memory region capable of temporary storing and is used as the working region for control processing; a ROM 313 which has various storing regions and stores therein control program and control data; a hard disk 314 which stores therein imaging data for performing imaging on the workpiece W, various data from the liquid droplet ejection apparatus 3 and the head maintenance apparatus 3 and also stores therein programs, or the like, for processing various data; a CPU 315 which performs operational processing based on the programs, or the like, stored in the ROM 313 and the hard disk 314; and a bus which connects them together.

The control section 305 controls each of the means by: inputting various data from the liquid droplet ejection apparatus 3, the head maintenance apparatus 5, or the like, through the interface 311; causing the CPU 315 to perform operational processing based on the programs stored in the hard disk 314 (or sequentially read out by CD-ROM drive, or the like); and outputting the processing results to the liquid droplet ejection apparatus 3, the head maintenance apparatus 5, or the like, through the interface. For example, the above-described series of wiping operations are performed by control from the control section 305.

A description will now be made about a second embodiment of the wiping unit. The wiping unit of this embodiment is substantially the same as the wiping apparatus 103 of the first embodiment. Therefore, a description will be made here only about what is different from the first embodiment. The wiping unit 400 of the second embodiment is covered entirely with a cover box 401. The cover box 401 has formed a roller opening 402 on the left upper surface thereof, and is provided with an open/close lid 403 in an area to extend from the right side to the right upper surface (here, "left" and "right" are used in the same manner as in the first embodiment, i.e., as shown in FIGS. 7 and others, even in case some of the relevant figures for the second embodiment represent them otherwise).

Figure 14:
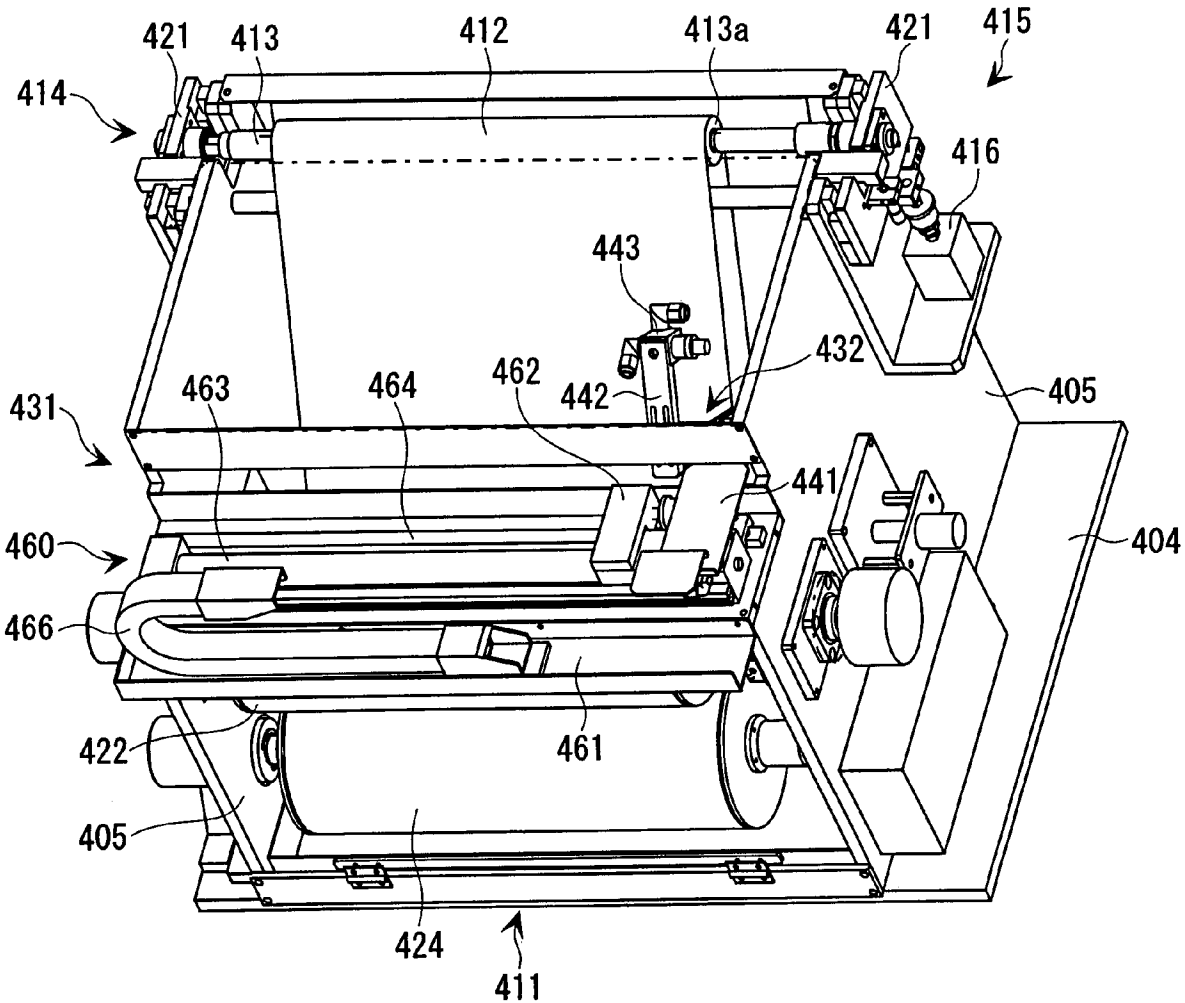
FIG. 14 is an external perspective view showing the wiping unit of the second embodiment in a state in which the cover box has been removed.
Figure 15:
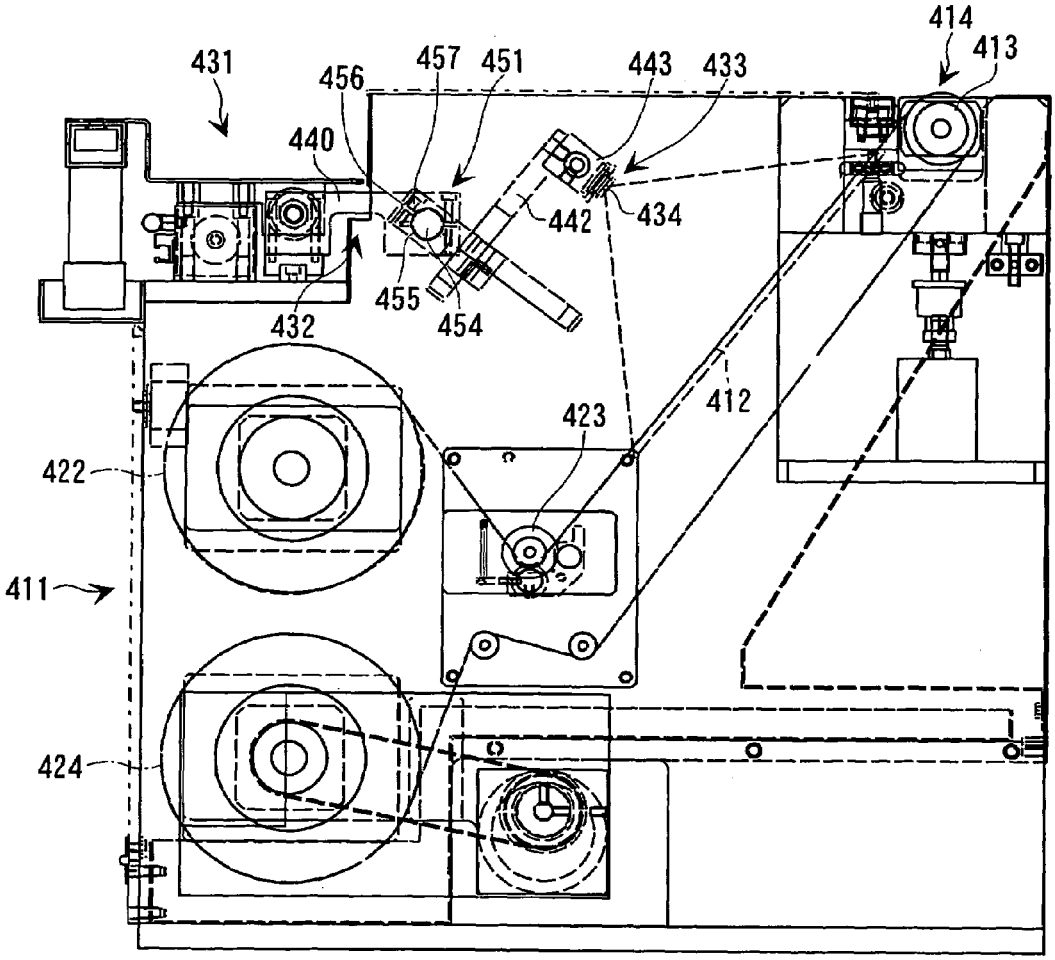
FIG. 15 is a sectional view of the wiping unit according to the second embodiment.

As shown in FIG. 14, the apparatus base 404 is vertically provided with a pair of side frames 405. On the right lower part of the side frame 405 (side plate), there is supported a sheet supply unit 411 in a manner to lie opposite to the open/close lid 403. According to this arrangement, when the open/close lid 403 is left open, the attaching and detaching of the wiping sheet 412 can be made. As shown in FIG. 15, on the left upper part of both the side frames 405, there is supported a wiping unit 414 such that the wiping roller 413 is slightly projected from (or protruded beyond) the roller opening 402. The roller lifting mechanism 415 has a pair of roller lifting cylinders 416 which are provided along with the upper outer surface of a pair of side frames 405. The wiping roller 413 is moved up and down through a bearing 421 which is supported on both sides thereof. In this embodiment, the sheet receiving member is not provided. The wiping sheet 412 mounted on the feeding roller 422 is fed slantingly relative to the wiping roller 413 through an intermediate roller 423 and is taken up by the take-up roller 424 by passing around the wiping roller 413.

As shown in FIGS. 14 and 15, the right upper part of the side frame 405 is partly notched and is made lower by one step. The main part of the cleaning liquid spraying unit 431 is disposed so as to be bridged over the notched part of the pair of side frames 405. The head carriage 432 is substantially the same as that in the first embodiment. The spraying nozzle 434 of the spray head 433 supports the spray head 433 so as to face the obliquely-running wiping sheet substantially at right angles, i.e., so that the spray direction of the cleaning liquid crosses the feeding direction of the wiping sheet 412 at right angles. Arm part 441 has built in a nozzle angle adjusting mechanism 451 which is capable of adjusting the supporting angle of the nozzle holder 443 through the head supporting part 442. Depending on the conditions (kind of the cleaning liquid, or the like), the spray angle of the spray head 433 can thus be adjusted.

Figure 16:
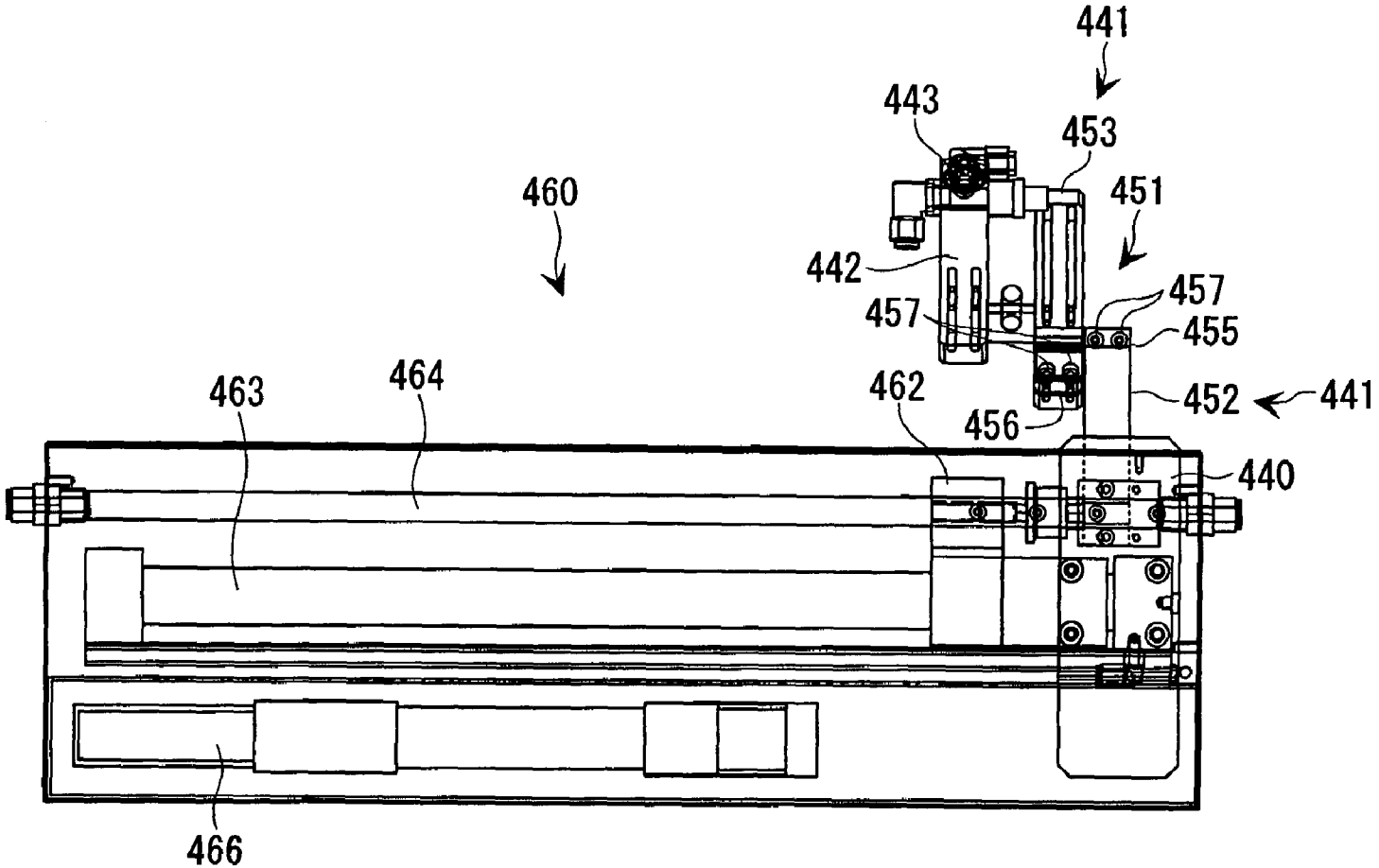
FIG. 16 is a plan view around a head moving mechanism.

A description will now be made about the nozzle angle adjusting mechanism 451. As shown in FIGS. 15 and 16, the arm part 441 is made up of: a first arm block 452 which is fixed to a base part 440; a second arm block 453 which fixes a head supporting part 442 and lies in close proximity to the first arm block 452 in the widthwise direction of the wiping sheet 412; and a connecting shaft 454 which rotatably connects the first arm block 452 and the second arm block 453. The first arm block 452 and the second arm block 453 have formed therein a through hole 455 for inserting therethrough the connecting shaft 454 and has also formed therein a groove part 456 which is communicated from the side thereof to the through hole. Both block 452, 453 are provided with a pair of screws 457 which penetrate the groove part 456 in the vertical direction. When the screws 457 in one of the blocks are loosened, the clearance of the groove part 456 becomes wider. As a result, the second arm block 453 becomes capable of rotating about the connecting shaft 454, so that the angle of the head supporting part 442 can be adjusted. When the loosened screws 457 are tightened, the clearance of the groove part 456 becomes smaller, so that the head supporting part 442 can be fixed to the adjusted angle.

A head moving mechanism 460 of the cleaning liquid spraying unit 431 is made up of: a cleaning liquid frame 461 which is bridged over the pair of side frames 405; a slider 462 which is disposed on the cleaning liquid frame 461 and slidably supports the head carriage 432; a rodless air cylinder (double-acting cylinder) which slidably moves the slider 462; and a slide guide 464 which is disposed in parallel with the air cylinder 463 and guides the movement of the slider 462. The slider 462 has fixed thereto a slider guide block 463*a* for the air cylinder 463. When air is supplied to the air cylinder 463, the slider 462 moves back and forth and the head carriage 432 thus reciprocates through the slider 432 in the widthwise direction of the wiping sheet 412. In order to follow the movement of the cleaning liquid spray head 433, the cleaning liquid tube (not illustrated) is housed in a flexible tube-duct known by the name of a "Cableveyor, reg. TM)" 466, which is disposed in parallel with the head moving mechanism 460.

Figure 13:
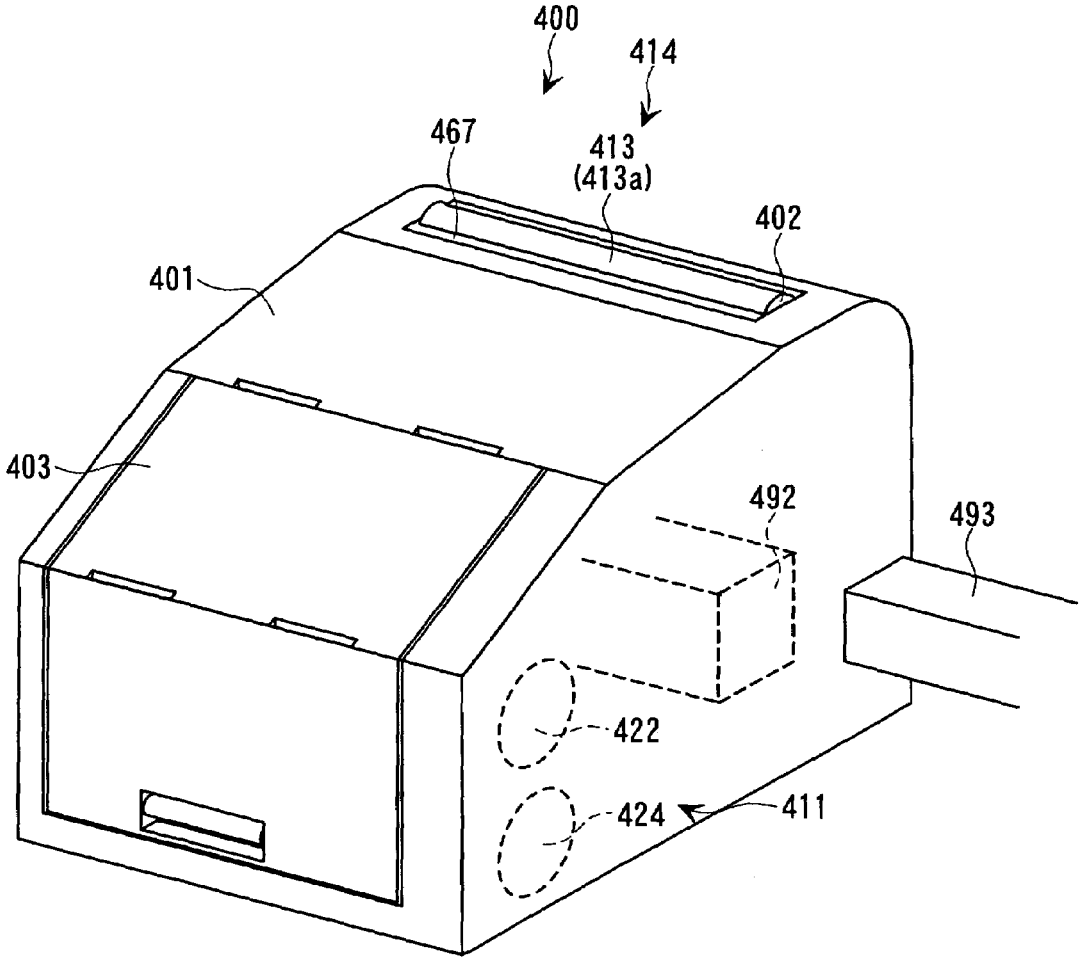
FIG. 13 is an external perspective view showing the wiping unit according to the second embodiment of this invention.

The cover box 401 is detachably fixed to the side frame 405. In this embodiment, the entire wiping unit 400, inclusive of the pair of side frames 405, is covered by the cover box 401. Alternatively, at least one of the wiping frames may be constituted to serve the dual purpose of a part of the cover box 401. As shown in FIG. 13, an air-tight material (mohair) 467 is disposed on an edge portion of the roller opening 402. The clearance between the wiping roller 413 which slightly projects beyond the roller opening 402 and the roller opening 402 is thus sealed to thereby prevent the cleaning liquid from splashing outside the roller opening 402.

In case the wiping roller 413 is ordinarily contained inside the cover box 401 and, only at the time of wiping operation, the wiping roller 413 is moved up so as to project through the roller opening 402, it is preferable to provide an open/close lid 471 to open or close the roller opening 402, in place of the air-tight material. It is more preferable to provide an open/close mechanism 472 (cover interlocking mechanism) which opens/closes the open/close lid 471 in a manner interlocked with the upward movement of the wiping roller 413, whereby the open/close lid 471 is opened or closed depending on the moving up and down of the wiping roller 413.

Figure 17A:
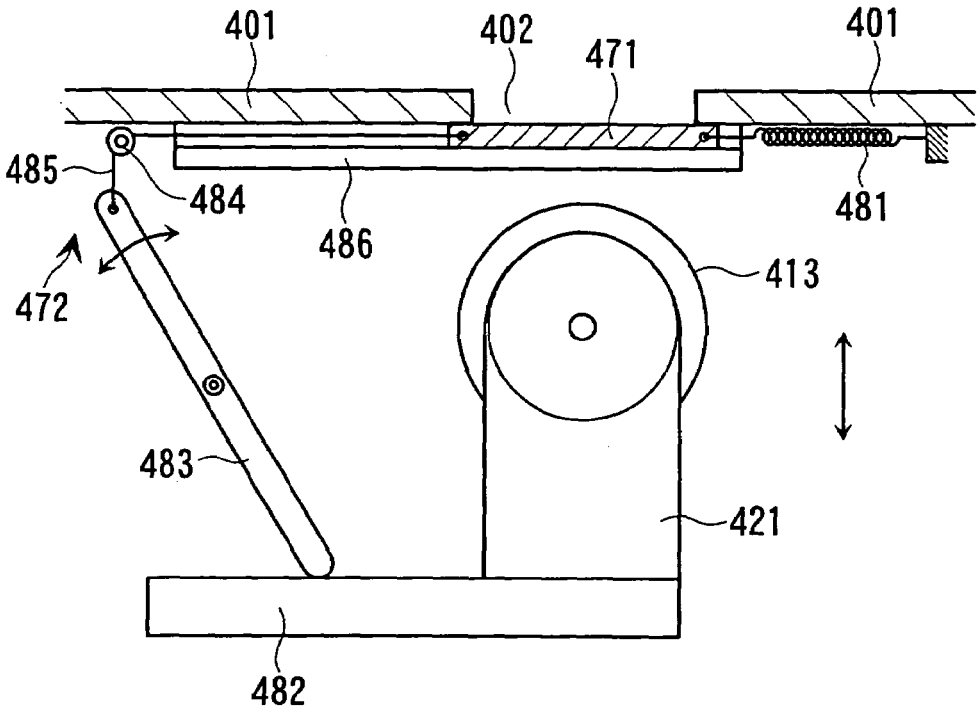
Figure 17B:
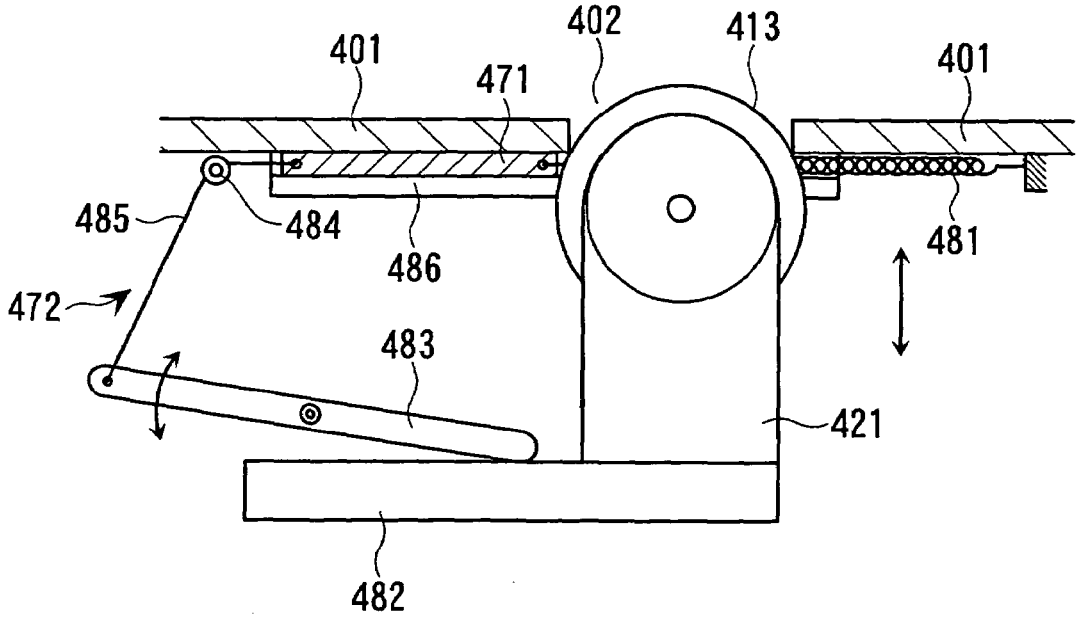

For example, as shown in FIGS. 17A and 17B, the open/close mechanism 472 is made up of: a pair of coil springs 481 which are fixed, at its one end, to the open/close lid 471 and, at the other end thereof, to the rear surface of the cover box 401; a pair of pushers 482 which are fixed to a shaft portion of the wiping roller 413 in a state in which the roller part 413*a* lies therebetween; a pair of link members 483 which are engaged with the pair of pushers 482 and rotate in accordance with the up and down movement thereof; a pair of pulleys 484 which are fixed to the rear surface of the cover box 401; and a pair of wires 485 whose one end is fixed to the open/close lid and the other end thereof is fixed to the end portions of the link members 483 through the pair of pulleys 484. The pair of coil springs 481 are disposed at a distance from each other in the widthwise direction of the open/close lid 471, and keep on urging or pushing the open/close lid 471 in the closing direction. On the other hand, the open/close lid 471 is supported so as to be slidable in a direction perpendicular to the wiping roller 413 by a pair of lid guides 486 provided on the edge portions of both the short sides of the roller opening 402.

When the wiping roller 413 moves up by the roller lifting mechanism 415 and the pair of pushers 482 move up, the link members 483 rotate so as to push down the end 483*a* to which the wire 485 is fixed. As a result, the wire 485 is pulled downward and the open/close lid 471 is opened against the pair of coil springs 481. On the other hand, when the wiping roller 413 is moved down by the roller lifting mechanism 415, the pair of coil springs 481 are operated, so that the link members 483 rotate to lift the end portion 483*a*, thereby opening the open/close lid 471.

In this case, too, preferably, an exhaust port 491 which is in communication with exhaust processing equipment is provided in a part of the cover box 401. Preferably, the cover box 401 is provided inside thereof with a moistening apparatus 492 to enable the moisture content inside the cover box 401 controllable (see FIG. 13).

A description will now be made about a construction (structure) of, and a method of manufacturing, an electro-optical device (flat panel display) which is manufactured by using the imaging apparatus 1 of this invention. As examples of the electro-optical device, a color filter, a liquid crystal display device, an organic electroluminescence (EL) device, a plasma display panel (PDP) device, an electron emission device (field emission display (FED) device, a surface conduction electron emitter display (SED) device), or the like, can be listed. Further, a description will be made about a method of manufacturing an active matrix substrate, or the like, as an example, which is formed on the above-described devices. The active matrix substrate is a substrate on which a thin film transistor, as well as source lines and data lines for electrical connection to the thin film transistor are formed.

Figure 18:
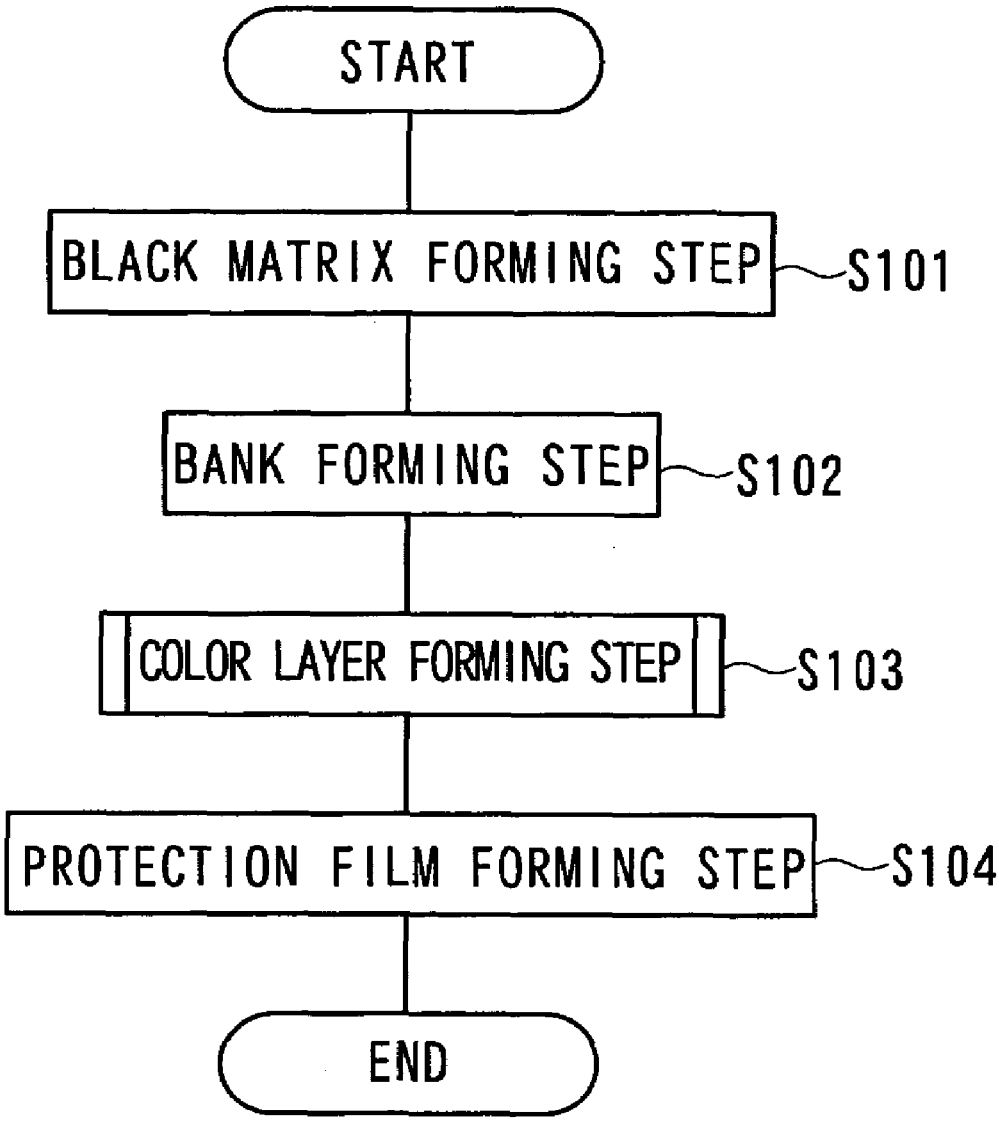
FIG. 18 is a flowchart showing the process for manufacturing a color filter.

First, an explanation will be made about the method of manufacturing a color filter which is built or assembled in a liquid crystal display device, an organic EL device, or the like. FIG. 18 is a flow chart showing the manufacturing steps of the color filter, and FIGS. 19A through 19E are schematic sectional views showing the color filter 600 (filter base member 600A) of this embodiment, as shown in the order of manufacturing steps.

Figure 19A:
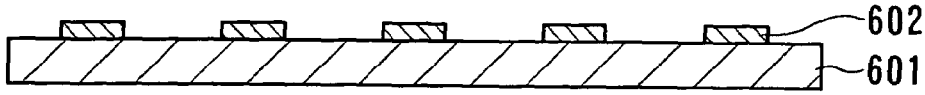
FIGS. 19A through 19E are schematic sectional views of the color filter as shown in the order of manufacturing processes.

First, at the black matrix forming step (S101), as shown in FIG. 19A, a black matrix 602 is formed on a substrate (W) 601. The black matrix 602 is formed of metallic chrome, a laminated member of metallic chrome and chrome oxide, or of resin black, or the like. In order to form the black matrix 602 made of a metallic thin film, a sputtering method, vapor deposition method, or the like, may be used. In addition, in case the black matrix 602 made of a resin thin film is formed, a gravure printing method, photo-resist method, thermal transfer method, or the like, may be used.

Figure 19B:
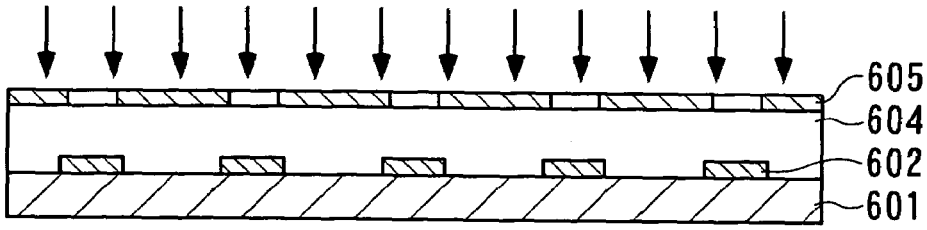

Then, at a bank forming step (S102), a bank 603 is formed in a state of being superposed on the black matrix 602. In other words, as shown in FIG. 19B, there is formed a resist layer 604 which is made of a negative type of transparent photosensitive resin so as to cover the substrate 601 and the black matrix 602. Then, the upper surface thereof is subjected to exposure processing in a state of being coated with a mask film 605 which is formed in a shape of a matrix pattern.

Figure 19C:
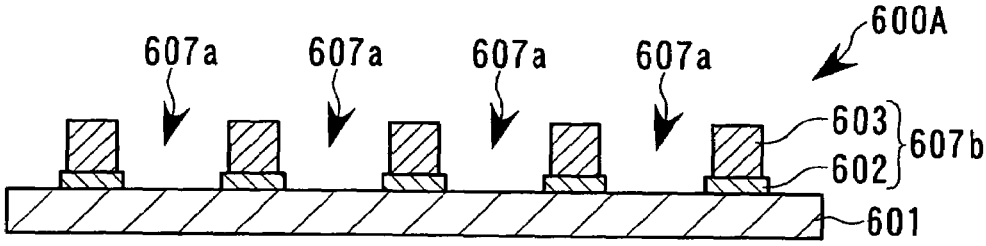

As shown in FIG. 19C, the un-exposed portion of the resist layer 604 is subjected to etching processing to perform patterning of the resist layer 604, whereby a bank 603 is formed. In case the black matrix is formed by the resin black, it becomes possible to commonly use the black matrix and the bank.

The bank 603 and the black matrix 602 thereunder become a partition wall portion 607*b* which partitions each of pixel regions 607*a*, thereby defining a shooting or firing region by the function liquid droplet (i.e., a region in which the function liquid droplet hits the target) at the subsequent color layer forming step to form the color layers (film forming layers) 608R, 608G, 608B.

By performing the above-described black matrix forming step and the bank forming step, the above-described filter base member 600A can be obtained.

As the material for the bank 603, there is used in this embodiment a resin material whose surface of coated film becomes liquid-repellent (water-repellent). Since the surface of the substrate (glass substrate) 601 has a liquid-affinity (affinity to water), the accuracy of shooting the liquid droplet into each of the pixel regions 607*a* enclosed by the bank 603 (partition wall portion 607*b*) is improved at a color layer forming step which is described hereinafter.

Figure 19D:
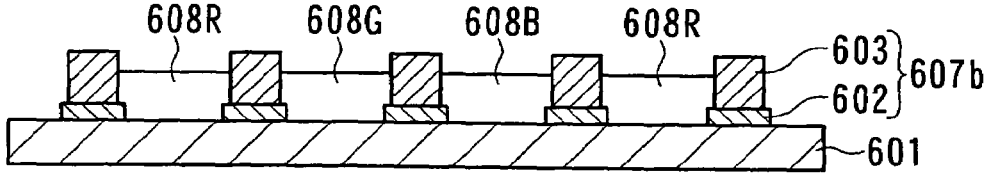

Then, at a color layer forming step (S103), as shown in FIG. 19D, the function liquid droplet is ejected by the function liquid droplet ejection head 31 to thereby cause the liquid droplet to be shot or fired into each of the pixel regions 607*a* enclosed by the partition wall portion 607*b*. In this case, by using the function liquid droplet ejection heads 31, three colors of red (R), green (G), and blue (B) function liquids (filter materials) are respectively introduced to thereby eject the function liquid droplets. As an arrangement pattern of the three colors R, G, and B, there are stripe arrangement, mosaic arrangement, delta arrangement, or the like.

Figure 19E:
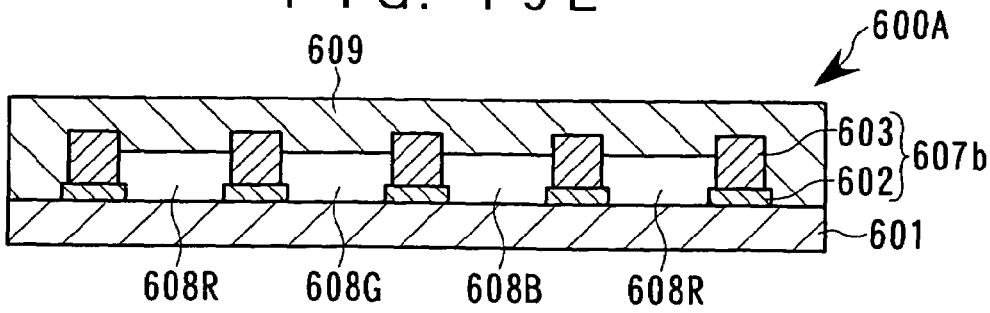

Thereafter, after drying processing (processing of heating, or the like), the function liquid is caused to be fixed to thereby form color layers 608R, 608G, 608B of three colors. Once the color layers have been formed, the step transfers to a protection film forming step (S104). As shown in FIG. 19E, a protection film 609 is formed to cover the upper surfaces of the substrate 601, the partition wall portion 607*b*, and color layers 608R, 608G, 608B.

In other words, after having ejected the protection film coating liquid over that entire surface of the substrate 601 on which the color layers 608R, 608B, 608G are formed, the protection film 609 is formed through the drying step.

After having formed the protection film 609, the color filter 600 transfers to a subsequent film-forming step at which a film such as indium tin oxide (ITO) to form a transparent electrode at the next step is formed.

Figure 20:
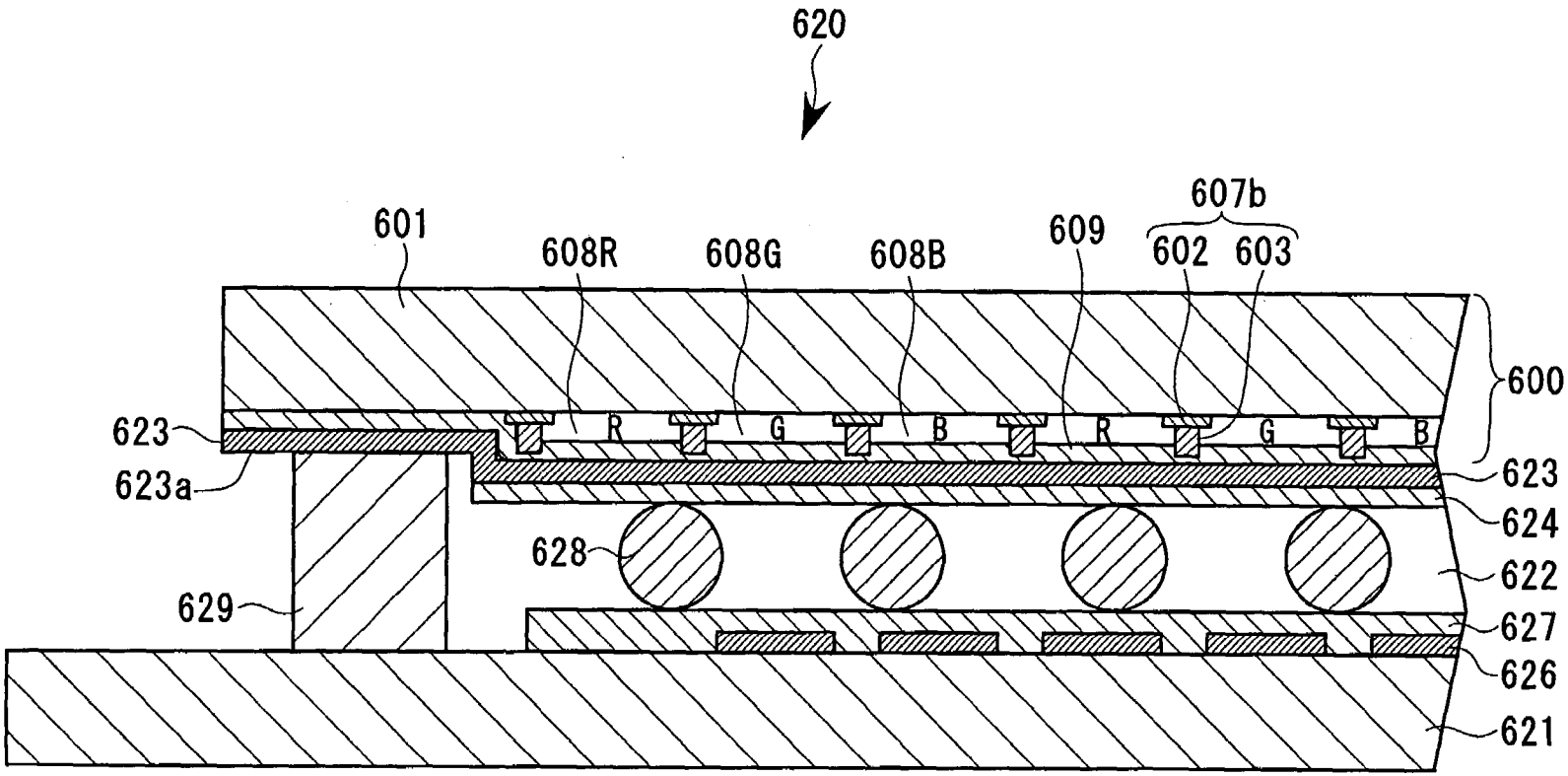
FIG. 20 is a schematic sectional view showing a main portion of a liquid crystal device using a color filter to which this invention is applied.

FIG. 20 is a sectional view of a main portion showing a general structure of passive matrix type of liquid crystal device (liquid crystal device) as an example of a liquid crystal display device employing the above-described color filter 600. By mounting auxiliary elements such as a liquid crystal driving integrated circuit (IC), backlight, supporting member, or the like, on this liquid crystal device 620, there is obtained a transmission liquid crystal display device as a final product. The color filter 600 is the same as that shown in FIGS. 19A through 19E. Therefore, the same reference numerals are affixed to the corresponding parts/portions and the explanation thereabout is omitted.

This liquid crystal device 620 is made up substantially of: a color filter 600; an opposite substrate 621 made of a glass substrate, or the like; and a liquid crystal layer 622 which is made up of a super twisted nematic (STN) liquid crystal composition interposed therebetween. The color filter 600 is disposed on an upper side as seen in the figure (i.e., on a side from which the viewer looks at the color filter).

Although not illustrated, on an outside surface of the opposite substrate 621 and of the color filter 600 (i.e., the surface which is opposite to the liquid crystal layer 622), there is respectively disposed a polarizer. On an outside of the polarizer which is positioned on the side of the opposite electrode 621, there is disposed a backlight.

On the protection film 609 (on the side of the liquid crystal) of the color filter 600, there are disposed a plurality of rectangular first electrodes 623 which are elongated in the left and right direction as seen in FIG. 20. A first alignment film 624 is formed so as to cover that side of the first electrode 623 which is opposite to the color filter 600.

On that surface of the opposite substrate 621 which lies opposite to the color filter 600, a plurality of second electrodes 626 are formed at a given distance to one another in a direction at right angles to the first electrode 623 of the color filter 600. A second alignment film 627 is formed so as to cover that surface of the second electrode 626 which is on the side of the liquid crystal layer 622. The first electrode 623 and the second electrode 626 are formed by a transparent conductive material such as ITO, or the like.

The spacer 628 which is provided inside the liquid crystal layer 622 is a material to keep the thickness of the liquid crystal layer 622 (cell gap) constant. The sealing material 629 is a material to prevent the liquid crystal composition inside the liquid crystal layer 622 from leaking outside. One end of the first electrode 623 is extended to the outside of the sealing material 629 as a running cable 623*a*.

The crossing portions between the first electrode 623 and the second electrode 626 form the pixels. It is thus so arranged that the color layers 608R, 608G, 608B of the color filter 600 are positioned in these portions which form the pixels.

At the ordinary manufacturing steps, the color filter 600 is coated with the patterning of the first electrode 623 and the first alignment film 624, to thereby form the portion on the side of the color filter 600. Aside from the above, the opposite substrate 621 is coated with the patterning of the second electrode 626 and the second alignment film 627, to thereby form the portion on the side of the opposite substrate 621. Thereafter, the spacer 628 and the sealing material 629 are formed into the portion on the side of the opposite substrate 621, and the portion on the side of the color filter 600 is adhered to the above-described portion in that state. Then, the liquid crystal which forms the liquid crystal layer 622 is filled from an inlet port of the sealing material 629, and the inlet port is closed thereafter. Then, both the polarizers and the backlight are laminated.

In the imaging apparatus 1 of this embodiment, the spacer material (function liquid) which forms, e.g., the cell gap is coated. Further, before the portion on the side of the color filter 600 is adhered to the portion on the side of the opposite substrate 621, the liquid crystal (function liquid) is uniformly coated on the region enclosed by the sealing material 629. Furthermore, printing on the sealing material 629 may be performed with the function liquid droplet ejection heads 31. In addition, the coating of both the first and second alignment films 624, 627 may alternatively be performed by the function liquid droplet ejection heads 31.

Figure 21:
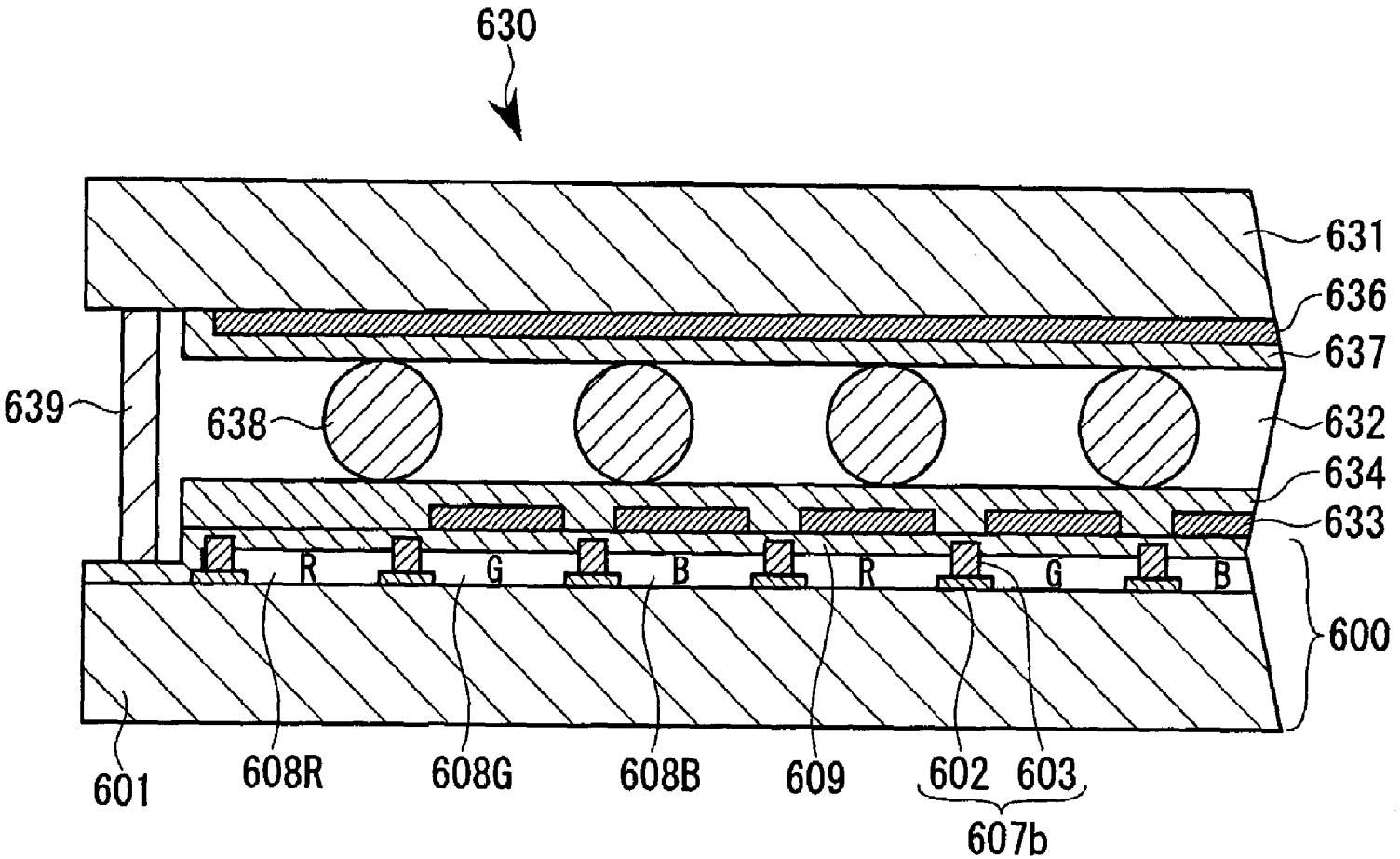
FIG. 21 is a schematic sectional view showing a main portion of a second example of liquid crystal device using a color filter to which this invention is applied.

FIG. 21 is a sectional view of an important part showing a general structure of a liquid crystal device as a second example using a color filter 600 manufactured in this embodiment.

What this liquid crystal device 630 is largely different from the above-described liquid crystal device 620 is that the color filter 600 is disposed on the lower side as seen in the figure (i.e., on the side opposite to the side from which the viewer looks at the device).

This liquid crystal device 630 is constructed such that a liquid crystal layer 632 which is made of an STN liquid crystal is sandwiched between the color filter 600 and the opposite substrate 631 which is made of a glass substrate, or the like. Though not illustrated, a polarizer, or the like, is disposed on an outside surface of the opposite substrate 631 and the color filter 600, respectively.

On the protection film 609 (on the side of the liquid crystal layer 632) of the color filter 600, there are formed a plurality of rectangular first electrodes 633 which are elongated in a direction at right angles to the surface plane of FIG. 21. A first alignment film 634 is formed so as to cover that side of the first electrode 633 which is on the side of the liquid crystal layer 632.

On that surface of the opposite substrate 631 which lies opposite to the color filter 600, a plurality of second electrodes 636 are formed at a given distance to one another in a direction at right angles to the first electrode 633. A second alignment film 637 is formed so as to cover that surface of the second electrode 636 which is on the side of the liquid crystal layer 632.

The liquid crystal layer 632 is provided with a spacer 638 to keep the thickness of the liquid crystal layer 632 constant, and a sealing material 639 to prevent the liquid crystal composition inside the liquid crystal layer 632 from leaking outside.

In the same manner as in the above-described liquid crystal device 620, the crossing portions between the first electrode 633 and the second electrode 636 form the pixels. It is thus so arranged that the color layers 608R, 608G, 608B of the color filter 600 are positioned in these portions which form the pixels.

Figure 22:
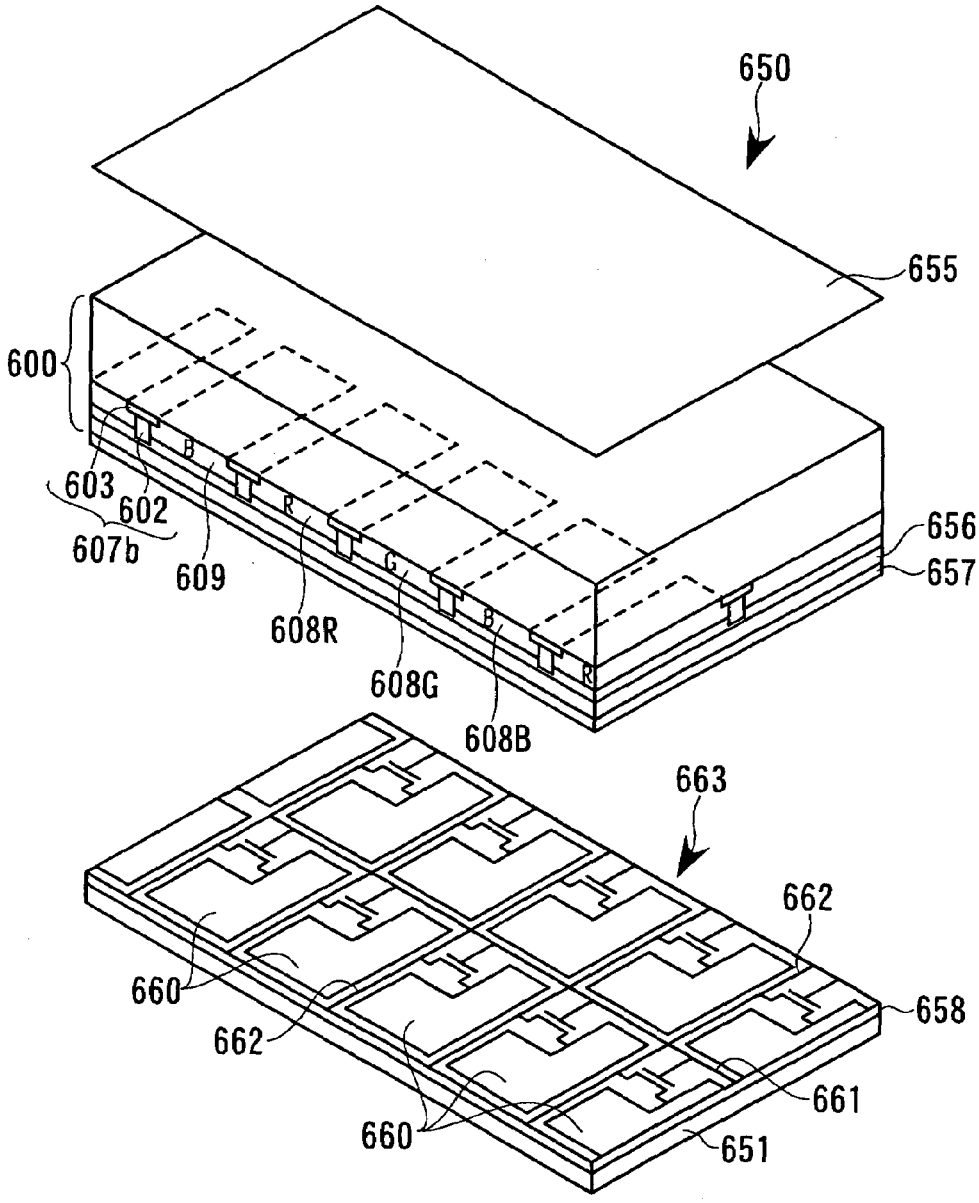
FIG. 22 is a schematic sectional view showing a main portion of a third example of liquid crystal device using a color filter to which this invention is applied.

FIG. 22 is an exploded perspective view showing a general structure of a transmission thin film transistor (TFT) type of liquid crystal device as a third example using a color filter 600 to which this invention is applied.

This liquid crystal device 650 has a construction in which the color filter 600 is disposed on an upper side as seen in the figure (i.e., on the side of the viewer).

This liquid crystal device 650 is made up of: a color filter 600; an opposite substrate 651 which is disposed to lie opposite to the color filter 600; a liquid crystal layer which is sandwiched therebetween; a polarizer 655 which is disposed on an upper side (on the side of the viewer) of the color filter 600; and a polarizer (not illustrated) which is disposed on the lower side of the opposite electrode 651.

On the surface (i.e., the surface on the side of the opposite substrate 651) of the protection film 609 of the color filter 600, there is formed an electrode 656 for the liquid crystal driving. This electrode 656 is made of a transparent conductive material such as ITO, or the like, and is formed into an entire-surface electrode which covers the entire region in which the pixel electrodes 660 (to be described later) are formed. An alignment film 657 is disposed in a state of covering the opposite surface of this pixel electrodes 660 of the electrode 656.

On that surface of the opposite substrate 651 which lies opposite to the color filter 600, there is formed an insulating layer 658. On this insulating layer 658 there are formed scanning lines 661 and signal lines 662 in a state of crossing each other at right angles. Pixel electrodes 660 are formed inside the regions enclosed by the scanning lines 661 and the signal lines 662. In the actual liquid crystal device, there will be disposed an alignment film (not illustrated) on the pixel electrode 660.

In the portion enclosed by the notched portion of the pixel electrode 660, the scanning line 661, and the signal line 662, there are built in or assembled a thin film transistor 663 which is provided with a source electrode, a drain electrode, a semiconductor, and a gate electrode. By charging signals to the scanning line 661 and the signal line 662, the thin film transistor 663 can be switched on and off so as to control the supply of electric current to the pixel electrode 660.

Although the above-described liquid crystal devices 620, 630, 650 of each of the above embodiments is constituted into a transmission type, it may also be constituted into a reflective type of liquid crystal device or into a translucent reflective type of liquid crystal device by providing a reflective layer or a translucent reflective layer, respectively.

Figure 23:
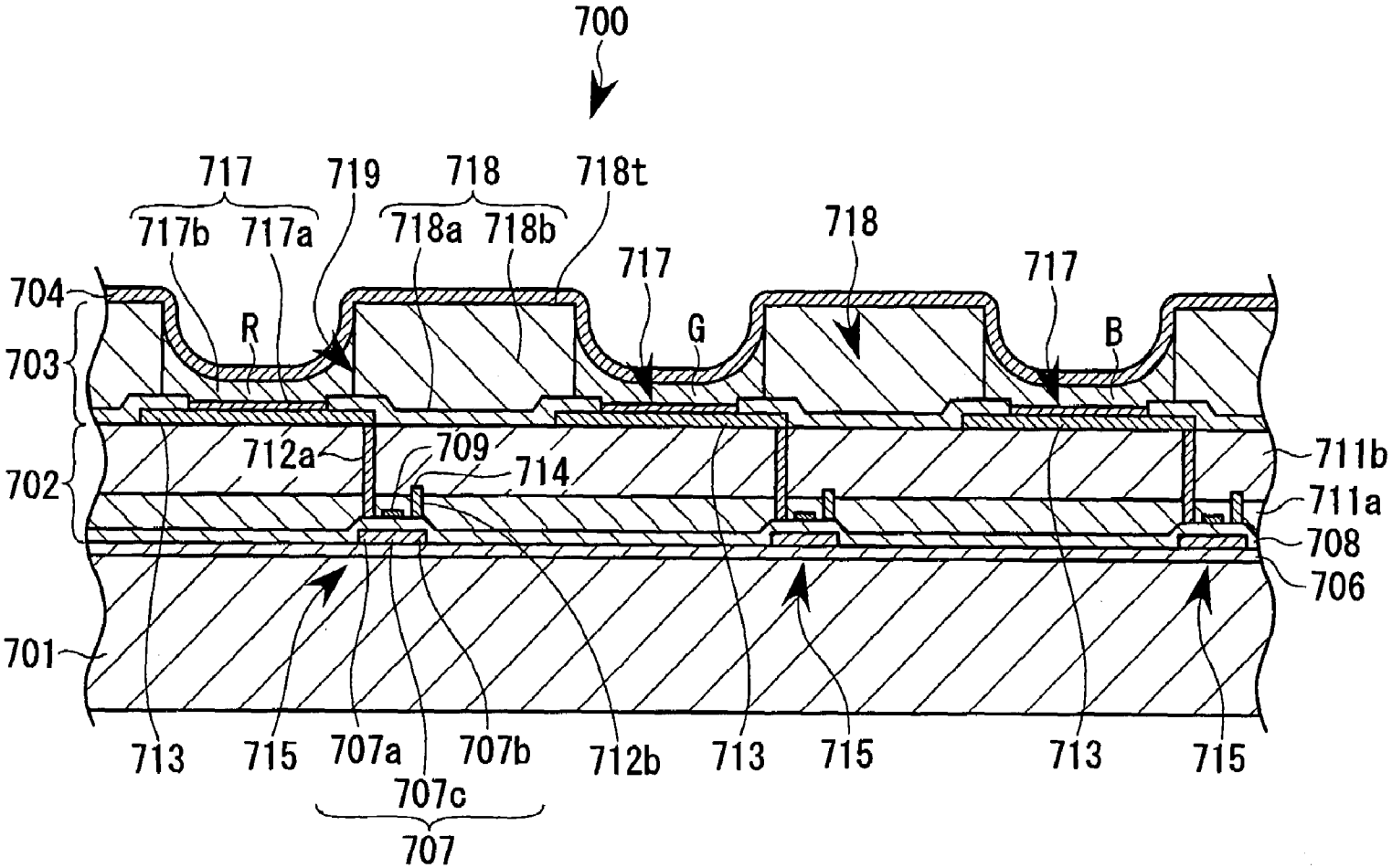
FIG. 23 is a schematic sectional view showing a main portion of a display device which is an organic electroluminescence (EL) device.

FIG. 23 is a sectional view of a main portion of a display region of an organic EL device (hereinafter referred to as a display device 700).

This display device 700 is substantially constituted by a substrate 701 (W), and on this substrate are laminated a circuit element part 702, emitting element part 703 and a cathode 704.

In this display device 700, the light emitted from the emitting element part 703 toward the substrate 701 is transmitted through the circuit element part 702 and the substrate 701. The light emitted from the emitting element part 703 toward the side opposite to the substrate 701 is reflected by the cathode 704 and passes through the circuit element part 702 and the substrate 701 for ejection toward the viewer.

Between the circuit element part 702 and the substrate 701, there is formed a base protection film 706 which is made of a silicon oxide film. On top of this base protection film 706 (on the side of the emitting element 703), there is formed an island-shaped semiconductor film 707 which is made of polycrystalline silicon. In the left and right regions of this semiconductor film 707, there are respectively formed a source region 707*a* and a drain region 707*b* by high-concentration anion implantation. The central portion which is free from anion implantation becomes a channel region 707*c*.

In the circuit element part 702, there is formed a transparent gate insulation film 708 which covers the base protection film 706 and the semiconductor film 707. In that position on this gate insulation film 708 which corresponds to the channel region 707*c* of the semiconductor film 707, there is formed a gate electrode 709 which is made up of Al, Mo, Ta, Ti, W, or the like. On top of this gate electrode 709 and the gate insulation film 708, there are formed a transparent first interlayer insulator (interlayer dielectric film) 711*a* and a second interlayer insulator 711*b*. Through the first and second interlayer insulators 711*a*, 711*b*, there are formed contact holes 712*a*, 712*b* which are in communication with the source region 707*a* and the drain region 707*b*, respectively, of the semiconductor film 707.

On top of the second interlayer insulator 711*b*, there is formed, by patterning, a transparent pixel electrode 713 with a given shape which is made of ITO, or the like. This pixel electrode 713 is connected to the source region 707*a* through the contact hole 712*a*.

On top of the first interlayer insulator 711*a*, there is formed an electric power source wiring 714, which is connected to the drain region 707*b* through the contact hole 712*b*.

As described hereinabove, the circuit element part 702 has formed therein a driving thin film transistor 715 which is connected to each of the pixel electrodes 713.

The above-described emitting element part 703 is made up of: a function layer 717 which is laminated on each of the plurality of pixel electrodes 713; and a bank part 718 which is provided between each of the pixel electrodes 713 and the function layers 717 to thereby partition each of the function layers 717.

The emitting element is constituted by these pixel electrodes 713, the function layer 717, and the cathode 704 which is disposed on the function layer 717. The pixel electrode 713 is formed into a substantial rectangle as seen in plan view by patterning, and the bank part 718 is formed between each of the pixel electrodes 713.

The bank part 718 is made up of: an inorganic-matter bank layer 718*a* (first bank layer) which is formed by inorganic materials such as SiO, $SiO_2$, $TiO_2$, or the like; and an organic-matter bank layer 718*b* (second bank layer) which is laminated on the inorganic-matter bank layer 718*a*, which is trapezoidal in cross section, and which is formed by a resist superior in heat-resistance and solvent-resistance such as an acrylic resin, a polyimide resin, or the like. Part of this bank part 718 is formed in a state of being overlapped with the peripheral portion of the pixel electrode 713.

Between each of the bank parts 718, there is formed an opening part 719 which gradually opens upward relative to the pixel electrode 713.

The function layer 717 is made up of: a hole injection/transport layer 717*a* which is formed inside the opening part 719 in a state of being laminated on the pixel electrode 713; and an emitting layer 717*b* which is formed on this hole injection/transport layer 717*a*. It may be so arranged that other function layers having other functions are further formed adjacent to the emitting layer 717*b*. For example, an electron transport layer may be formed.

The hole injection/transport layer 717*a* has a function of transporting holes from the pixel electrode 713 side for injection into the emitting layer 717*b*. This hole injection/transport layer 717*a* is formed by ejecting the first composition of matter (function liquid) containing therein the hole injection/transport layer forming material. As the hole injection/transport layer forming material, there may be used known materials.

The emitting layer 717*b* emits light of red (R), green (G) or blue (B), and is formed by ejecting the second composition of matter (function liquid) containing the emitting layer forming material (emitting material). The solvent (non-polar solvent) for the second composition of matter shall preferably be known materials insoluble to the hole injection/transport layer 717*a*. By using this kind of non-polar solvent as the second composition of matter of the emitting layer 717*b*, the emitting layer 717*b* can be formed without dissolving the hole injection/transport layer 717*a* again.

The emitting layer 717*b* is so arranged that the holes injected from the hole injection/transport layer 717*a* and the electron injected from the cathode 704 get bonded again in the emitting layer to thereby emit light.

The cathode 704 is formed in a state to cover the entire surface of the emitting element part 703, and forms a pair with the pixel electrode 713 to thereby cause the electric current to flow through the function layer 717. A sealing member (not illustrated) is disposed on top of this cathode 704.

Now, a description will be made about the manufacturing steps of the display device 700 with reference to FIGS. 24 through 32.

Figure 24:
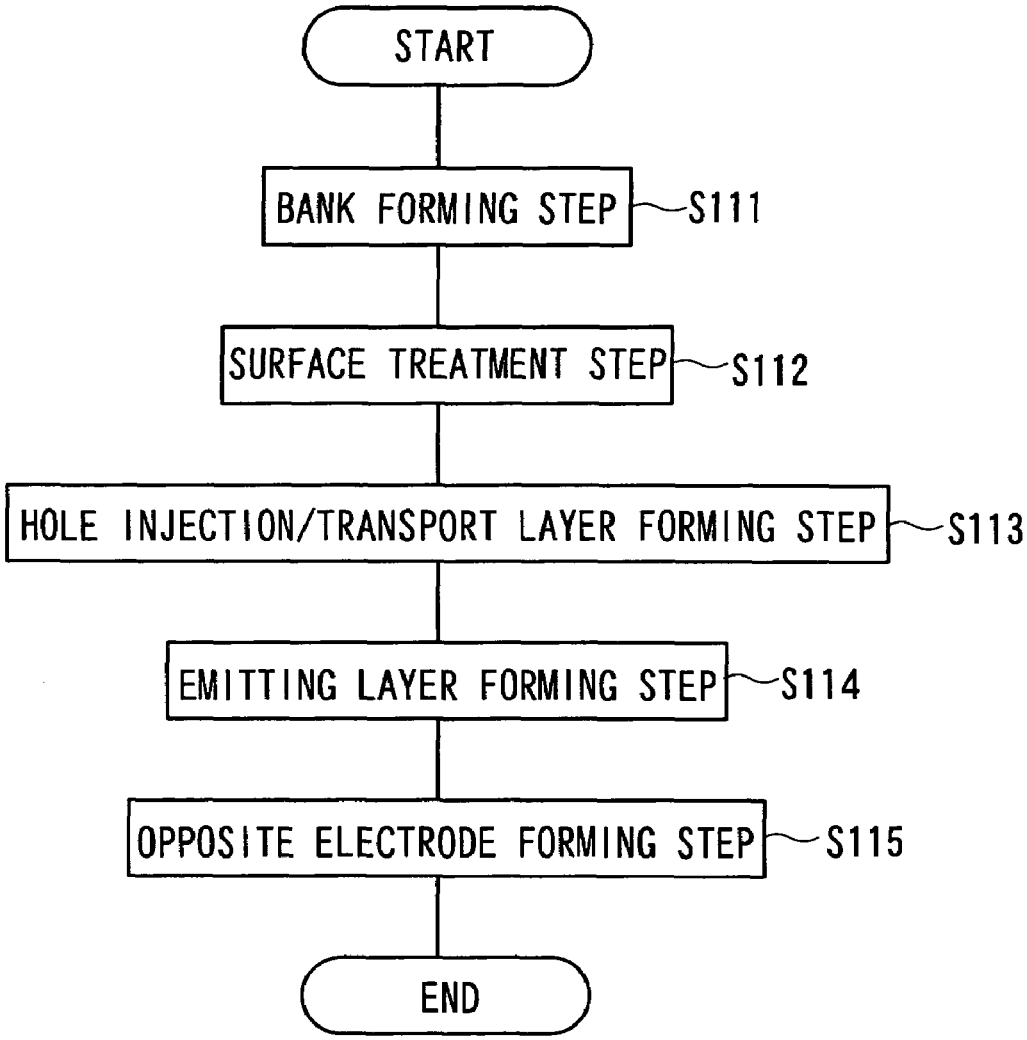
FIG. 24 is a flow chart showing the process for manufacturing a display device which is an organic EL device.

As shown in FIG. 24, this display device 700 is manufactured through the following steps, i.e., a bank part forming step (S111), a surface treatment step (S112), a hole injection/transport layer forming step (S113), an emitting layer forming step (S114), and an opposite electrode forming step (S115). The manufacturing steps need not be limited to the illustrated ones; some steps may be omitted or others added if necessary.

Figure 25:
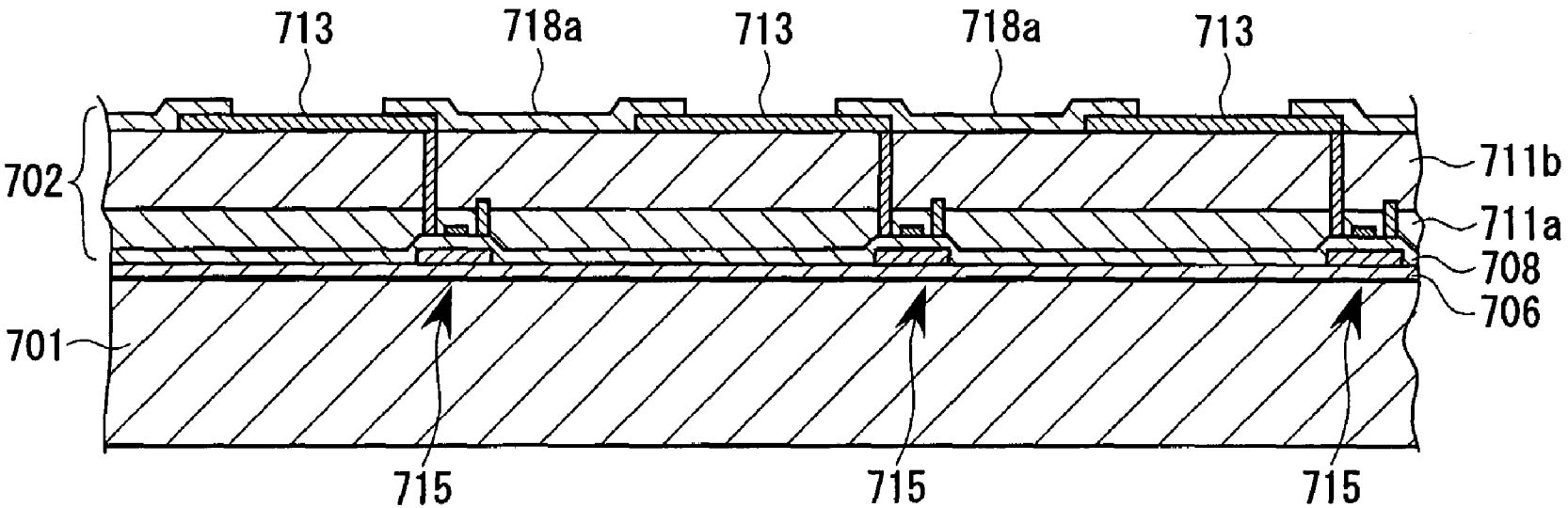
FIG. 25 is a schematic sectional view of a main portion explaining the process for forming an inorganic-matter bank layer.

First, at the bank part forming step (S111), an inorganic-matter bank layer 718*a* is formed on the second interlayer insulator 711*b* as shown in FIG. 25. This inorganic-matter bank layer 718*a* is formed, after having formed an inorganic-matter film on the forming position, by patterning the inorganic-matter film by means of photolithography, or the like. At this time, part of the inorganic-matter bank layer 718*a* is formed so as to overlap with the peripheral portion of the pixel electrode 713.

Figure 26:
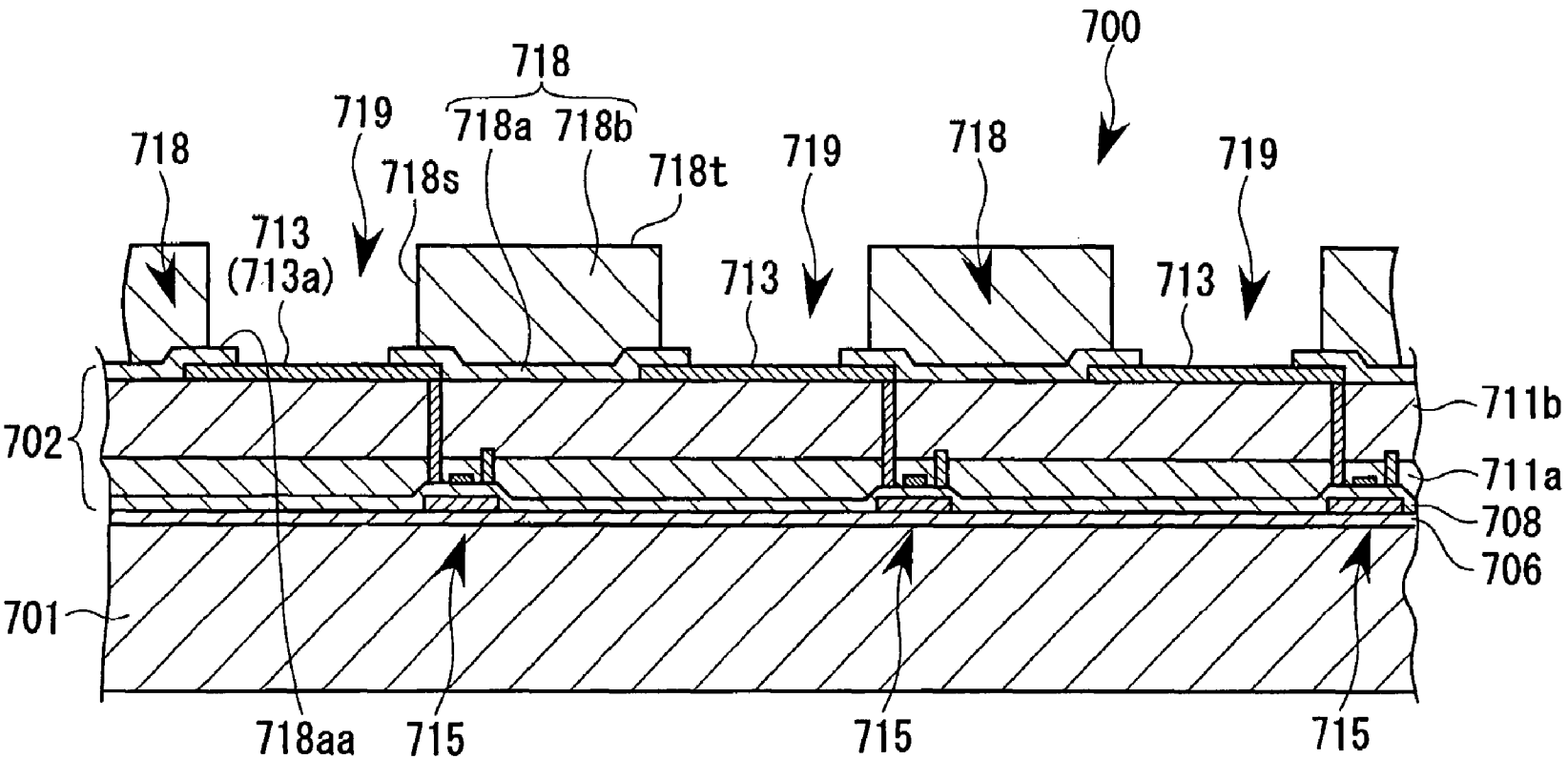
FIG. 26 is a schematic sectional view of a main portion explaining the process for forming an organic-matter bank layer.

Once the inorganic-matter bank layer 718*a* has been formed, an organic-matter bank layer 718*b* is formed on top of the inorganic-matter bank layer 718*a* as shown in FIG. 26. This organic-matter bank layer 718*b* is formed, as in the case of the inorganic-matter bank layer 718*a*, by patterning by means of photolithography, or the like.

The bank part 718 is formed as described above. As a result, an opening part 719 which opens upward relative to the pixel electrode 713 is formed. This opening part 719 defines a pixel region.

At the surface treatment step (S112), the liquid-affinity processing (treatment to gain affinity to liquid) and the liquid-repellency processing (treatment to gain repellency to liquid) are performed. The regions in which the liquid-affinity processing is to be performed are the first laminated part 718*aa* of the inorganic-matter bank layer 718*a* and the electrode surface 713*a* of the pixel electrode 713. These regions are subjected to surface treatment to obtain liquid affinity by means, e.g., of plasma processing using oxygen as the processing gas. This plasma processing also serves the purpose of cleaning the ITO which is the pixel electrode 713.

The liquid-repellency processing, on the other hand, is performed on the wall surface 718*s* of the organic-matter bank layer 718*b* and on the upper surface 718*t* of the organic-matter bank layer 718*b*. By means of plasma processing with, e.g., methane tetrafluoride as the processing gas, the surface is subjected to fluoridizing processing (processed to obtain liquid-repellent characteristic).

By performing this surface processing step, it becomes possible for the function liquid droplet to reach (or hit) the pixel region in a surer manner when the function layer 717 is formed by using the function liquid droplet ejection heads 31. It also becomes possible to prevent the function liquid droplet that has hit the pixel region from flowing out of the opening part 719.

By going through the above-described steps, the display device base member 700A can be obtained. This display device base member 700A is mounted on the setting table 24 of imaging apparatus 1 as shown in FIG. 1, and the following hole injection/transport layer forming step (S113) and the emitting layer forming step (S114) are performed.

Figure 27:
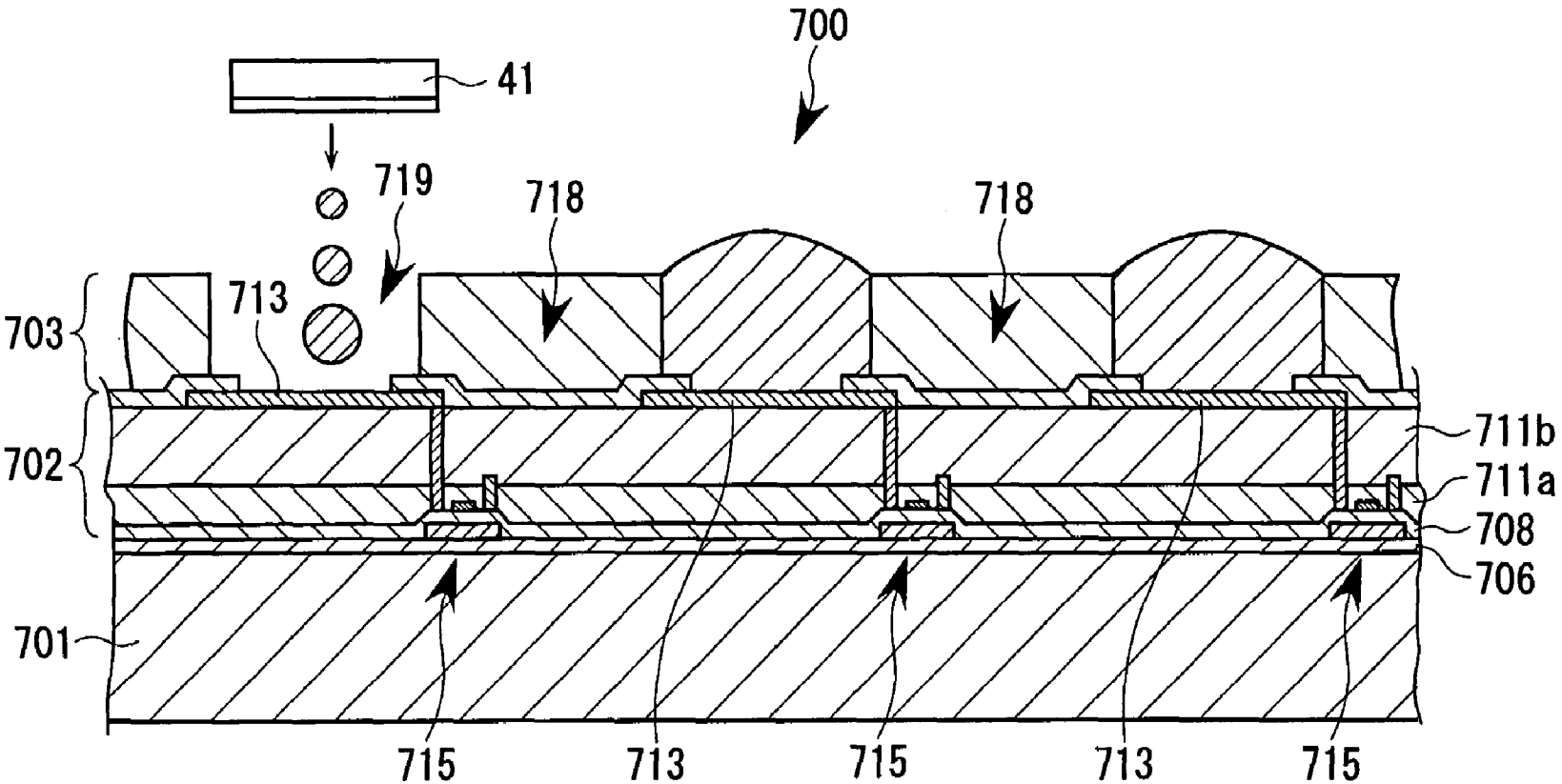
FIG. 27 is a schematic sectional view of a main portion explaining the process for forming a hole injection/transport layer.
Figure 28:
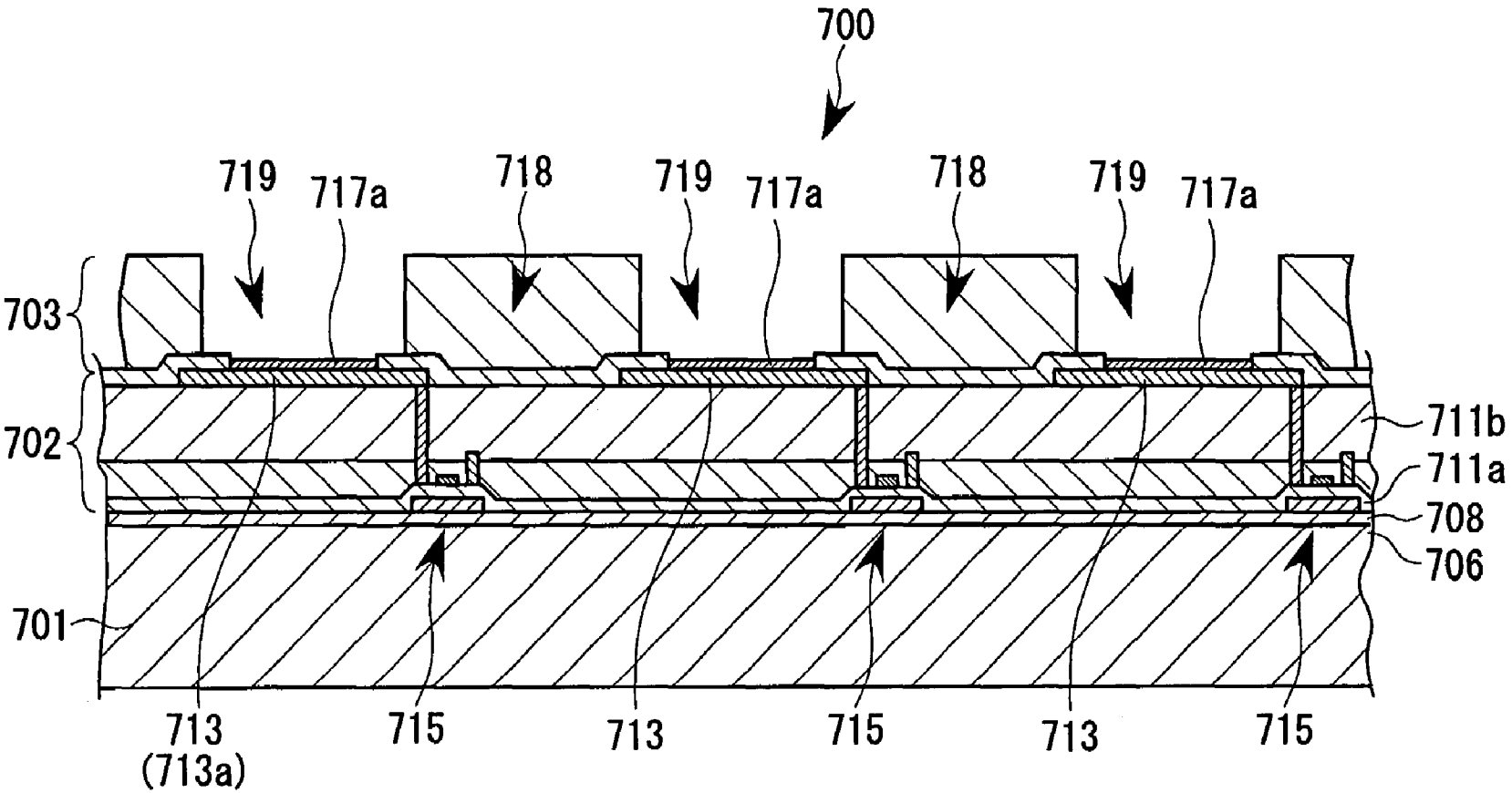
FIG. 28 is a schematic sectional view of a main portion explaining the state in which the hole injection/transport layer has been formed.

As shown in FIG. 27, at the hole injection/transport layer forming step (S113), the first composition of matter containing therein the hole injection/transport layer forming material is ejected from the function liquid droplet ejection heads 31 into each of the opening parts 719. Thereafter, as shown in FIG. 28, drying process and heat-treatment process are performed in order to evaporate the polar solvent contained in the first composition of matter, whereby the hole injection/transport layer 717*a* is formed on the pixel electrode 713 (electrode surface 713*a*).

A description will now be made about the emitting layer forming step (S114). At this emitting layer forming step, as described above, in order to prevent the hole injection/transport layer 717*a* from getting resolved again, there is used a non-polar solvent which is insoluble to the hole injection/transport layer 717*a* as a solvent for the second composition of matter to be used in forming the emitting layer.

On the other hand, since the hole injection/transport layer 717*a* is low in affinity to the non-polar solvent, it will be impossible to closely adhere the hole injection/transport layer 717*a* to the emitting layer 717*b* or to uniformly coat the emitting layer 717*b* even if the second composition of matter containing therein the non-polar solvent is ejected onto the hole injection/transport layer 717*a*.

As a solution, in order to enhance the affinity of the surface of the hole injection/transport layer 717*a* to the non-polar solvent and to the emitting layer forming material, it is preferable to perform the surface treatment (treatment to improve the quality of the surface) before forming the emitting layer. This surface treatment is performed by coating the hole injection/transport layer 717*a* with a surface modifying material which is a solvent that is the same as, or similar to, the non-polar solvent of the second composition of matter to be used in forming the emitting layer, and then drying it.

By performing this kind of treatment, the surface of the hole injection/transport layer 717*a* easily conforms to the non-polar solvent. It becomes thus possible to uniformly coat, at a subsequent step, the hole injection/transport layer 717*a* with the second composition of matter containing therein the emitting layer forming material.

Figure 29:
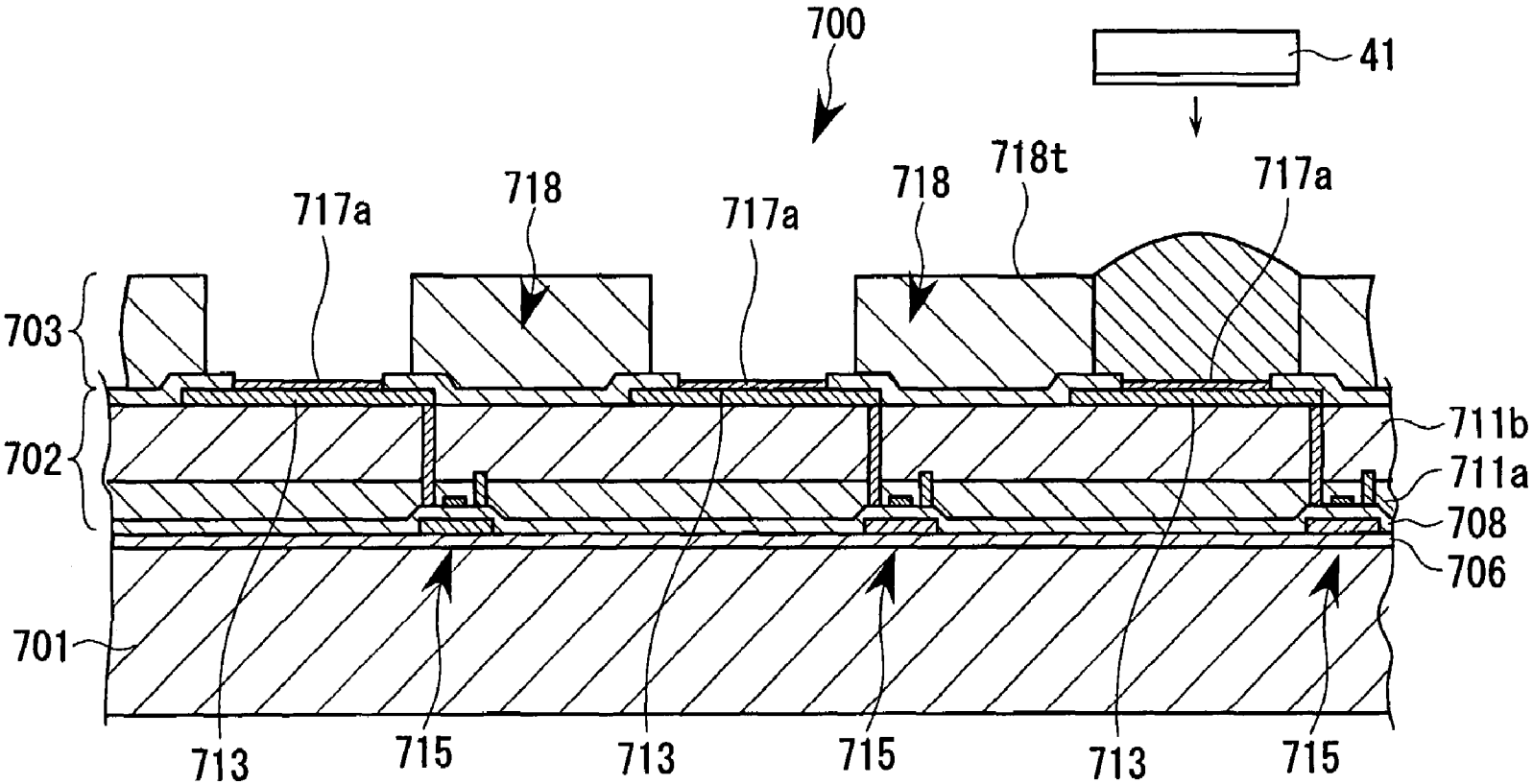
FIG. 29 is a schematic sectional view of a main portion explaining the process for forming a blue emitting layer.

Thereafter, as shown in FIG. 29, the second composition of matter containing therein the emitting layer forming material corresponding to one of the colors (blue in the example in FIG. 29) is implanted into the pixel region (opening part 719) by a predetermined amount. The second composition of matter implanted into the pixel region gets spread over the hole injection/transport layer 717*a* to thereby fill the opening part 719. Even if the second composition of matter goes out of the pixel region to thereby hit the upper surface 718*t* of the bank part 718, since this upper surface 718*t* has been subjected to the liquid-repellent treatment as described above, the second composition of matter is likely to be easily rolled into the opening part 719.

Figure 30:
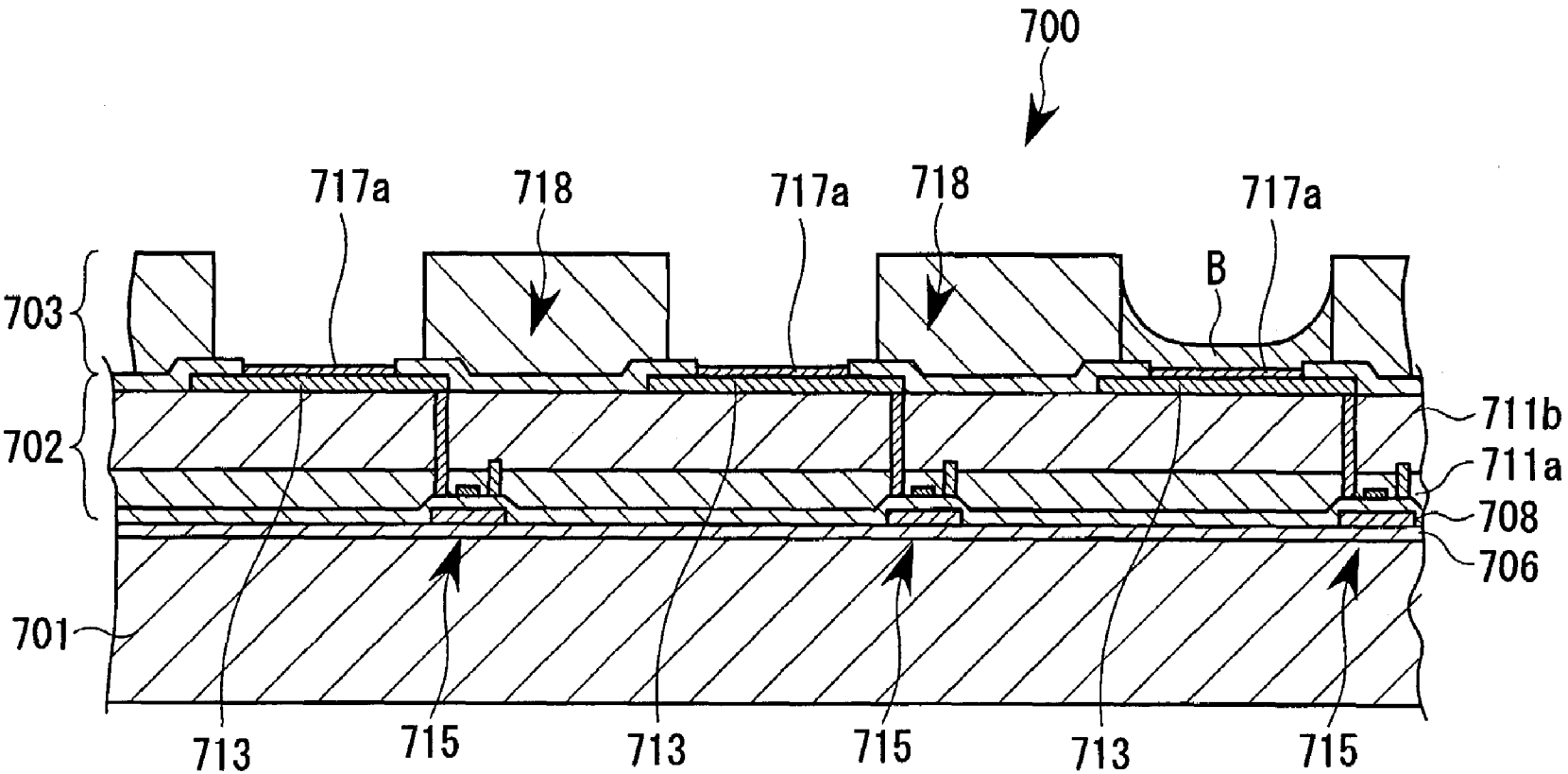
FIG. 30 is a schematic sectional view of a main portion explaining the state in which the blue emitting layer has been formed.

Thereafter, by performing the drying step, or the like, the second composition of matter after ejection is processed by drying to thereby evaporate the non-polar solvent contained in the second composition of matter. The emitting layer 717*b* is thus formed on top of the hole injection/transport layer 717*a* as shown in FIG. 30. In this embodiment, there is formed an emitting layer 717*b* corresponding to the blue color (B).

Figure 31:
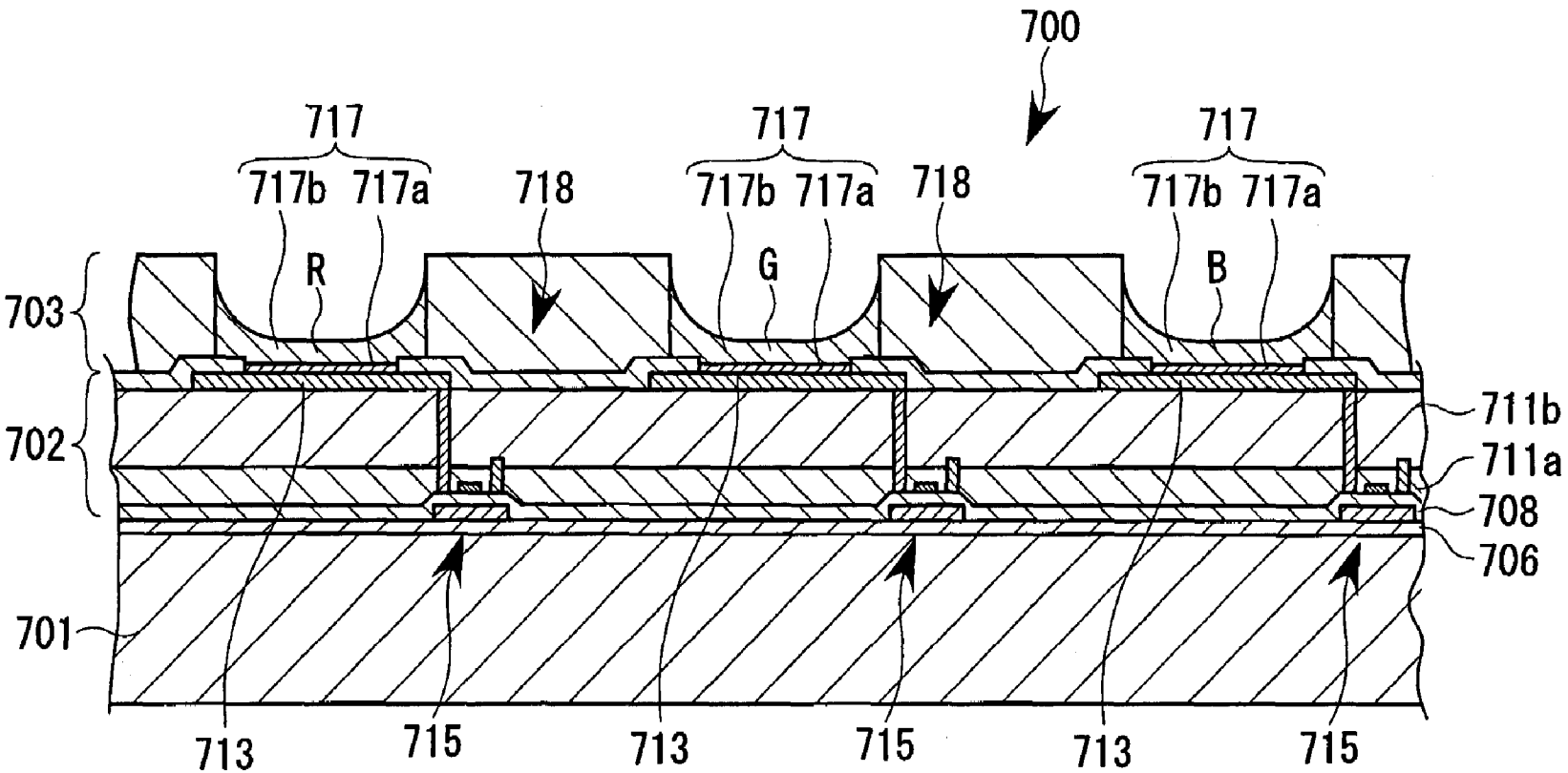
FIG. 31 is a schematic sectional view of a main portion explaining the state in which emitting layers of respective colors have been formed.

By using the function liquid droplet ejection head 31, the steps like in the above-described emitting layer 717*b* corresponding to the blue color (B) are sequentially performed as shown in FIG. 31, whereby the emitting layers 717*b* corresponding to the other colors of red (R) and green (G) are formed. The order of forming the emitting layer 717*b* is not limited to the above-described embodiment, but may be arbitrarily determined. For example, it is possible to determine the order of forming depending on the materials to form the emitting layer. As an arrangement pattern of the three colors R, G, and B, there are stripe arrangement, mosaic arrangement, delta arrangement, or the like.

In the manner as described hereinabove, the function layer 717, i.e., the hole injection/transport layer 717*a* and the emitting layer 717*b*, is formed on the pixel electrode 713. Then, the process transfers to the opposite electrode forming step (S115).

Figure 32:
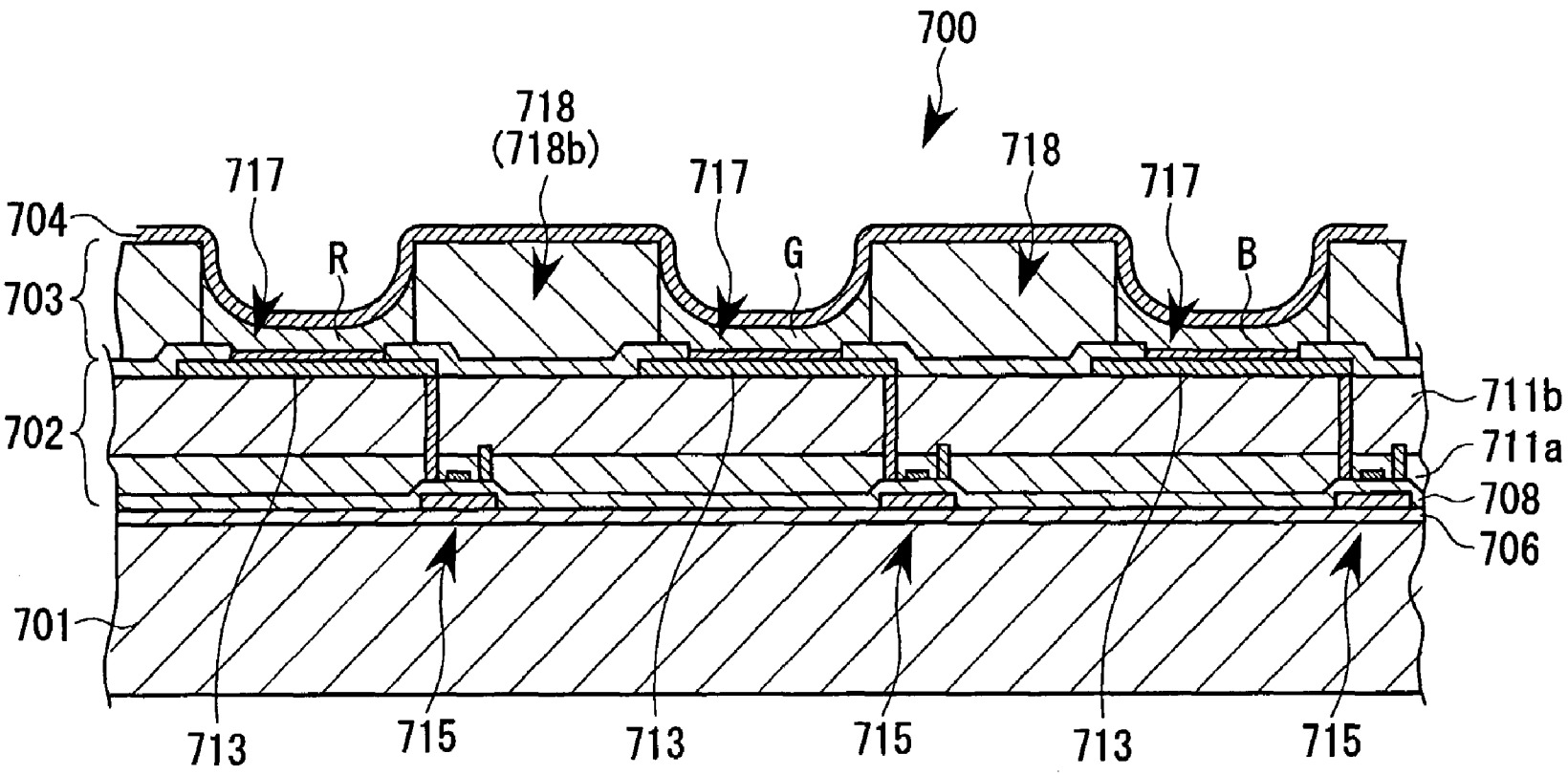
FIG. 32 is a schematic sectional view of a main portion explaining the process for forming a cathode.

At the opposite electrode forming step (S115), as shown in FIG. 32, the cathode 704 (opposite electrode) is formed over the entire surfaces of the emitting layer 717*b* and the organic matter bank layer 718*b* by means of a vapor deposition method, sputtering method, chemical vapor deposition (CVD) method, or the like. This cathode 704 is constituted in this embodiment by laminating, e.g., a calcium layer and an aluminum layer.

On an upper part of the cathode 704, there are provided an Al film and an Ag film as electrodes and, on top thereof, a protection layer for preventing oxidation such as an $SiO_2$ film, an SiN film, or the like, depending on necessity.

After having formed the cathode 704 as described above, a sealing process for sealing the upper portion of the cathode 704 with a sealing material, a wiring processing, or the like, are performed to thereby obtain the display device 700.

Figure 33:
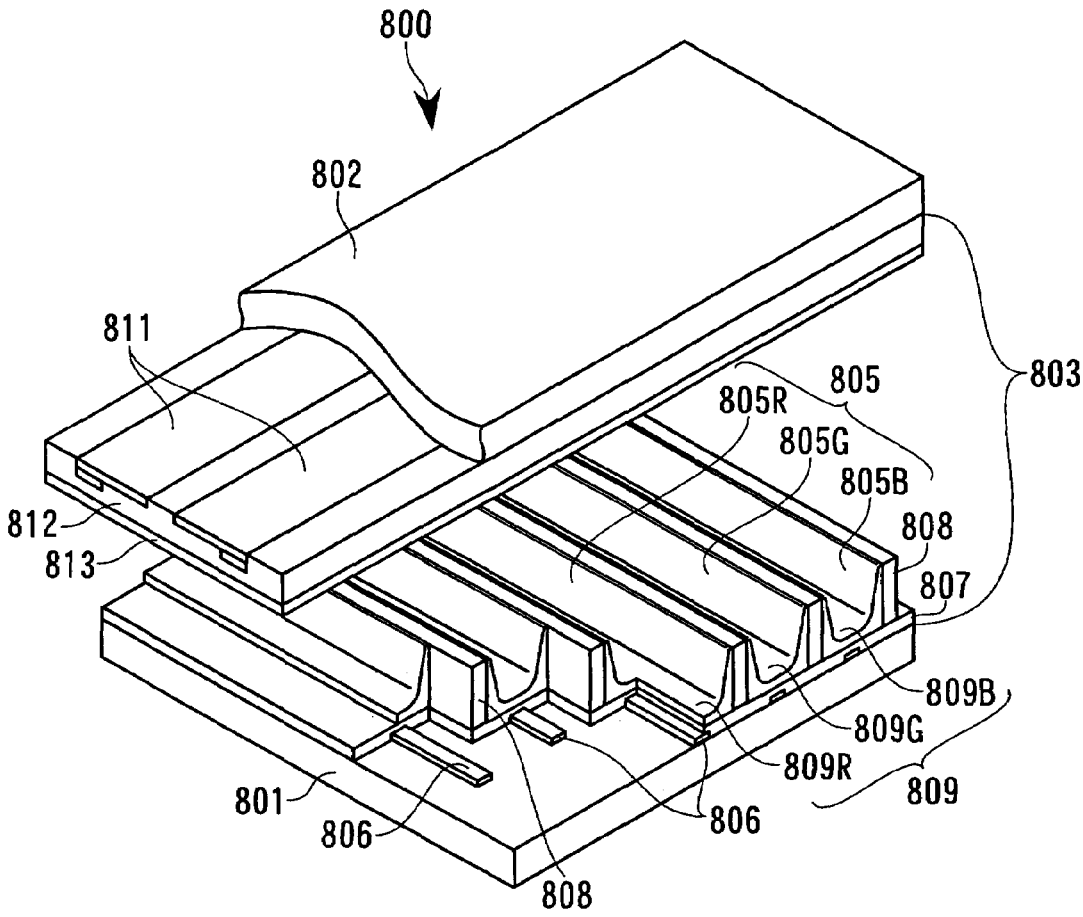
FIG. 33 is an exploded perspective view of a main portion of a display device which is of a type of plasma display panel (PDP) device.

FIG. 33 is an exploded perspective view showing a main portion of the plasma type of display device (PDP device, hereinafter simply referred to as a display device 800). In the figure, the display device 800 is shown in a partly cut away state.

This display device 800 is made up of a first substrate 801 and a second substrate 802 which are disposed to lie opposite to each other, as well as a discharge display part 803 which is formed therebetween. The discharge display part 803 is constituted by a plurality of discharging chambers 805. Among these plurality of discharging chambers 805, the three chambers 805 of a red discharging chamber 805R, a green discharging chamber 805G, and a blue discharging chamber 805B are disposed as a set to make one pixel.

On an upper surface of the first substrate 901, there are formed address electrodes 806 in a stripe form at a given distance from one another. A dielectric layer 807 is formed to cover these address electrodes 806 and the upper surface of the first substrate 901. On the dielectric layer 807, there are vertically disposed partition walls 808 which are positioned between respective address electrodes 807 in a manner to lie along the respective address electrodes 806. Some of these partition walls 808 extend on both widthwise sides of the address electrodes 806 and others (not illustrated) extend at right angles to the address electrodes 806.

The regions which are partitioned by these partition walls 808 form the discharge chambers 805.

Inside the discharge chambers 805, there are disposed fluorescent bodies 809. The fluorescent bodies 809 emit luminescent light of any one of red (R), green (G) and blue (B). At the bottom of the red discharging chamber 805R, there are disposed red fluorescent bodies 809R, at the bottom of the green discharging chamber 805G, there are disposed green fluorescent bodies 909R, and at the bottom of the blue discharging chamber 805B, there are disposed blue fluorescent bodies 809B, respectively.

On the lower side of the second substrate 802 as seen in the figure, there are formed a plurality of display electrodes 811 in a direction crossing the address electrodes 806 at right angles at a predetermined distance from one another. In a manner to cover them, there are formed a dielectric layer 812 and a protection film 813 which is made of MgO, or the like.

The first substrate 801 and the second substrate 802 are oppositely adhered to each other in a state in which the address electrodes 806 and the display electrodes 811 cross each other at right angles. The address electrodes 806 and the display electrodes 811 are connected to an AC power source (not illustrated).

By charging electricity to each of the electrodes 806, 811, the fluorescent bodies 809 are caused to emit light through excitation in the discharge display part 803, whereby color display becomes possible.

In this embodiment, the address electrodes 806, the display electrodes 811, and the fluorescent bodies 809 can be formed by using the imaging apparatus 1 as shown in FIG. 1. A description will now be made about an embodiment of steps for manufacturing the address electrodes 806 on the first substrate 801.

In this case, the following steps are performed in a state in which the first substrate 801 is placed on the setting table 24 of the imaging apparatus 1.

First, by means of the function liquid droplet ejection head 31, the liquid material (function liquid) containing therein a material for forming the conductive film wiring is caused to hit the address electrode forming region as the function liquid droplet. This liquid material is prepared as the electrically conductive film wiring (wiring formed by electrically conductive film) by dispersing electrically conductive fine particles of metals, or the like, into a dispersion medium. As the electrically conductive fine particles, there are used metallic fine particles containing therein gold, silver, copper, palladium, nickel, or the like, or an electrically conductive polymer, or the like.

Once all of the address electrode forming regions in which the liquid material is scheduled to be filled have been filled therewith, the liquid material after ejection is dried to evaporate the dispersion medium contained in the liquid material, whereby the address electrodes 806 are formed.

An embodiment of the address electrodes 806 has been given hereinabove, but the display electrodes 811 and the fluorescent bodies 809 can also be formed by the above-described steps.

In forming the display electrodes 811, a liquid material (function liquid) containing therein the electrically conductive wiring forming material is caused to hit the display electrode forming region as a function liquid droplet, in a similar manner as in the case of the address electrodes 806.

In forming the fluorescent bodies 809, on the other hand, a liquid material (function liquid) containing therein a fluorescent material corresponding to each of the colors (R, G, B) is ejected from the function liquid droplet ejection heads 31 to thereby cause them to hit the discharge chambers 805 of corresponding colors.

Figure 34:
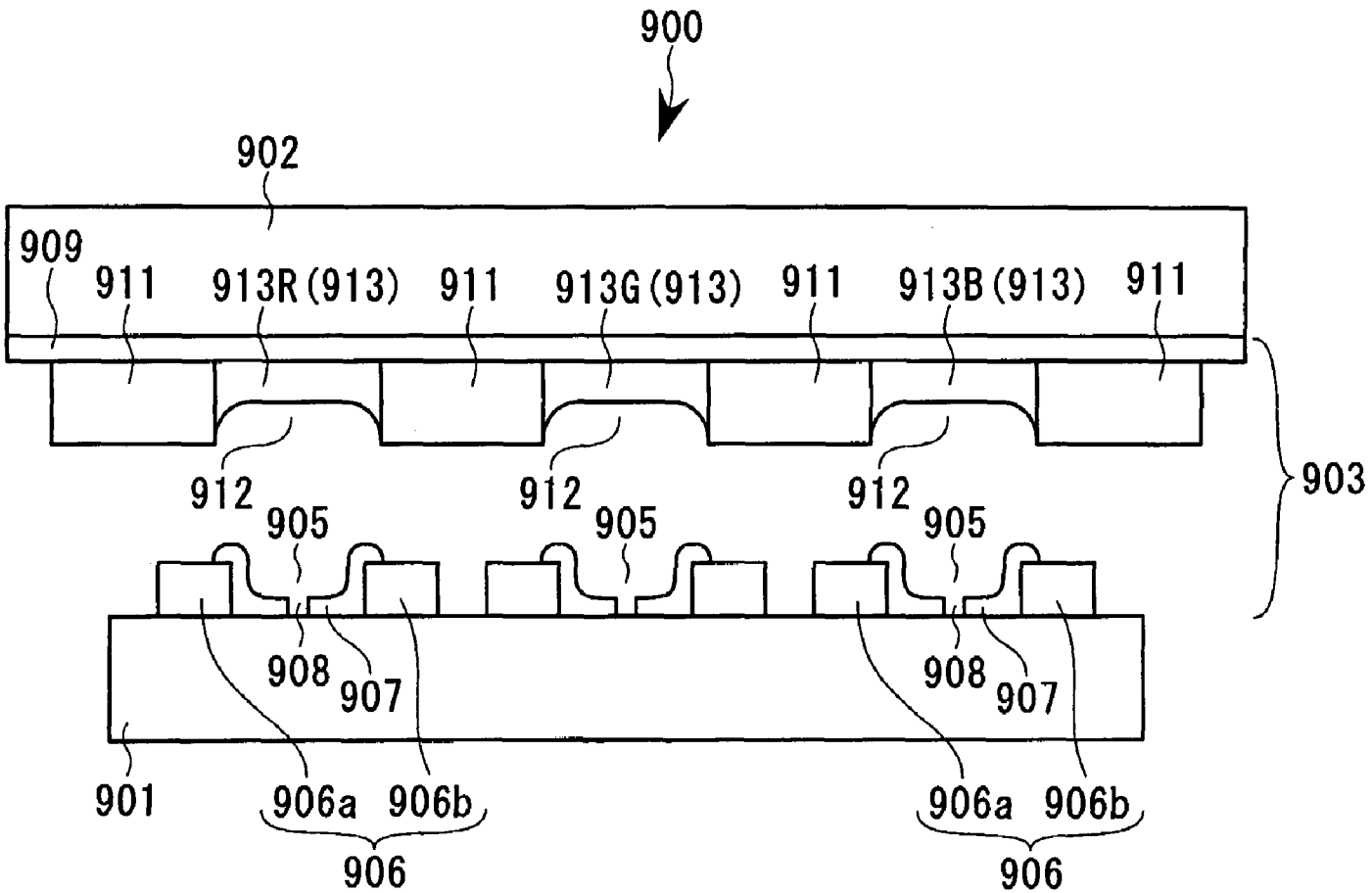
FIG. 34 is a sectional view of a main portion of a display device which is of a type of electron emission discharge (FED) device.

FIG. 34 is a sectional view showing an important part of the electron emission device (FED device or SED device, hereinafter simply referred to as a display device 900). In the figure, the display device 900 is partly shown in section.

The display device 900 is substantially made up of a first substrate 901 and a second substrate 902 which are disposed opposite to each other, as well as a field emission display part 903 which is formed therebetween. The field emission display part 903 is constituted by a plurality of electron emission parts 905 which are arranged in matrix.

On an upper surface of the first substrate 901, there are formed first element electrodes 906*a* and second electrodes 906*b* which constitute cathode electrodes 906, in a manner to cross each other at right angles. In each of the portions partitioned by the first element electrodes 906*a* and the second element electrodes 906*b*, there is formed a conductive film 907 with a gap 908 formed therein. In other words, a plurality of electron emission parts 905 are constituted by the first element electrodes 906*a*, the second element electrodes 906*b* and the conductive film 907. The conductive film 907 is made, e.g., of palladium oxide (PdO), or the like, and the gap 908 is formed by the work called forming, or the like, after having formed the conductive film 907.

On a lower surface of the second substrate 902, there is formed an anode electrode 909 which lies opposite to the cathode electrode 906. On a lower surface of the anode electrode 909, there is formed a lattice-shaped bank part 911. In each of the downward-looking openings 912 enclosed by the bank part 911, there is disposed a fluorescent body 913 in a manner to correspond to the electron emission part 905. The fluorescent body 913 emits light of either red (R), green (G), and blue (B). In each of the opening parts 912, there is disposed a red fluorescent body 913R, a green fluorescent body 913G, and a blue fluorescent body 913B in a predetermined pattern.

The first substrate 901 and the second substrate 902 constituted as described above are adhered to each other at a very small gap therebetween. In this display device 900, the electrons to be emitted from the first element electrode 906*a* and the second element electrode 906*b* as the cathode are excited and caused to emit light through the conductive film (gap 908) 907 by causing them to hit the fluorescent body 913 formed on the anode electrode 909 which is the anode. Color display is thus possible.

In this case, too, as in the other embodiments, the first element electrode 906*a*, the second element electrode 906*b*, the conductive film 907, and the anode electrode 909 can be formed by using the imaging apparatus 1. Fluorescent bodies 913R, 913G, 913B of each color can be formed by using the imaging apparatus 1.

Figure 35A:
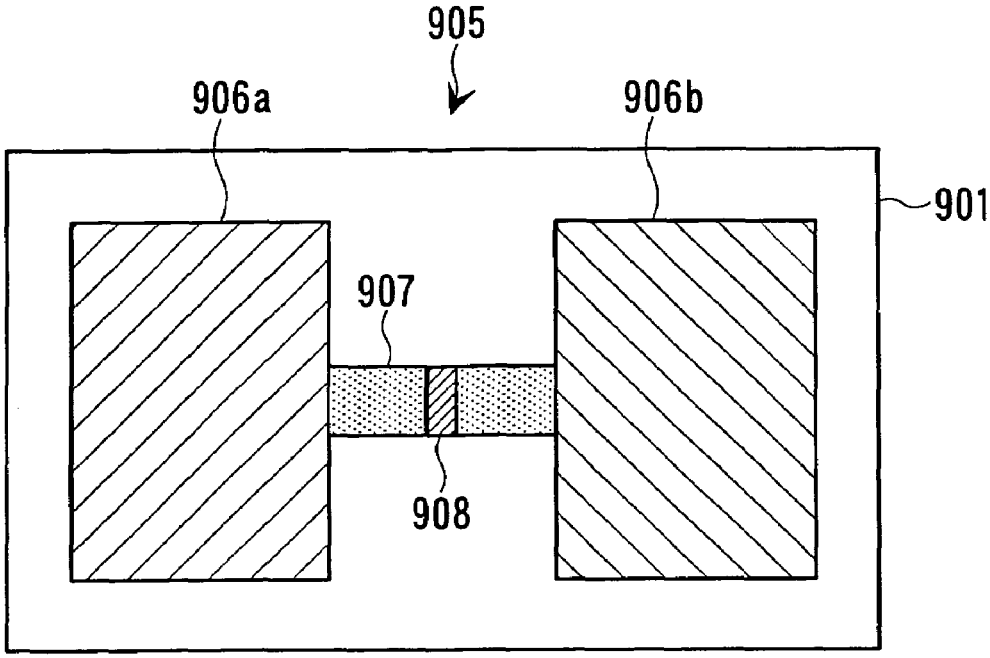
FIG. 35A is a plan view around the electron emission part of the display device and FIG. 35B is a plan view explaining the process of forming thereof.
Figure 35B:
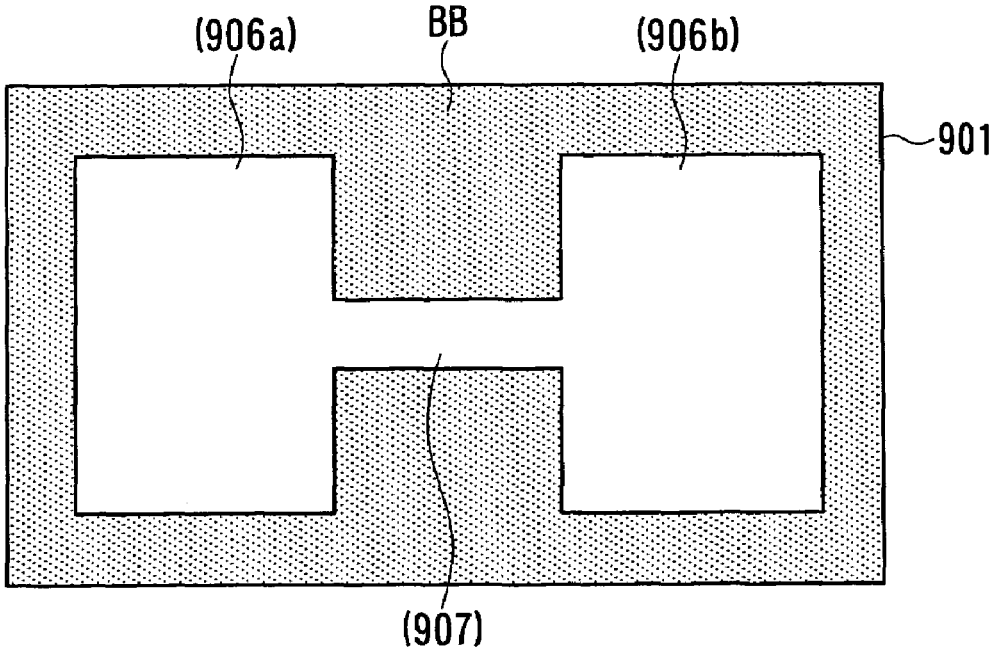

The first element electrode 906*a*, the second element electrode 906*b* and the electrically conductive film 907 has a flat shape as shown in FIG. 35A. In forming this film, as shown in FIG. 35B, the bank portion BB is formed by photolithographic method while leaving the portions in which the first element electrode 906*a*, the second element electrode 906*b*, and the electrically conductive film 907 are formed. Then, in the groove portion which is constituted by the bank portion BB, the first element electrode 906*a* and the second element electrode 906*b* are formed (by ink jet method with the imaging apparatus 1). After the solvent is dried and the film is formed, the electrically conductive film 907 is formed (in the ink jet method with the imaging apparatus 1). Then, after having formed the electrically conductive film 907, the bank portion BB is removed (peeling by the processing called ashing), and the process proceeds to the above-described forming processing. In the same manner as in the above-described organic EL device, it is preferable to perform the liquid-affinity processing to the first substrate 901 and the second substrate 902, as well as the liquid-repellency processing to the bank portion 911, BB.

As the other electro-optical apparatus, there can be considered an apparatus for forming a metallic wire, for forming a lens, for forming a resist, for forming a light diffusion body, or the like. Various electro-optical apparatus (devices) can be efficiently manufactured with the imaging apparatus 1 as described above.

What is claimed is:

1. A wiping apparatus for wiping a nozzle surface of a function liquid droplet ejection head by a wiping sheet coated with a cleaning liquid capable of dissolving a function liquid, the apparatus comprising:

a feeding reel for feeding the wiping sheet;

a spray head for spraying and coating the wiping sheet fed from the feeding reel with the cleaning liquid;

a wiping member for causing the wiping sheet coated with the cleaning liquid to be urged against the nozzle surface of the function liquid droplet ejection head, thereby performing a wiping operation;

a take-up reel for taking up the wiping sheet passing through the wiping member;

a cover box covering at least the feeding reel, the take-up reel, the wiping member and the spray head, as well as a sheet-feeding passage for the wiping sheet, the passage extending from the feeding reel to the take-up reel through the wiping member; and an apparatus frame supporting the above-described constituting elements of the apparatus, wherein the cover box has formed therein a member opening through which the wiping member protrudes;

a protruding/withdrawal mechanism for supporting the wiping member and also for causing the wiping member to be protruded or withdrawn from the member opening;

an open/close lid for opening or closing the member opening; and a cover interlocking mechanism for closing the open/close lid in a manner interlocked with an withdrawing movement of the wiping member by the protruding/withdrawal mechanism.

2. A wiping apparatus for wiping a nozzle surface of a function liquid droplet ejection head by a wiping sheet coated with a cleaning liquid capable of dissolving a function liquid, the apparatus comprising:

a feeding reel for feeding the wiping sheet;

a spray head for spraying and coating the wiping sheet fed from the feeding reel with the cleaning liquid;

a wiping member for causing the wiping sheet coated with the cleaning liquid to be urged against the nozzle surface of the function liquid droplet ejection head, thereby performing a wiping operation;

a take-up reel for taking up the wiping sheet passing through the wiping member;

a cover box covering at least the feeding reel, the take-up reel, the wiping member and the spray head, as well as a sheet-feeding passage for the wiping sheet, the passage extending from the feeding reel to the take-up reel through the wiping member; and an apparatus frame supporting the above-described constituting elements of the apparatus, wherein the cover box has formed therein a member opening through which the wiping member protrudes, the wiping member is disposed on an upper end, the spray head is disposed on an upper portion, and the feeding reel and the take-up reel are disposed on a lower portion of the apparatus, respectively; and wherein the cover box comprises an upper covering part for covering the upper portion, and a lower covering part for covering the lower portion, respectively, of the apparatus, and wherein the upper covering part and the lower covering part are respectively detachably mounted on the apparatus frame.

3. The apparatus according to claim 2, wherein the upper covering part is made in two segments construction to partition the member opening, and each of the segments is detachably mounted on the apparatus frame.

4. The apparatus according to claim 2, further comprising a carrier arm for supporting the spray head, and a head scanning mechanism for causing the spray head to perform spray-scanning in a widthwise direction of the wiping sheet, wherein the upper covering part has formed therein a slit opening to which the carrier arm faces.

5. A wiping apparatus for wiping a nozzle surface of a function liquid droplet ejection head by a wiping sheet coated with a cleaning liquid capable of dissolving a function liquid, the apparatus comprising:

a feeding reel for feeding the wiping sheet;

a spray head for spraying and coating the wiping sheet fed from the feeding reel with the cleaning liquid;

a wiping member for causing the wiping sheet coated with the cleaning liquid to be urged against the nozzle surface of the function liquid droplet ejection head, thereby performing a wiping operation;

a take-up reel for taking up the wiping sheet passing through the wiping member;

a cover box covering at least the feeding reel, the take-up reel, the wiping member and the spray head, as well as a sheet-feeding passage for the wiping sheet, the passage extending from the feeding reel to the take-up reel through the wiping member; and an apparatus frame supporting the above-described constituting elements of the apparatus, wherein the cover box has formed therein a member opening through which the wiping member protrudes, the cover box has a pair of side plates which lie parallel with each other, and wherein at least one of the pair of side plates serves a dual purpose of the apparatus frame.

6. A wiping apparatus for wiping a nozzle surface of a function liquid droplet ejection head by a wiping sheet coated with a cleaning liquid capable of dissolving a function liquid, the apparatus comprising:

a feeding reel for feeding the wiping sheet;

a spray head for spraying and coating the wiping sheet fed from the feeding reel with the cleaning liquid;

a wiping member for causing the wiping sheet coated with the cleaning liquid to be urged against the nozzle surface of the function liquid droplet ejection head, thereby performing a wiping operation;

a take-up reel for taking up the wiping sheet passing through the wiping member;

a cover box covering at least the feeding reel, the take-up reel, the wiping member and the spray head, as well as a sheet-feeding passage for the wiping sheet, the passage extending from the feeding reel to the take-up reel through the wiping member; and an apparatus frame supporting the above-described constituting elements of the apparatus, wherein the cover box has formed therein a member opening through which the wiping member protrudes, and the cover box has connected thereto an exhaust passage communicated with an exhaust equipment.

* * * * *